US005427064A

United States Patent [19]

Murata et al.

[11] Patent Number: 5,427,064

[45] Date of Patent: Jun. 27, 1995

[54] VALVE-MOVING APPARATUS FOR INTERNAL COMBUSTION ENGINE

[75] Inventors: Shinichi Murata; Setsuo Nishihara; Tetsuo Kataoka; Hideki Miyamoto; Noriyuki Miyamura; Masahiko Kubo; Hirofumi Higashi, all of Kyoto, Japan

[73] Assignee: Mitsubishi Jidosha Kogyo Kabushiki Kaisha, Tokyo, Japan

[21] Appl. No.: 267,279

[22] Filed: Jun. 28, 1994

Related U.S. Application Data

[62] Division of Ser. No. 23,390, Feb. 26, 1993.

[30] Foreign Application Priority Data

| | | | |
|---|---|---|---|
| Feb. 28, 1992 | [JP] | Japan | 4-43029 |
| Feb. 28, 1992 | [JP] | Japan | 4-43030 |
| Mar. 4, 1992 | [JP] | Japan | 4-46709 |
| Mar. 4, 1992 | [JP] | Japan | 4-46710 |
| Mar. 5, 1992 | [JP] | Japan | 4-48249 |
| Mar. 5, 1992 | [JP] | Japan | 4-48250 |
| Mar. 5, 1992 | [JP] | Japan | 4-48251 |
| Mar. 16, 1992 | [JP] | Japan | 4-57913 |
| Mar. 26, 1992 | [JP] | Japan | 4-15952 U |
| Mar. 27, 1992 | [JP] | Japan | 4-70847 |
| Mar. 31, 1992 | [JP] | Japan | 4-18495 U |
| Mar. 31, 1992 | [JP] | Japan | 4-18496 U |
| Mar. 31, 1992 | [JP] | Japan | 4-76730 |
| Jul. 17, 1992 | [JP] | Japan | 4-189791 |
| Jul. 31, 1992 | [JP] | Japan | 4-205475 |

[51] Int. Cl.[6] ..... F01L 1/34; F01L 1/18

[52] U.S. Cl. ..... 123/90.16; 123/90.36; 123/90.42; 123/90.44

[58] Field of Search ..... 123/90.15, 90.16, 90.17, 123/90.33, 90.35, 90.36, 90.39, 90.4, 90.42, 90.44, 90.65

[56] References Cited

U.S. PATENT DOCUMENTS

| | | | |
|---|---|---|---|
| 4,848,285 | 7/1989 | Konno | 123/90.16 |
| 5,020,488 | 6/1991 | Watanabe | 123/90.16 |
| 5,099,806 | 3/1992 | Murata et al. | 123/90.16 |
| 5,203,289 | 4/1993 | Hara et al. | 123/90.16 |

FOREIGN PATENT DOCUMENTS

| | | |
|---|---|---|
| 262269 | 4/1988 | European Pat. Off. . |
| 0267696 | 5/1988 | European Pat. Off. . |
| 0323233 | 7/1989 | European Pat. Off. . |
| 0420159 | 4/1991 | European Pat. Off. . |
| 0452158 | 10/1991 | European Pat. Off. . |
| 0760104 | 10/1952 | Germany . |
| 4122827 | 1/1992 | Germany . |
| 2199079 | 6/1988 | United Kingdom . |

OTHER PUBLICATIONS

Patent Abstracts of Japan vol. 11, No. 102 (M-576) 31 Mar. 1987 & JP-A-61 250 312 (Mazda Motor Corp) 7 Nov. 1986.

Patent Abstracts of Japan vol. 15, No. 211 (C-836) 29 May 1991 & JP-A-30 060 467 (Toshiba Corp) 15 Mar. 1991.

Patent Abstracts of Japan vol. 9, No. 294 (M-431) 20 Nov. 1985 & JP-A-60 132 011 (Honda) 13 Jul. 1985.

JP Application NO. 3-213604 with English Abstract, Sep. 1991.

*Primary Examiner*—Willis R. Wolfe

*Assistant Examiner*—Weilun Lo

[57] ABSTRACT

In a valve-moving apparatus for an internal combustion engine, lever members are integrally formed with rocker shaft parts and arm parts, the lever members are provided with large-diameter parts larger in diameter than support parts, disposed between support parts of the rocker shaft parts supported by support members of the engine and the arm parts; rocker arms driven by cams are rotatably supported on the large-diameter parts; and change-over mechanisms for selectively engaging the large-diameter parts and the rocker arms are disposed in the large-diameter parts, thereby improving rigidity of the large-diameter parts and achieving improved reliability of the change-over mechanisms.

20 Claims, 51 Drawing Sheets

VALVE-MOVING APPARATUS FOR INTERNAL COMBUSTION ENGINE

This application is a divisional of application Ser. No. 08/023,390, filed on Feb. 26, 1993, pending.

BACKGROUND OF THE INVENTION

1. Field of the Invention

This invention relates to a valve-moving apparatus for an internal combustion engine for controlling operation of an intake valve and an exhaust valve disposed in an automobile engine and the like.

2.Description of the Prior Art

In general, in open/close control of an intake valve and an exhaust valve of an automobile engine, the open/close timing is set according to the operating condition determined from an engine rotation speed, the amount of depression of accelerator pedal, and the like. In such a valve-moving apparatus, there is proposed one which varies a cam profile according to the operation condition to improve the fuel consumption at a low speed and to improve volumetric efficiency into the cylinders at a high speed. This is achieved by varying the open/close timing, lift amount, release time, and the like of the intake and exhaust valves at a low or a high speed.

Specifically, the automobile engine is provided with a high-speed cam and a low-speed cam, the high-speed cam having a cam profile which is able to obtain a valve open/close timing for high-speed operation, and on the other hand, the low-speed cam having a cam profile which is able to obtain a valve open/close timing for low-speed operation. During operation of the engine, the high-speed cam or the low-speed cam can be selectively used according to the operating condition in order to obtain an optimum open/close timing of the intake and exhaust valves.

Further, in such an automobile engine, there has been previously proposed a cylinder-closing mechanism which stops operation of two of four cylinders of a 4-cylinder engine to improve the fuel comsumption. That is, in the valve-moving apparatus, during idle operation or low-load operation, the piston operates but operation of the intake and exhaust valves is stopped to discontinue supply of fuel.

This cylinder-closing mechanism for stopping operation of the intake and exhaust valves is generally operated by providing a change-over mechanism in the rocker arm and hydraulically controlling the change-over mechanism. In this case, hydraulic pressure is supplied from a main oil pump of the engine to the change-over mechanism through an oil passage. As shown in FIG. 58, in order to operate the change-over mechanism, there is a necessary minimum change-over requirement hydraulic pressure. However, the hydraulic pressure from a main oil pump of the engine tends to be lower than the change-over requirement hydraulic pressure. Therefore, an assist oil pump is provided in addition to the main oil pump of the engine to obtain a hydraulic pressure for the change-over mechanism higher than the operation requirement hydraulic pressure.

FIG. 59 shows a plan view of a cylinder head showing the valve-moving apparatus having a prior art cylinder-closing mechanism, and FIG. 60 shows a hydraulic passage of the valve-moving apparatus.

As shown in FIG. 59 and FIG. 60, a cam shaft 1202 is rotatably mounted at the center of a cylinder head 1201, and a cam (not shown) is integrally formed at a predetermined position. A pair of rocker shafts 1203 are also rotatably mounted on the cylinder head 1201, parallel to the cam shaft 1202. Bases of a rocker arm 1204 and a rocker arm 1206 having a change-over mechanism 1205 are individually mounted to the rocker shafts 1203, and rocking ends of the rocker arms 1204 and 1206 oppose top ends of intake or exhaust valves 1207. Furthermore, an assist oil pump 1208, an accumulator 1209, and an oil control valve 1210 are mounted on an end portion of the cylinder head 1201. The assist oil pump 1208 can be driven by a driving cam 1211 attached to one end of the cam shaft 1202, and the oil control valve 1210 can be operated by a control signal from a control unit 1212.

When the cam shaft 1202 rotates, the rocker arm 1204 and the rocker arm 1206 are rocked by the cam to drive the intake and exhaust valves 1207. During idle operation or low-load operation, the engine is operated with two of the four cylinders unworked. Specifically, the oil pump 1208 is driven by the driving cam 1211 of the cam shaft 1202, and hydraulic pressure is stored in the accumulator 1209. On the other hand, the control unit 1212 determines the operating condition of the engine from signals from various sensors and sends a control signal to the control valve 1210 to change it over. Then, hydraulic pressure is sen to the change-over mechanism 1205 of the rocker arm 1206 to stop the driving of the corresponding intake and exhaust valves 1207. Therefore, the engine is operated only with the driving of the intake and exhaust valves 1207 corresponding to the rocker arm 1204.

SUMMARY OF THE INVENTION

In the above-described prior art valve-moving apparatus for an engine, some of rocker arms 1206 are provided with change-over mechanisms to stop two of the four cylinders during idle operation or low-load operation of the engine. For this purpose, the oil pump 1208 or the accumulator 1209 or the like is required, which must be mounted to the cylinder head 1201. In the past, as described above, the device has been provided on one end of the cylinder head 1201. However, this projects part of the engine upward. Consequently, a cylinder head cover on the upper part of the cylinder head 1201 must also be projected upward, increasing the height of the engine. This leads to a large-sized engine and difficulty in layout when the engine is mounted on the vehicle.

With a view to eliminating such prior art problems, it is a primary object of the present invention to provide a valve-moving apparatus in which large-diameter parts are provided on rocker shaft parts, and rocker arms are rotatably supported on the large-diameter parts, thereby improving rigidity of the rocker shaft parts.

Another object of the present invention is to provide a valve-moving apparatus in which an oil pump is disposed between an intake cam shaft and an exhaust cam shaft and is driven by the oil pump cam mounted on the cam shaft, and the oil pump and an accumulator are disposed at the upper and lower sides, thereby enabling a space-saving, compact internal combustion engine and simplified layout when mounted in the vehicle.

A further object of the present invention is to provide a valve-moving apparatus for an internal combustion engine in which necessary hydraulic pressure is positively supplied to prevent malfunctions of the valves.

A further object of the present invention is to provide a valve-moving apparatus in which a high-speed rocker arm which is applied with a small inertial force is urged by a spring having a small biasing force, and a low-speed rocker arm which is applied with large inertial force is urged by a spring having a large biasing force, thereby removing unnecessary forces to the individual rocker arms and reducing friction.

A further object of the present invention is to provide a valve-moving apparatus for an internal combustion engine, in which operability of a change-over mechanism is improved when a cylinder is closed.

A further object of the present invention is to provide a lubrication apparatus for a valve-moving apparatus for an internal combustion engine, in which a common lubrication passage to the arm springs is used, thereby reducing man-power for manufacturing processing.

A further object of the present invention is to provide a valve-moving apparatus for an internal combustion engine, in which hydraulic pressure is supplied to the oil passage according to the operating condition of the internal combustion engine, and a projection of a connecting plunger in the rocker shaft is set so that a first or second sub-rocker arm is selectively integrated with or disconnected from the rocker shaft, and transmission of the driving force from both of the sub-rocker arms to the rocker shaft is set off to set cylinder closing. When a rock pin engages with an engaging hole in the rocker arm, the rock pin and the engaging hole make a line contact.

A further object of the present invention is to provide a valve-moving apparatus for an internal combustion engine, in which pressure of an oil passage is set according to the operating condition of the internal combustion engine, and a projection of a connecting plunger in the rocker shaft is set so that a first or second sub-rocker arm is selectively integrated with or disconnected from the rocker shaft. A biasing means insertion part is formed in the rocker shaft separately from a through-hole in the rocker shaft, thereby reducing the diameter of projection of a rock pin in the through-hole.

A further object of the present invention is to provide a valve-moving apparatus, in which the same cam shaft holder and the like can be used for an engine having only a valve open timing adjustment mechanism, or an engine further having a valve operation stopping mechanism.

A further object of the present invention is to provide a valve-moving apparatus, in which an opening of a through-hole provided in a direction perpendicular to the axial direction of the rocker shaft section is chamfered, thereby improving the productivity of the rocker shaft.

A further object of the present invention is to provide a valve-moving apparatus, in which a recess is provided in a plug housing, a rocking center of the rocker arm is moved to the center side, and the cam shaft and the like are also moved to the center side, thereby enabling a compact cylinder head.

A further object of the present invention is to provide a valve-moving system structure having a variable valve timing mechanism, in which a low-speed roller is formed of a lighter material than for a high-speed roller, thereby improving dynamic characteristics of the valve-moving system at a reduced cost.

A further object of the present invention is to provide a valve-moving apparatus, in which an elephant foot structure is used in a part of a rocker arm part contacting against a valve, thereby maintaining the valve clearance without complex maintenance work.

A further object of the present invention is to provide a valve-moving apparatus, in which an oil injection hole directed to a contact surface between roller and cam is formed on an end of the rocker arm, thereby achieving sufficient lubrication to the roller part.

A further object of the present invention is to provide a valve-moving apparatus for an engine, which provides smooth reversion from cylinder-closing operation to all-cylinder operation, or a change in valve timing of an engine of a type which is possible to close a cylinder or vary the valve timing.

In accordance with the present invention, there is provided a valve-moving apparatus for an internal combustion engine comprising:

cam shafts provided with cams;

lever members disposed adjacent to the cam shafts each lever member comprising a rocker shaft part rotatably mounted on support members of the engine, a large-diameter part integrally formed with each of the rocker shaft parts and having an outer diameter larger than an outer diameter of the rocker shaft part, and an arm par integrally formed with the large-diameter parts and contacting against intake and exhaust valves;

rocker arms rotatably mounted on the large-diameter parts and rocked by the cams;

change-over mechanism means for selectively engaging the rocker arms with each of the large-diameter parts; and hydraulic pressure supply means for hydraulically operating the change-over mechanism means according to an operating condition of the engine.

The cam shafts have a low-speed cam and a high-speed cam, and the rocker arms are rotatably mounted individually on the large-diameter parts on both sides of the arm parts, and have a low-speed rocker arm and a high-speed rocker arm individually driven by the low-speed cam and the high-speed cam.

The low-speed rocker arm and the high-speed rocker arm are provided with roller bearing means individually driven by the low-speed cam and the high-speed cam, and rotatably mounted individually on the low-speed rocker arm and the high-speed rocker arm, respectively.

The low-speed rocker arm and he high-speed rocker arm are urged so that the individual roller bearing means contact against the individual cams by first arm spring means.

The lever members are urged by biasing means mounted to the support members to contact against the valves.

The valves are formed so that the valves are urged only in an initial sage when the valves are lifting.

The biasing means is formed of second arm spring means mounted on the support members.

The biasing means is formed of plate springs mounted on the support members.

The biasing means is formed of torsion springs mounted on the support members.

The first arm spring means sets urging force of the spring for urging the low-speed rocker arm to be greater than biasing force of the spring for urging the high-speed rocker arm.

The hydraulic pressure supply means is provided with an oil passage disposed in a cam cap supporting the cam shaft for supplying lubricating oil to the first arm spring.

The roller bearing means has low-speed roller bearing means formed of a material lighter in weight than a material of high-speed roller bearing means.

The low-speed roller bearing means is formed of a ceramic, and the high-speed roller bearing means is formed of a ferrous metal.

Furthermore, in the valve-moving apparatus for an internal combustion engine according to the present invention, the cam shafts comprise a low-speed cam and a high-speed cam;

the rocker arms are rotatably mounted on the large-diameter parts and have a high-speed rocker arm driven by the high-speed cam; and the lever members are driven by the low-speed cam.

The high-speed rocker arm has high-speed roller bearing means which is driven by the high-speed cam and is rotatably mounted on the high-speed rocker arm; and the lever members have low-speed roller bearing means rotatably mounted on the low-speed rocker arm.

The high-speed rocker arm is urged by first arm spring means mounted on the support members to urge the high-speed roller bearing means to contact against the high-speed cam.

The lever members are urged by biasing means mounted on the support members to contact against the valves.

The biasing means are formed so that the valves are urged only in an initial stage when the valves are lifting.

The biasing means is formed of second arm spring means mounted on the support members.

The biasing means is formed of a plate spring mounted on the support members.

The biasing means is formed of torsion springs mounted to the support members.

The biasing force of the spring of the first arm spring means is set to a greater value than the biasing force of the spring of the second arm spring means.

The cam cap supporting the cam shaft is provided with an oil passage for supplying lubricating oil to the first arm spring.

The low-speed roller bearing means is formed of a material lighter in weight than a material of the high-speed roller bearing means.

The low-speed roller bearing means is formed of a ceramic, and the high-speed roller bearing means is formed of a ferrous metal.

The rocker shaft parts are individually provided with oil jets for supplying oil to the low-speed roller bearing means and the high-speed roller bearing means.

The oil jets are provided with oil reservoirs at their outlet parts.

The hydraulic pressure supply means is provided with an oil control valve for supplying hydraulic pressure from the oil pump of the engine to an oil chamber of the change-over mechanism means of the high-speed rocker arm.

Furthermore, in the valve-moving apparatus for an internal combustion engine according to the present invention, the cam shafts have a plurality of low-speed cam and high-speed cam, the lever members are provided in a plurality of units, some of the rocker arms are rotatably mounted individually on the large-diameter parts on both sides of some of the arm parts and individually driven by the low-speed cam and the high-speed cam, and the other of the rocker arms are rotatably mounted to the large-diameter parts of one side adjacent to one side of the other of the arm parts driven by the low-speed cam and driven by the high-speed cam.

Lengths of both sides of the low-speed rocker arm and the high-speed rocker arm mounted on both sides of some of the arm parts in a direction along the center axis line of the rocker shaft par are set equal to lengths of both sides of the high-speed rocker arm mounted on one side of the other of arms and the large-diameter part provided on one side of the other of arms in the same direction.

The hydraulic pressure supply means comprises: a first oil control valve for supplying hydraulic pressure from the oil pump of the engine to oil chambers of the change-over mechanism means provided in the high-speed rocker arms of the side of some and the other of rocker arms; and a second oil control valve for supplying hydraulic pressure from the oil pump of the engine through the accumulator and the second oil pump to oil chambers of the change-over mechanism means provided in the low-speed rocker arms of the side of some of the rocker arms.

The hydraulic pressure supply means comprises an oil jet provided in the rocker shaft part for supplying hydraulic oil to the high-speed roller bearing means provided in the high-speed rocker arm.

The oil jet is provided with an oil reservoir at its outlet part.

The second oil control valve is disposed between the intake cam shaft and the exhaust cam shaft.

The second oil control valve is formed on the accumulator.

The second oil pumps are formed on one of cam shafts and driven by cams greater in number than the closed cylinders.

The cam is formed on one end of the intake cam shaft.

Furthermore, in the valve-moving apparatus for an internal combustion engine according to the present invention, the change-over mechanism means comprises:

an engaging hole formed on a rotating surface of the rocker arm rotating the rocker shaft part;

a through-hole disposed in the rocker shaft part in a direction perpendicular to the axial direction of the rocker shaft part and having a center axis line in line with the center axis line of the engaging hole when the roller bearing means is in contact with a base circle of the cam;

a rock in disposed projectable from a withdrawal position in the through-hole to a projection position on the engaging hole side and engaging with the engaging hole when both center axis lines are in line with each other;

an oil chamber disposed between one end of the rock pin and a rotation surface of the rocker arm; and a compression spring disposed between the other end of the rock pin and the rotation surface of the rocker arm.

The change-over mechanism means has an oil passage communicating with the engaging hole formed in the rock pin, and a plate-metal cover attached to the engaging hole to close the oil chamber.

The cover is disposed on the engaging hole of the low-speed rocker arm rotatably mounted to the large-diameter part.

The change-over mechanism means has an oil passage communicating with the engaging hole formed in the rock pin, a hydraulic pressure passage formed in the rocker shaft part, and an oil passage formed on the inner peripheral surface of the through-hole for communicating the oil passage and the hydraulic pressure passage with each other.

The oil passage is formed annularly.

The change-over mechanism means has a compression spring disposed at the end surface side reverse to the side surface of the oil chamber of the rock pin, and a spring sheet engaging with the compression spring and supported by the rocker arm, with the outer diameter of the spring sheet being formed larger than the inner diameter of the engaging hole.

The change-over mechanism means has a spring hole provided separately from the through-hole in the rocker shaft part, and a compression spring disposed in the spring hole.

An end edge of the through-hole is formed by chamfering with a cylindrical cutter.

Furthermore, in the valve-moving apparatus for an internal combustion engine according to the present invention, the change-over mechanism means comprises:

an engaging hole formed on a rotating surface of the rocker arm rotating the rocker shaft part;

a through-hole disposed in the rocker shaft part in a direction perpendicular to the axial direction of the rocker shaft part and having a center axis line eccentric with respect to the center axis line of the engaging hole when the roller bearing means is in contact with a base circle of the cam;

a rock pin disposed projectable from a withdrawal position in the through-hole to a projection position on the engaging hole side and engaging with the engaging hole when the through-hole overlaps the engaging hole; and an oil chamber disposed between a rear end of the rock pin and a rotation surface of the rocker arm.

The center axis line of the engaging hole is formed eccentric from the center axis line of the through-hole to the roller bearing means side.

The valve-moving apparatus of the present invention is for an engine of a double overhead cam shaft type having two of the cam shafts.

A plug tube is disposed between the rocker arms, and a recess is formed on a part of the plug tube facing the rocker arm.

The lever member has an adjust screw mounted to a contact part of the valve, a pad in line contact with the adjust screw and in face contact with the valve, and a retainer for mounting the pad to the adjust screw.

The hydraulic pressure supply means has an oil groove for supplying hydraulic pressure from the oil pump of the engine to a journal part of the cam shaft.

DESCRIPTION OF THE PREFERRED EMBODIMENTS

Figure 1:
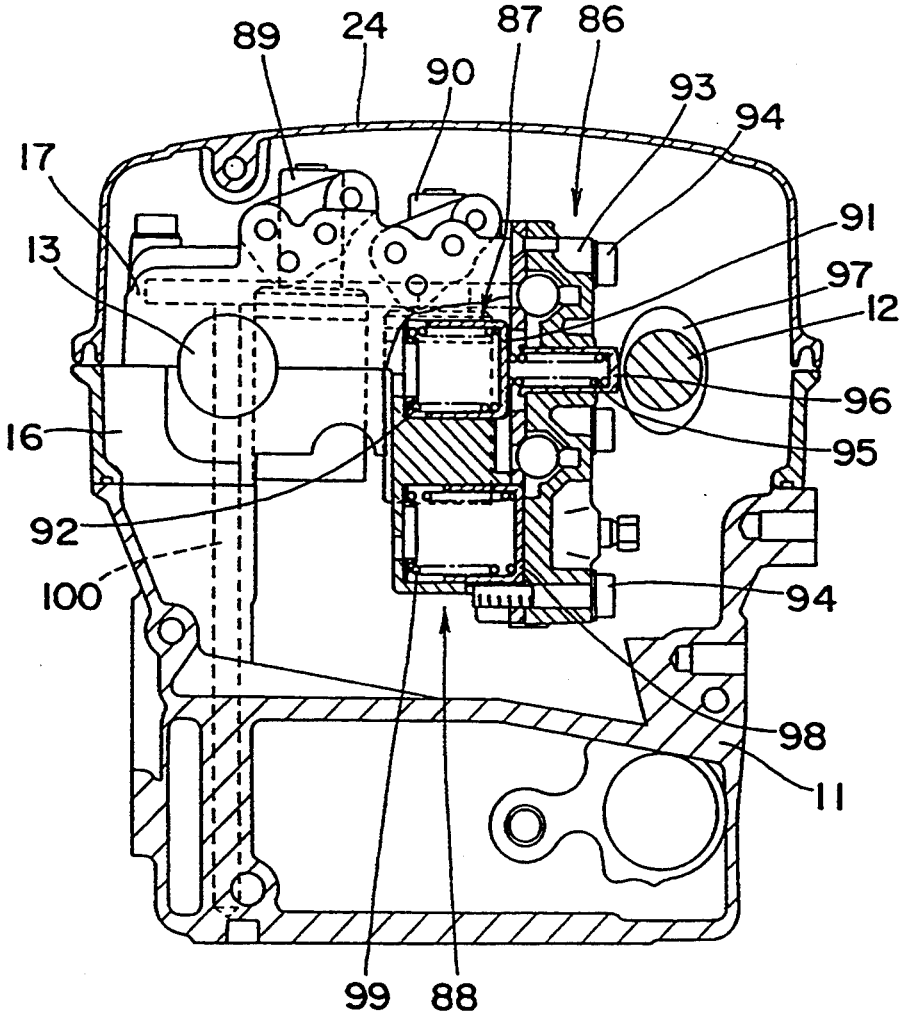
FIG. 1 is a schematic cross sectional view (I—I in FIG. 2) of a cylinder head showing part of a first embodiment of the valve-moving apparatus for an internal combustion engine according to the present invention.

A first embodiment of the present invention will now be described in detail with reference to FIGS. 1 to 11.

An internal combustion engine of the present embodiment is a 4-cylinder engine of a dual overhead cam shaft (DOHC) type having two cam shafts on the cylinder head, with two intake valves and two exhaust valves for each cylinder.

As shown in FIGS. 3 to 5 and FIG. 11, a cylinder head 11 is provided with a pair of cam shafts intake cam shaft 12 and exhaust cam shafts 13 which are parallel to each other along a longitudinal direction, and a low-speed cam 14 having a small lift amount and a high-speed cam 15 having a large lift amount are integrally formed on each of such cam shafts for each cylinder. The pair of cam shafts 12 and 13 are sandwiched between an upper portion of a cam shaft housing 16 and a plurality of cam caps 17 and mounted by bolts 18 and 19 on top of the cylinder head 11, thus being rotatably supported on the cylinder head 11.

Furthermore, in the cylinder head 11, a pair of a intake rocker part 21 and an exhaust rocker shaft part 22, which will be described later in detail, are disposed parallel to each other along the longitudinal direction and parallel to the pair of cam shafts 12 and 13 for each cylinder. The pair of rocker shaft parts 21 and 22 are sandwiched between a lower portion of the cam shaft housing 16 and a plurality of cam caps 23 and mounted by bolts 19 and 24 on a lower portion of the cylinder head 11, thus being rotatably supported on the cylinder head 11. A cylinder head cover 25 is mounted on top of the cylinder head 11.

Figure 11:
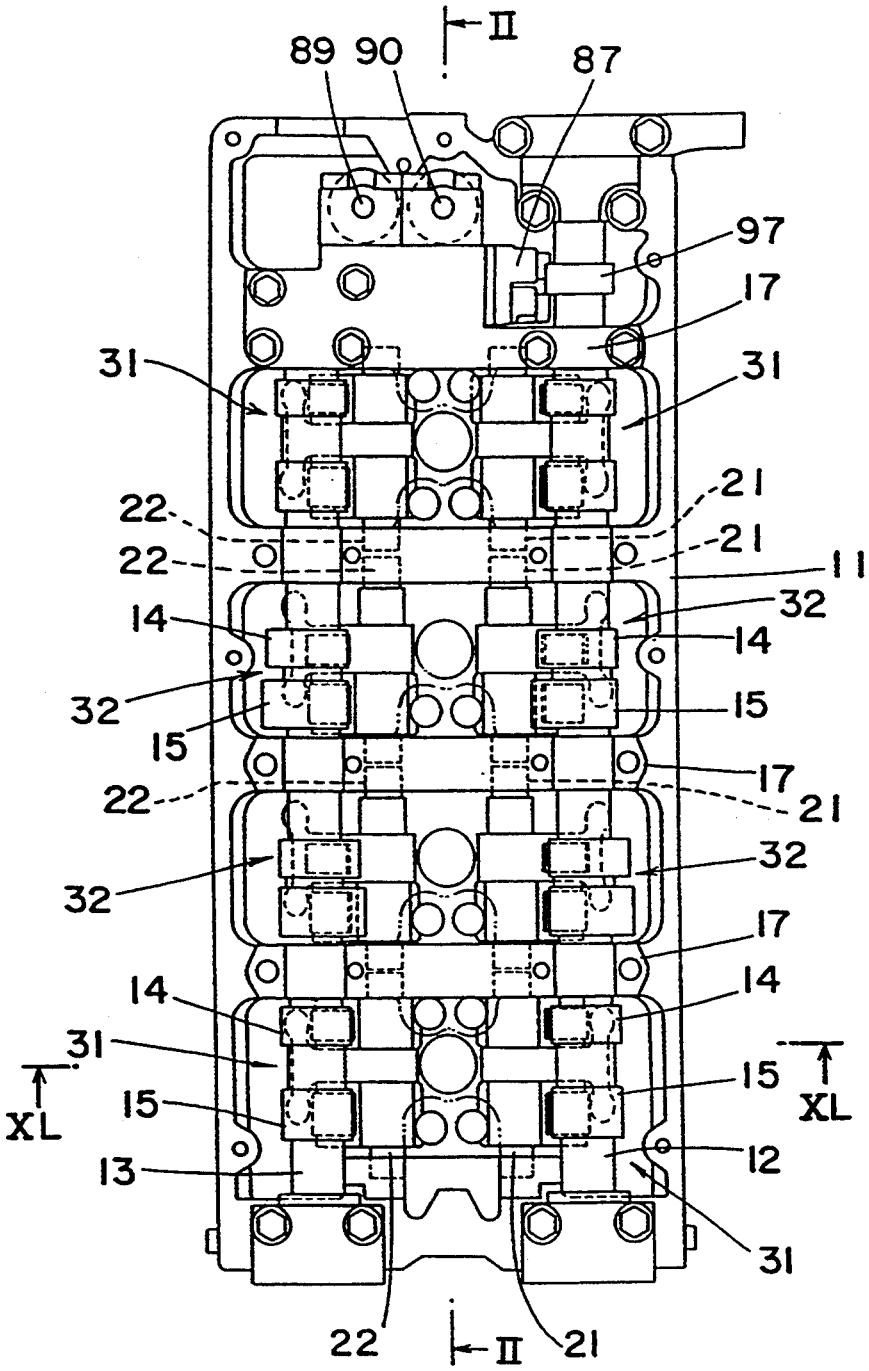
FIG. 11 is a schematic plan view showing a cylinder head.

Each of the rocker shaft parts 21 and 22 is provided with a valve-moving apparatus which can be changed over to a valve open/close timing for high-speed operation and a valve open/close timing for low-speed operation, and a valve-moving apparatus which can be changed over to a high-speed valve timing and a low-speed valve timing and which can be stopped from operating during low-load operation. Thus, as shown in FIG. 11, of the four cylinders, valve-moving apparatus 31 of the top and bottom two cylinders have cylinder-closing mechanisms, and valve-moving apparatus 32 of the two cylinders at the center have no cylinder-closing mechanisms.

Figure 6:
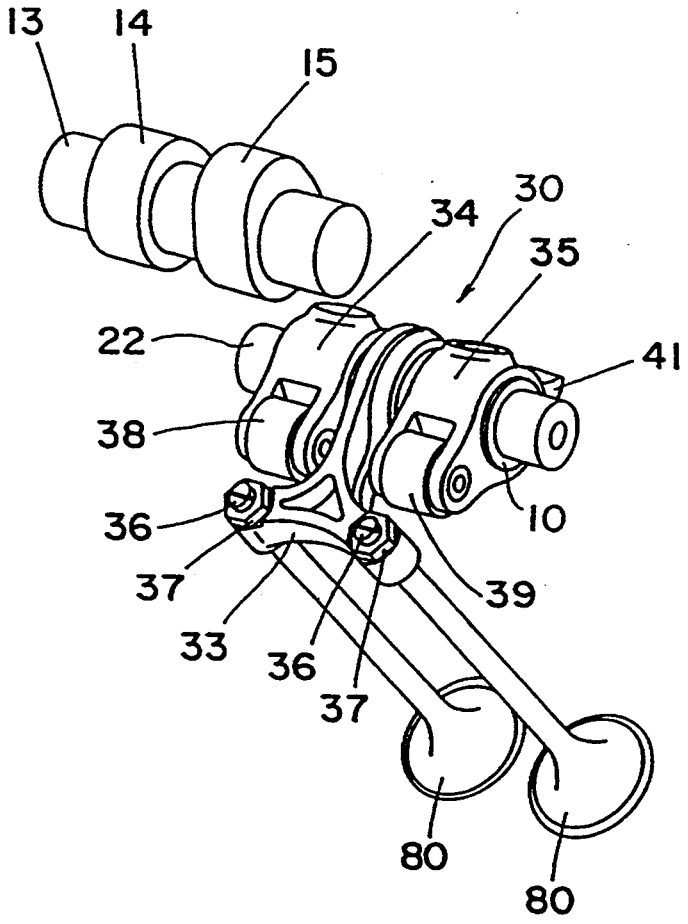
FIG. 6 is a schematic exploded perspective view of the valve-moving apparatus.

The valve-moving apparatus 31 with the cylinder-closing mechanism will now be described. As shown in FIG. 6, a T-formed lever 30 as a lever member is integrally formed, with a base of an arm part 33, which is nearly T-shaped in plan view, at the center of the T-formed lever 30, and a low-speed rocker arm 34 and a high-speed rocker arm 35 as sub-rocker arms disposed on both sides of the exhaust rocker shaft part 22. An adjust screw 36 is mounted to a rocking end of the arm part 33 by an adjust nut 37, and the bottom end of the adjust screw 36 is in contact against the top end of an exhaust valve 80, which will be described later.

On the other hand, the low-speed rocker arm 34, with its base attached to a large-diameter part 10 of the rocker shaft part 22, is rotatably supported, a roller bearing 38 being mounted to its rocking end, the roller bearing 38 being capable of engaging with the low-speed cam 14. Similarly, the high-speed rocker arm 35, with its base attached to the rocker shaft part 22, is rotatably supported, a roller bearing 39 being mounted to its rocking end, and the roller bearing 39 being capable of engaging with the high-speed cam 15.

Figure 5:
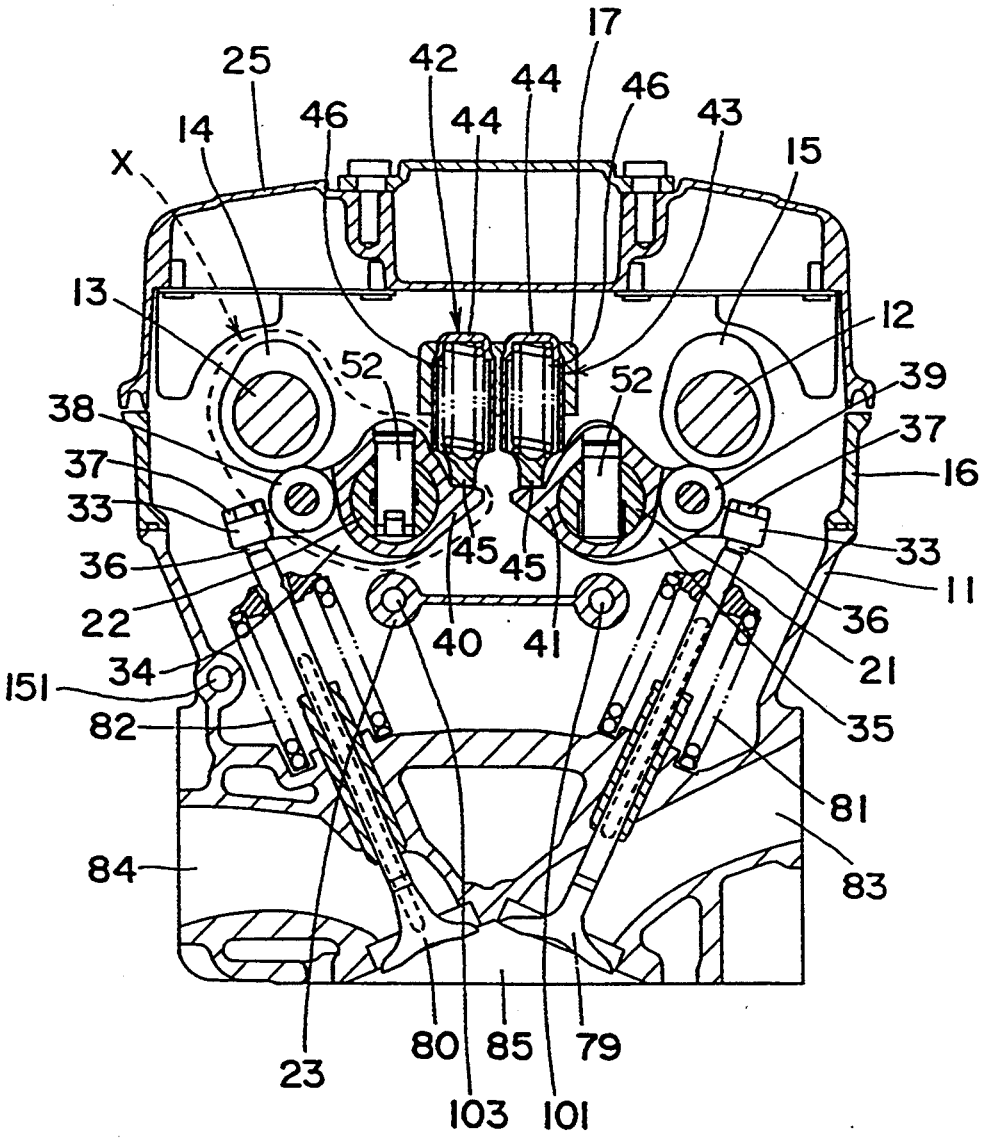
FIG. 5 is a schematic V—V cross sectional view of FIG. 3.

Furthermore, as shown in FIG. 5, the low-speed rocker arm 34 and the high-speed rocker arm 35 are formed individually with arm parts 40 and 41, respectively, at the opposite side to the rocking end to which the roller bearings 38 and 39 are mounted, and the arm parts 40 and 41 are urged by arm springs 42 and 43, respectively as first arm spring means. The arm springs 42 and 43 comprise cylinders 44 and plungers 45 fixed to the cam cap 17, and compression springs 46, each free end of the plunger 45 pressing the arm parts 40 and 41, respectively, to urge the individual rocker arms 34 and 35 shown at the left side in FIG. 5 clockwise, and the individual rocker arms 34 and 35 shown at the right side counter-clockwise.

Therefore, usually, in the low-speed rocker arm 34 and the high-speed rocker arm 35, the roller bearings 38 and 39 as roller bearing means contact against the outer peripheral surfaces of the low-speed cam 14 and the high-speed cam 15 of the cam shafts due to the arm springs 42 and 43. When the cam shafts 12 and 13 rotate, the individual cams 14 and 15 can operate to rock the low-speed rocker arm 34 and the high-speed rocker arm 35.

Figure 7:
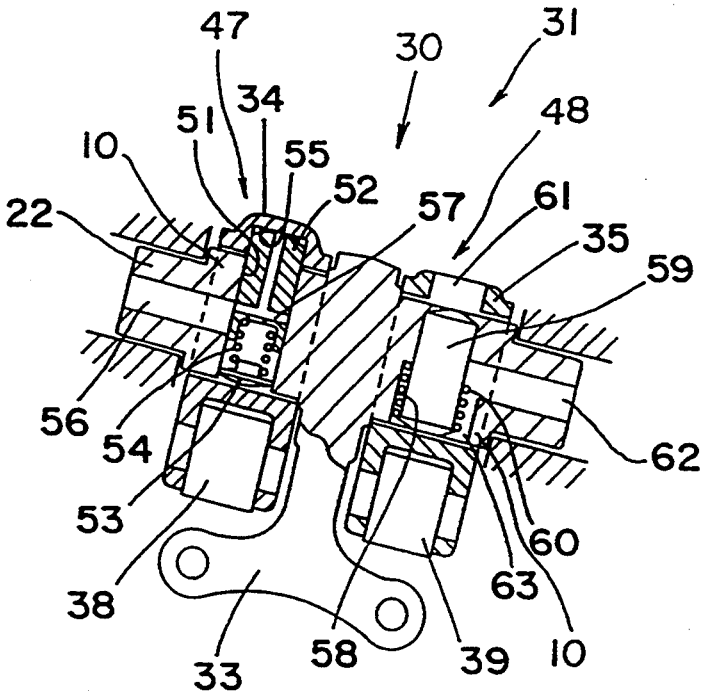
FIG. 7 is a schematic cross sectional view showing a change-over mechanism of the valve-moving apparatus.

As shown in FIG. 7, the low-speed rocker arm 34 and the high-speed rocker arm 35 can be integrally rotated with the rocker shaft part 22 by change-over mechanisms 47 and 48 as change-over mechanism means. The change-over mechanism 47 will be described. The rocker shaft part 22 is formed with a through-hole 51 at a position corresponding to the low-speed rocker arm 34 along its radial direction. A rock pin 52 is movably inserted into the through-hole 54, and urged in one direction by a compression spring 51 supported by a spring seat 53. On the other hand, the low-speed rocker arm 34 is formed with an engaging hole 55 at a position corresponding to the through-hole 51 of the rocker shaft part 22, and the engaging hole 55 is engaged with a rock pin 52 urged by a compression spring 52. The rocker shaft part 22 is formed with a hydraulic pressure passage 56 communicating with the through-hole 51 along its axial direction, and the rock pin 52 is formed with an oil passage 57 which communicates with the through-hole 51 and opens to the side to engage with the engaging hole 55.

Further, the change-over mechanism 48 will be described. The rocker shaft part 22 is formed with a through-hole 58 at a position corresponding to the high-speed rocker arm 35 along its radial direction. A rock pin 59 is movably inserted in the through-hole 58, and is urged in one direction by a compression spring 60. On the other hand, the high-speed rocker arm 35 is formed with an engaging hole 61 at a position corresponding to the through-hole 58 of the rocker shaft part 22, and the rock sin 59 is biased away from the engaging hole 61 by the compression spring 60. The rocker shaft 22 is formed with a hydraulic pressure passage 62 communicating with the though-hole 58 along its axial direction, and with an oil passage 63 communicating with an end opposing the engaging hole 61 of the through-hole 58.

Normally, as shown in FIG. (*a*), the low-speed rocker arm 34 becomes integral with the rocker shaft part 22 by engaging the rock pin 52 urged by the compression spring 54 with the engaging hole 55, and can be rotated with the main rocker arm 33 through the rocker shaft part 22. On the other hand, in the high-speed rocker arm 35, the rock pin 59, urged by the compression spring 60 is biased away from the engaging hole 61, and engagement with the rocker shaft part 22 is released not to rotate integrally with the rocker shaft part 22. Therefore, the low-speed cam 14 and the high-speed cam 15 rock the low-speed rocker arm 34 and the high-speed rocker arm 35, but only the driving force transmitted to the low-speed rocker arm 32 is transmitted to the arm part 33 through the rocker shaft part 22 to rock the arm part 33.

Figure 9A:
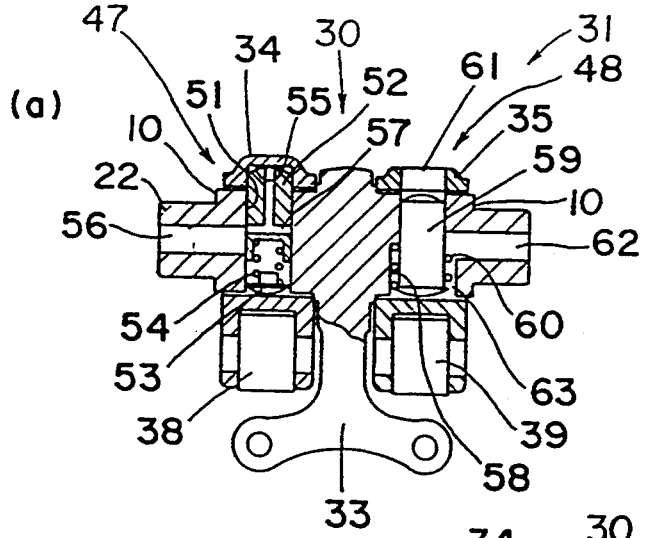
FIGS. 9 (*a*)–(*c*) are schematic views for explaining operation of a change-over mechanism.
Figure 9B:
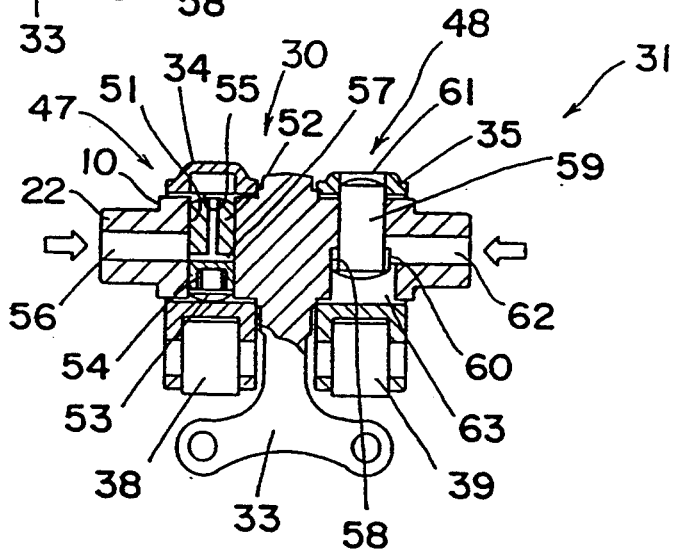
Figure 9C:
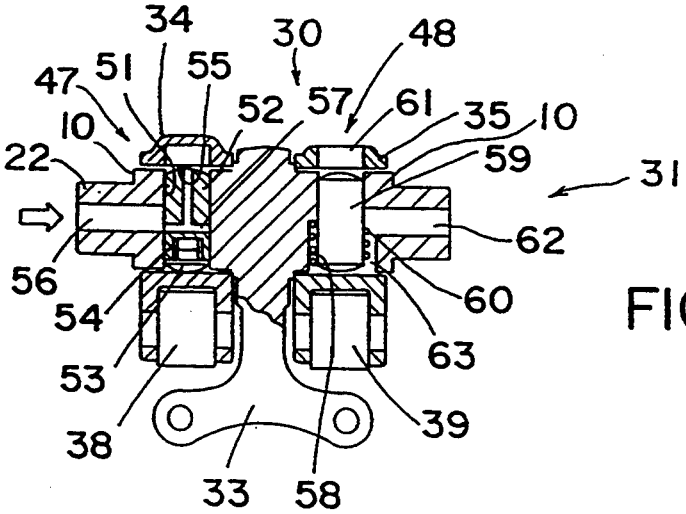

When hydraulic pressure is supplied to the individual hydraulic pressure passages 56 and 62 of the rocker shaft part 22, as shown in FIG. 9(*b*), in the low-speed rocker arm 34, hydraulic oil flows to the engaging hole 55 side of the through-hole 51 through the oil passage 57, causing the rock pin 52 to disengage from the engaging hole 55 against the biasing force of the compression spring 54. As a result, the low-speed rocker arm 34 is disengaged from the rocker shaft part 22 thereby not to rotate integrally. On the other hand, in the high-speed rocker arm 35, hydraulic oil flows in a direction opposite to the engaging hole 61 of the through-hole 58 through the oil passage 63, causing the rock pin 59 to engage with the engaging hole 61 against the urging force of the compression spring 60. As a result, the high-speed rocker arm 35 engages with the rocker shaft part 22 to rotate integrally therewith. Therefore, the low-speed cam 14 and the high-speed cam 15 rock the low-speed rocker arm 34 and the high-speed rocker arm 35, however, only the driving force transmitted to the high-speed rocker arm 35 is transmitted to the arm part 33 through the rocker shaft part 22, thereby rocking the arm part 33.

When hydraulic pressure is supplied only to the hydraulic pressure passage 56 of the rocker shaft part 22, as shown in FIG. 9(*c*), in the low-speed rocker arm 34, hydraulic oil flows to the engaging hole 55 side of the through-hole 51 to pull out the rock pin 52 from the engaging hole 55, and engagement of he low-speed rocker arm 34 with the rocker shaft part 22 is released not to rotate integrally. On the other hand, in the high-speed rocker arm 35, the rock pin 59 disengages from the engaging hole 61 due to the compression spring 60 to release engagement with the rocker shaft part 22, and does not rotate integrally. Therefore, the low-speed cam 14 and the high-speed cam 15 rock the low-speed rocker arm 34 and the high-speed rocker arm 35, but the driving force is not transmitted to the rocker shaft part 22, and the arm part 33 does not operate, thereby achieving a cylinder-closing condition.

Figure 10:
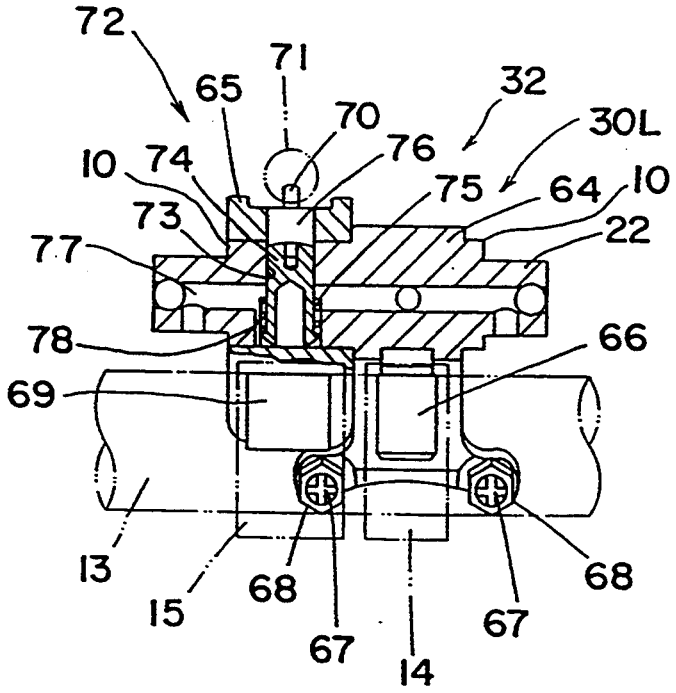
FIG. 10 is a schematic cross sectional view showing the valve-moving apparatus with no cylinder-closing mechanism.

In the valve-moving apparatus 32 with no cylinder-closing mechanism, as shown in FIG. 10, a T-formed lever (L) 30L as a lever member is provided at an end of the exhaust rocker shaft part 22 with a low-speed rocker arm 64 having a T-shaped plan view and a high-speed rocker arm 65 at the other end. A roller bearing 66 is mounted to a rocking end of the low-speed arm part 64 to engage with the low-speed cam 14, and an adjust screw 67 is mounted by an adjust nut 68, and a bottom end of the adjust screw 67 contacts against the top end of the exhaust valve 80.

On the other hand, the high-speed rocker arm 65 has its base mounted to the rocker shaft part 22 to be rotatably supported, and a roller bearing 69 is mounted to the rocking end, and the roller bearing 69 can engage with the high-speed cam 15. The high-speed rocker arm 65 is formed with an arm part 70 at the opposite side to the rocking end to which the roller bearing 69 is mounted, and the arm part 70 is urged by an arm spring 71 as first arm spring means to urge the high-speed rocker arm 65 in one direction. Further, the high-speed rocker arm 65 can rotate integrally with the rocker shaft part 22 by the function of a change-over mechanism 72. Specifically, the rocker shaft part 22 is formed with a through-hole 73 at a position corresponding to the high-speed rocker arm 65, a rock pin 74 is movably mounted, and urged by the compression spring 75. On the other hand, the high-speed rocker arm 65 is formed with an engaging hole 76, and rock pin 74 is disengaged from the engaging hole 76 due to the compression spring 75. The rocker shaft part 22 is formed with a hydraulic pressure passage 77 communicating with the through-hole 73 along its axial direction, and with an oil passage 78 communicating with an end opposite to the engaging hole 76 of the through-hole 73.

Normally, in the high-speed rocker arm 65, the rock pin 74 is disengaged from the engaging hole 76 due to the compression spring 75, and engagement with the rocker shaft part 22 is released not to integrally rotate with the rocker shaft 22. Therefore, the low-speed cam 14 and the high-speed cam 15 rock the low-speed arm part 64 and the high-speed rocker arm 65, but driving force of the low-speed cam 14 is transmitted to the exhaust valve to rock the exhaust valve 80. When hydraulic pressure is supplied to the hydraulic pressure passage 77 of he rocker shaft part 22, in the high-speed rocker arm 65, hydraulic oil flows in the opposite side to the engaging hole 76 of the through-hole 73 through the oil passage 78 causing the rock pin 59 to engage with the engaging hole 76. As a result, the high-speed rocker arm 65 and the rocker shaft part 22 engage to rotate integrally. Therefore, the high-speed cam 15 rocks the high-speed rocker arm 65, and the driving force is transmitted to the exhaust valve 80 through the rocker shaft part 22 and the low-speed arm part 62, thereby rocking the exhaust valve 80.

Only the exhaust side was described in the above description of the valve-moving apparatus 31 and 32, however, the intake side has the same structure, and merely formation positions in the peripheral direction of the cam 14 and 15 of the individual cam shafts 12 and 13 differ according to the open/close timing of the intake and exhaust valves.

As shown in FIG. 5, the intake valve 79 and the exhaust valve 80 are movably mounted on the cylinder head 11, and an intake port 83 and an exhaust port 84 are closed by valve springs 81 and 82. Therefore, the above-described arm part 33 (low-speed arm part 64) is driven to press top ends of the intake valve 79 and the exhaust valve 80, thereby opening/closing the intake port 83 and the exhaust port 84 to communicate with a combustion chamber 85.

Figure 2:
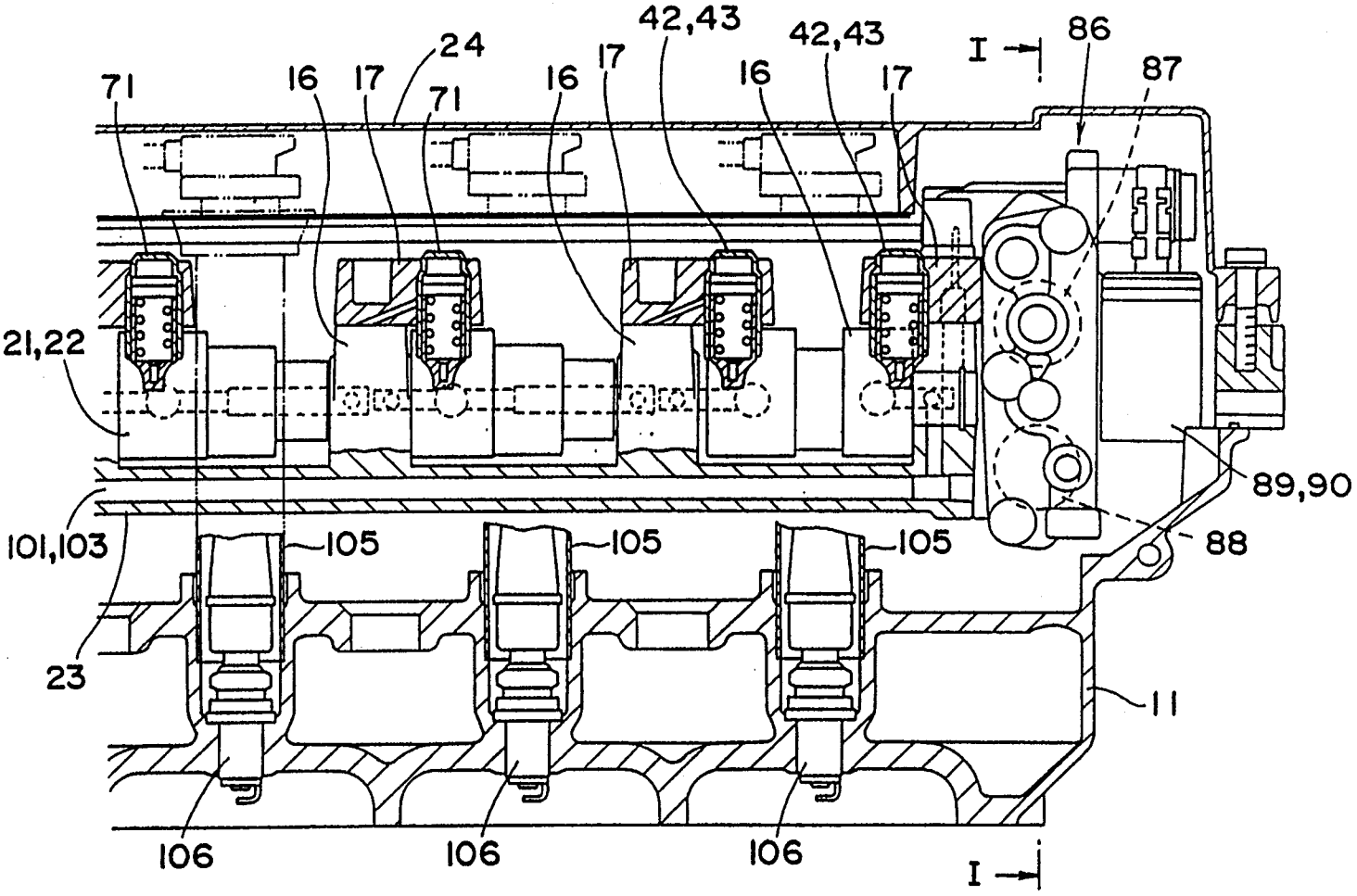
FIG. 2 is a schematic cross sectional view at the center (II—II in FIG. 11) of the cylinder head.
Figure 3:
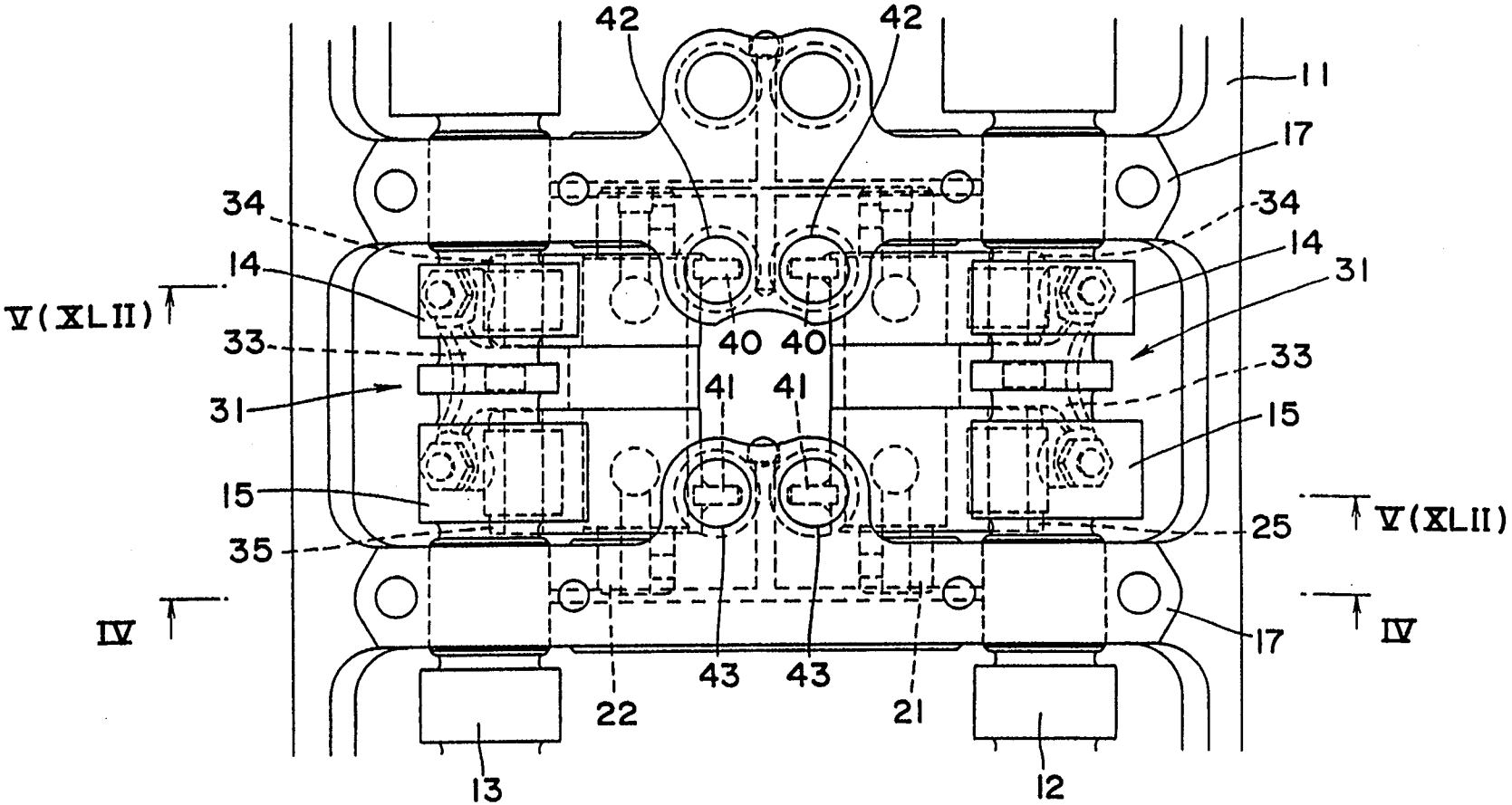
FIG. 3 is a schematic plan view of the valve-moving apparatus with a cylinder-closing mechanism.

As shown in FIGS. 1, 2, and 11, rear portion (upper portion in FIG. 11) of the cylinder head is provided with a hydraulic pressure control device 86 as a hydraulic pressure supply means for operating the change-over mechanisms 47, 48, and 72 of the valve-moving apparatus 31 and 32. The hydraulic pressure control device 86 comprises an oil pump 87 as a second oil pump, an accumulator 88, a high-speed change-over oil control valve 89, a cylinder-closing change-over oil control valve 90, and the like.

The oil pump 87 and the accumulator 88 are located between the intake cam shaft 12 and the exhaust cam shaft 13, both are juxtaposed vertically, and both axial centers are in the horizontal directions. Specifically, on the side of the cam cap housing 16 and the cam cap 17 at the rearmost portion of the cylinder head 11, a piston 91 of the oil pump 87 is disposed at the upper side to be movable in the horizontal direction, and fixed by bolts 94 through a cover 93. The piston 91 of the oil pump 87 is urged by a plunger 96 through a compression spring 95, and the plunger 96 can be driven by an oil pump cam 97 integrally formed at one end of the intake cam shaft 12.

On the side of the cam cap housing 16 and the cam cap 17, a piston 98 of the accumulator 88 is supported to be movable in horizontal direction and urged by a compression spring 99, and also mounted by bolts 94 through the cover 93. The piston 91 of the oil pump 87 and the piston 98 of the accumulator 88 are the same diameter, and can thus be used interchangeably. The high-speed change-over oil control valve 89 and the cylinder-closing change-over oil control valve 90 as an assistant oil control valve are mounted on the cylinder head 11.

Figure 8:
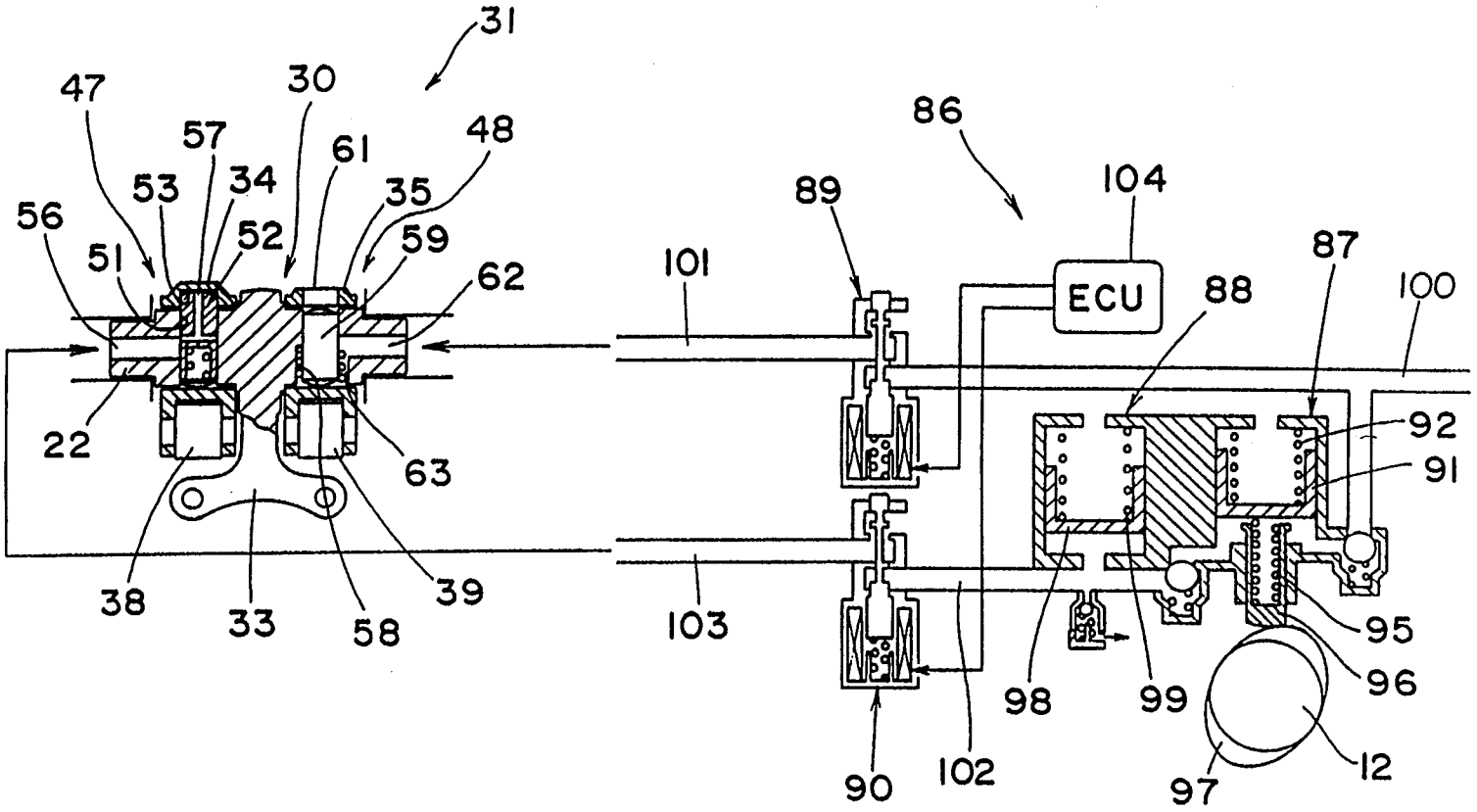
FIG.8 is a diagram showing a hydraulic pressure system of the valve-moving apparatus.

As shown in FIGS. 1, 2 and 8, the high-speed change-over oil control valve 89 is connected directly to the main oil pump of the engine (not shown) and to the hydraulic pressure passage 62 through an oil passage 101. The cylinder-closing change-over oil control valve 90 is connected to the accumulator 88, the oil pump 87, and the main oil pump, as well as to the hydraulic pressure passage 56 through an oil passage 103. Furthermore, the individual oil control valves 89 and 90 can be operated by control signals of an engine control unit 104.

The change-over mechanism 72 of the valve-moving apparatus 32 can also be operated by the hydraulic pressure control device 86, as for the valve-moving apparatus 31, and the hydraulic pressure passage 77 of the rocker shaft part 22 is connected with the oil control valve 89 through an oil passage (not shown). As shown in FIG. 2, the cylinder head 11 is provided with a hollow plug tube for each cylinder, an ignition plug 106 is disposed inside each plug tube 105, and its chip faces within each combustion chamber 85.

Operation of the 4-cylinder engine of the first embodiment will be described. The engine control unit 104 detects operation condition of the engine from detection results of various sensors, and if the engine is in a low-speed traveling condition, selects a cam profile according to the condition. In such case, she engine control unit 104 outputs control signals to the individual oil control valves 89 and 90 to close the valves. Then, hydraulic oil is not supplied to the individual hydraulic pressure passages 56, 62, and 77, in the valve-moving apparatus 31, as shown in FIG. 9(*a*), such that the low-speed rocker arm 35 and the rocker shaft part 22 become integral, and engagement is released between the high-speed rocker arm 35 and the rocker shaft part 22. Therefore, when the cam shafts 12 and 13 rotate, the low-speed rocker arm 34 is rocked by the low-speed cam 14, the driving force is transmitted to the arm part 33 through the rocker shaft part 22 to rock the T-formed lever 30, and the pair of adjust screws 36 at the rocking end rock the intake valve 79 and the exhaust valve 80. On the other hand, in he valve-moving apparatus 32, as shown in FIG. 10, engagement is released between the high-speed rocker arm 65 and the rocker shaft part 22, when the cam shafts 12 and 13 rotate, the T-formed lever (L) 30L is rocked by the low-speed cam 14, and the pair of adjust screws 67 at the rocking end rock the intake valve 79 and the exhaust valve 80. Thus, the intake valve 79 and the exhaust valve 80 are driven in an open/close timing corresponding to low-speed operation, and the engine is operated at a low-speed.

When the engine control unit 104 detects a high-speed traveling condition of the engine, the engine control unit 104 outputs control signals to the individual oil control valves 89 and 90 to open the valves. Then, hydraulic oil is supplied to the individual oil passages 56, 62, and 77. During high-speed operation of the engine, in the valve-moving apparatus 31, as shown in FIG. 9(*b*), the rock pin 52 disengages from the engaging hole 55 by hydraulic oil supplied to release engagement between the low-speed rocker arm 34 and the rocker shaft part 22. Further, the rock pin 59 engages with the engaging hole 61 and the high-speed rocker arm 35 and the rocker shaft part 22 become integral. Therefore, the high-speed rocker arm 35 is rocked by the high-speed cam 15, and the T-formed lever 30 rocks to drive the intake valve 79 and the exhaust valve 80. On the other hand, in the valve-moving apparatus 32, the rock pin 59 is engaged with the engaging hole 76 by hydraulic oil supplied, and the high-speed rocker arm 65 and the rocker shaft part 22 become integral. Therefore, the T-formed lever (L) 30L is rocked by the high-speed cam 15 through the high-speed rocker arm 65 to drive the intake valve 79 and the exhaust valve 80. Thus, the intake valve 79 and the exhaust valve 80 are driven in an open/close timing corresponding to high-speed operation, and the engine is operated at a high speed.

When the engine control unit 104 detects an idle operation condition or a low-load operation condition of the engine, two of the four cylinders are stopped, thereby improving gas mileage. The engine control unit 104 outputs control signals to the individual oil control valves 89 and 90 to open only the valve 90. Then, hydraulic oil is supplied to the oil passage 56, and in the valve-moving apparatus 31, as shown in FIG. 9(*c*), engagement is released between the low-speed rocker arm 34 and the rocker shaft part 22. Therefore, driving force of the low-speed cam 14 and the high-speed cam 15 is not transmitted to the T-formed lever 30, and the valve-moving apparatus 31 does not operate, achieving a cylinder-closing condition. On the other hand, in the valve-moving apparatus 32, the low-speed arm 64 is rocked by the low-speed cam 14 to drive the intake valve 79 and the exhaust valve 80. Thus, the engine is operated by driving only the intake valve 79 and the exhaust valve 80 of the valve-moving apparatus 32.

As described above, in the valve-moving apparatus for an engine of the first embodiment, since the oil pump 87 and the accumulator 88 for operating the change-over mechanism 50 of the valve-moving apparatus 31, the individual oil control valves 89 and 90, and the hydraulic pressure control device 86 are disposed between the intake cam shaft 12 and the exhaust cam shaft 13, and the oil pump 87 and the accumulator 88 are disposed on the upper and lower sides, the oil pump 87 and the accumulator 88 can be efficiently disposed to make the layout of the cylinder head 11 compact, thereby preventing part of the engine from protruding upward and the engine height from increasing.

Furthermore, since the same diameters are used for the individual pistons 91 and 98 of the oil pump 87 and the accumulator 88, the pistons 91 and 98 can be used interchangeably as well as the peripheral components, thereby achieving a cost reduction.

With the valve-moving apparatus for an engine according to the present embodiment, since, in the change-over mechanism 47 of the valve-moving apparatus 31, the main oil pump of the engine is connected to the low-speed side hydraulic pressure passage 56 to operate the low-speed side mock pin 52 through the valve-closing change-over oil control valve 90, the accumulator 88, and the oil pump 87, and the main oil pump of the engine is connected to the high-speed side hydraulic pressure passage 62 to operate the high-speed side rock pin 59 directly through the high-speed change-over oil control valve 89, a sufficient amount of hydraulic oil is supplied from the individual oil pumps to the low-speed side hydraulic pressure passage 56 and the high-speed side hydraulic pressure passage 62 during high-speed operation of the engine.

Figure 12:
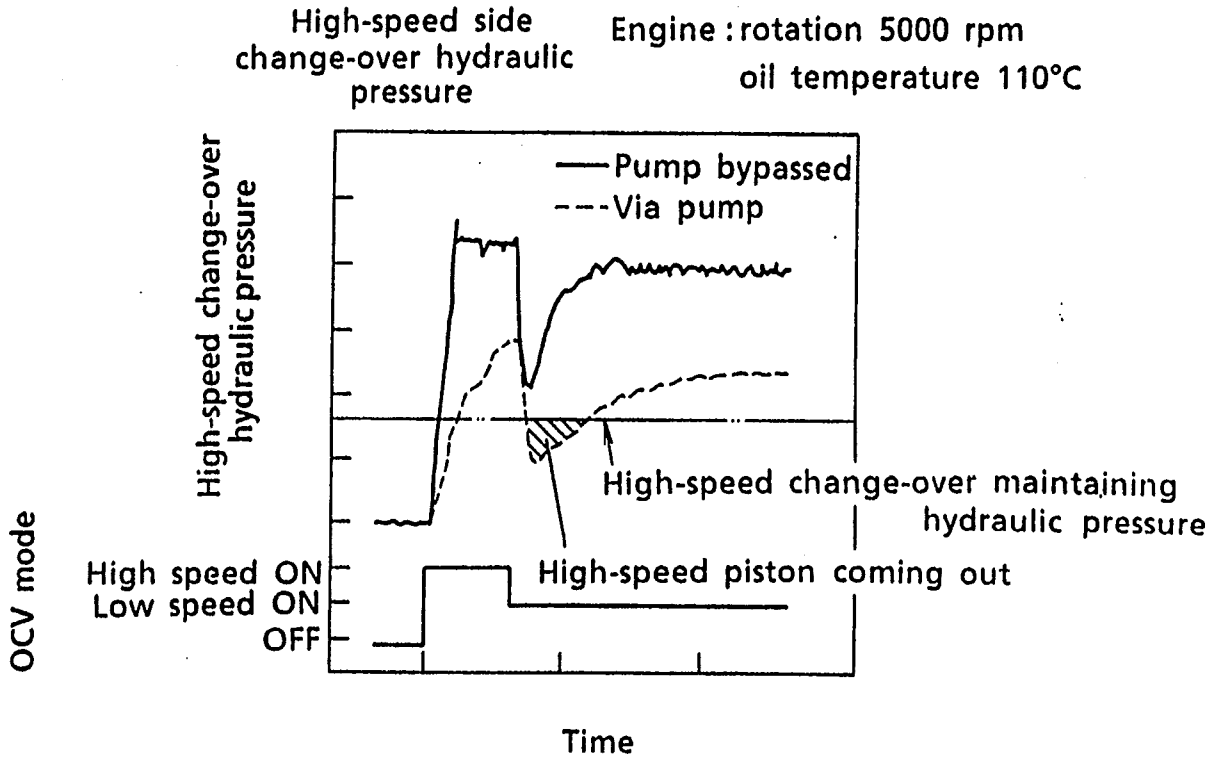
FIG. 12 is a graph showing changes over time in high-speed side change-over hydraulic pressure in the valve-moving apparatus.

As can be seen from the graph showing changes over time in high-speed side change-over hydraulic pressure shown in FIG. 12, high-speed side change-over hydraulic pressure when the main oil pump is directly connected to the high-speed side hydraulic pressure passage 62, bypassing the oil pump 87, indicated by the solid line in the Figure, is always maintained at a higher value than the high-speed change-over holding hydraulic pressure. On the other hand, the high-speed side change-over hydraulic pressure when the main oil pump is connected to the high-speed side hydraulic pressure passage through an assist pump, indicated by the dotted line as in the prior art, is lower than the high-speed change-over holding hydraulic pressure when changing over to a high speed. Therefore, when the main oil pump of the engine is directly connected to the high-speed side hydraulic pressure passage 62 to operate the high-speed side rock pin 59 as in the present embodiment, the low-speed rock pin 52 and the high-speed rock pin 59 can be operated positively and rapidly, and a cam feel, suitable for high-speed operation, selected to operate the intake valve 79 and the exhaust valve 80.

Therefore, the internal combustion engine can provide an output necessary for high-speed operation while preventing malfunctions of the intake and exhaust valves.

Figure 13:
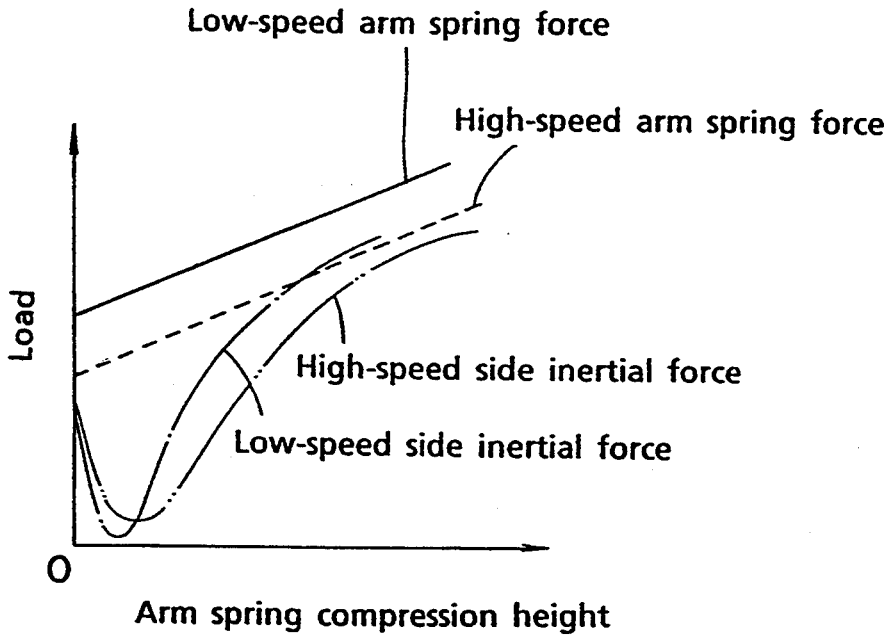
FIG. 13 is a graph showing an arm spring compression height versus load.

Furthermore, in the valve-moving apparatus for an engine of the present embodiment, the urging force of the compression spring 46 of the low-speed arm spring 42 is set to a greater value than that of the compression spring 46 of the high-speed arm spring 43. Therefore, an inertial force applied to the low-speed rocker arm 34, as indicated by the dot-bar line in FIG. 13, is along with the spring force of the compression spring 46 of the low-speed arm spring 42, indicated by the solid line; and an inertial force applied to the high-speed rocker arm 35 indicated by the two-dot-bar line is along with the spring force of the compression spring 46 of the high-speed arm spring 43, and only necessary urging forces are applied to the individual rocker arms 34 and 35, thereby reducing friction and improving the operability.

Figure 14:
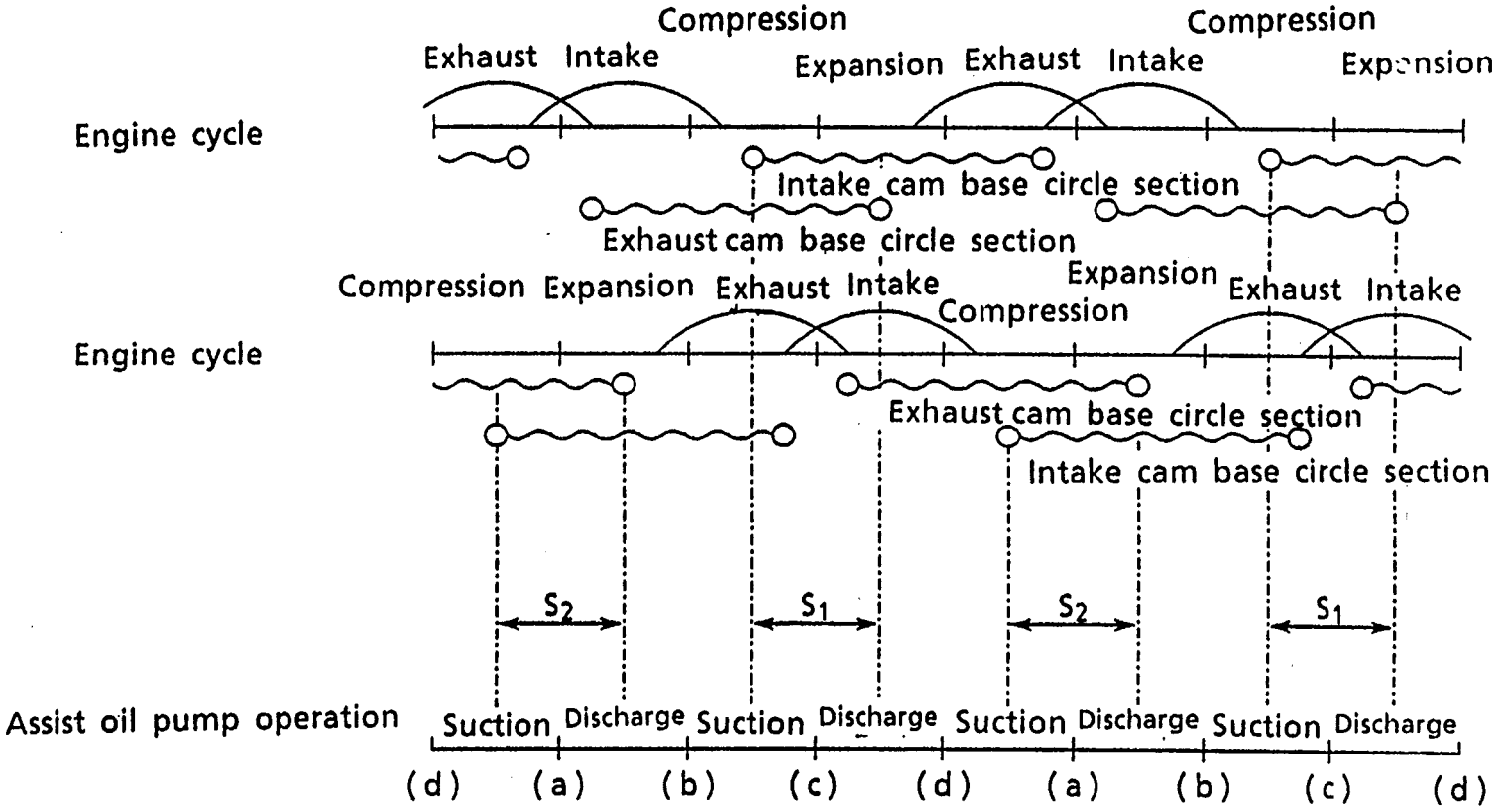
FIG. 14 is a schematic view showing the relationship between an engine cycle time and operation of an assist oil pump.

Further, in the valve-moving apparatus for an engine of the present embodiment, the engine is of a 4-cylinder type but, as shown in FIG. 14, a cycle time of intake-compression-expansion-exhaust is different by cylinders. Specifically, as shown in FIG. 14, cycles of two valve-moving apparatuses having the cylinder-closing mechanism are different, and non-operation times (engaging times of the individual rocker shafts 34 and 35 by base circular sections of the individual cams 14 and 15) of the intake valve 79 and the exhaust valve 80 differ between he intake side and the exhaust side. Therefore, the non-operation times of the two valves 79 and 80 are a range $S_1$ for one valve-moving apparatus, whereas a range $S_2$ for the other valve-moving apparatus.

Figures 15A, 15B, 15C, 15D, 15E:
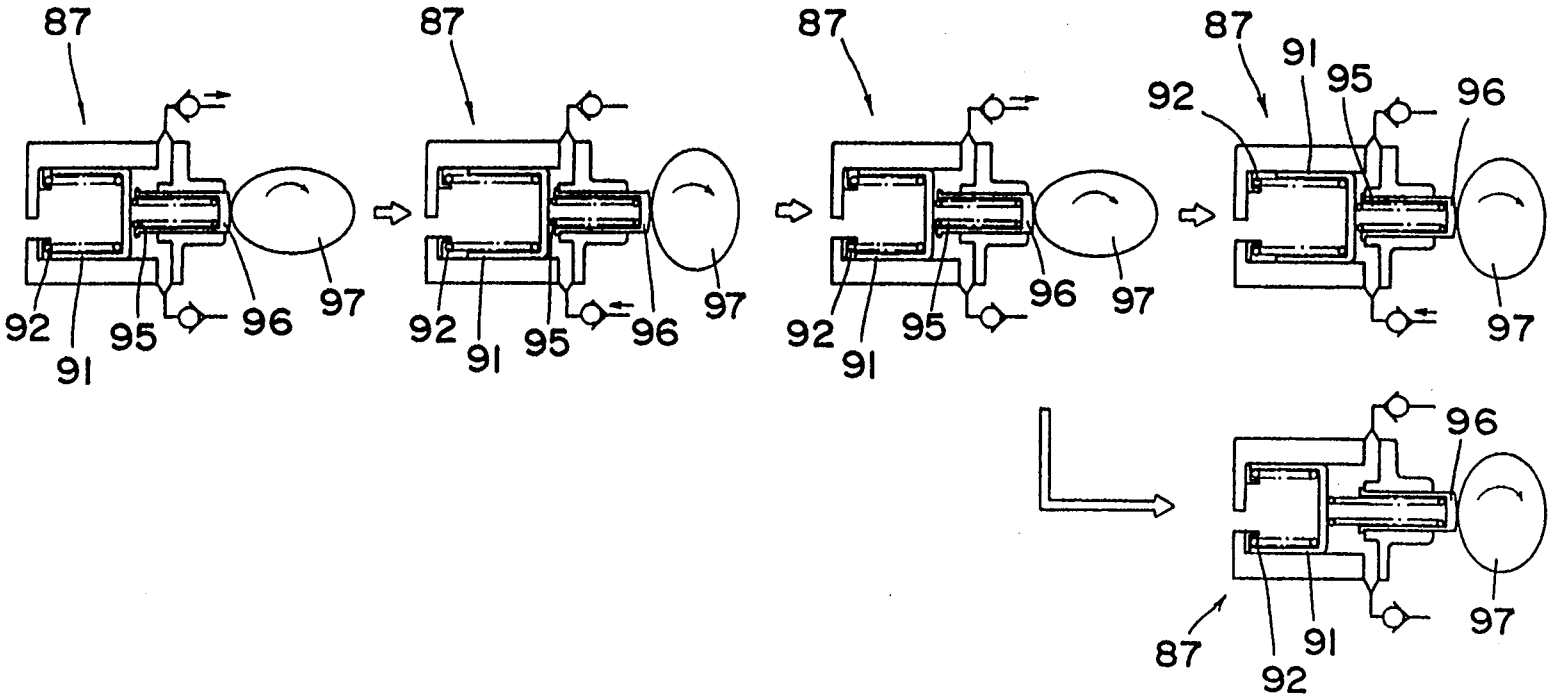
FIGS. 15 (*a*)–(*e*) are schematic views for explaining operation of an assist oil pump.

In this case, the oil pump 87 is operated by the oil pump cam 97 and has two cam parts on the outer peripheral part thereof, and as shown in FIG. 14 and FIG. 15, the oil pump makes operation of intake-discharge-intake-discharge, that is, a two-cycle operation of (d)-(a)-(c)-(d). When the storage pressure of the accumulator 88 becomes sufficient by the operation of the oil pump 87, only a plunger 96 operates and the piston 91 does not operate in the oil pump 87 as shown in FIG. 15(*e*).

Therefore, the range S1 of the one valve-moving apparatus is a discharge section of the oil pump 87, that is, the operation condition of (c)-(d) in FIG. 14, and a required hydraulic pressure can be sufficiently obtained. Also, the range $S_2$ of the other valve-moving apparatus is a discharge section of the oil pump 87, that is, the operation condition of (a)-(b) in FIG. 14, and a required hydraulic pressure can be sufficiently obtained. As a result, a hydraulic pressure necessary for changing over the rock pin 52 can be rapidly obtained when the oil control valve 90 is changed over, a rising delay time of hydraulic pressure of the oil pump 87 is decreased and quick supply of hydraulic pressure in achieved, and a smooth change-over for cylinder closing can be made, thereby sufficiently achieving the inherent purpose of cylinder closing to reduce fuel consumption during idle operation and low-load operation.

With the valve-moving apparatus according to the present invention, since one or more cylinder-closing mechanisms for stopping valve driving during low-speed operation are provided in the multi-cylinder internal combustion engine, with the change-over mechanism operated by hydraulic pressure control disposed between the rocker shaft and the rocker arm, the cylinder-closing mechanism is connected with the oil pump through the cylinder-closing change-over oil control valve, and an oil pump cam provided with cam parts greater in number than the number of cylinders to be closed is formed at ends of the cam shafts, when the oil control valve is operated during cylinder closing, a hydraulic pressure necessary at that time can be sufficiently supplied to rapidly operate the rock pins, and smooth change-over for cylinder closing can be made with no rising delay time of hydraulic pressure of the assist oil pump, thereby, achieving improved operability of the change-over mechanism during cylinder closing. As a result, the inherent purpose of cylinder closing to reduce fuel consumption during idle operation or low-load operation of the engine is achieved. Furthermore, the capacity of the accumulator can be reduced, or the accumulator can be eliminated, thereby achieving a cost reduction and space-saving effect.

Figure 16:
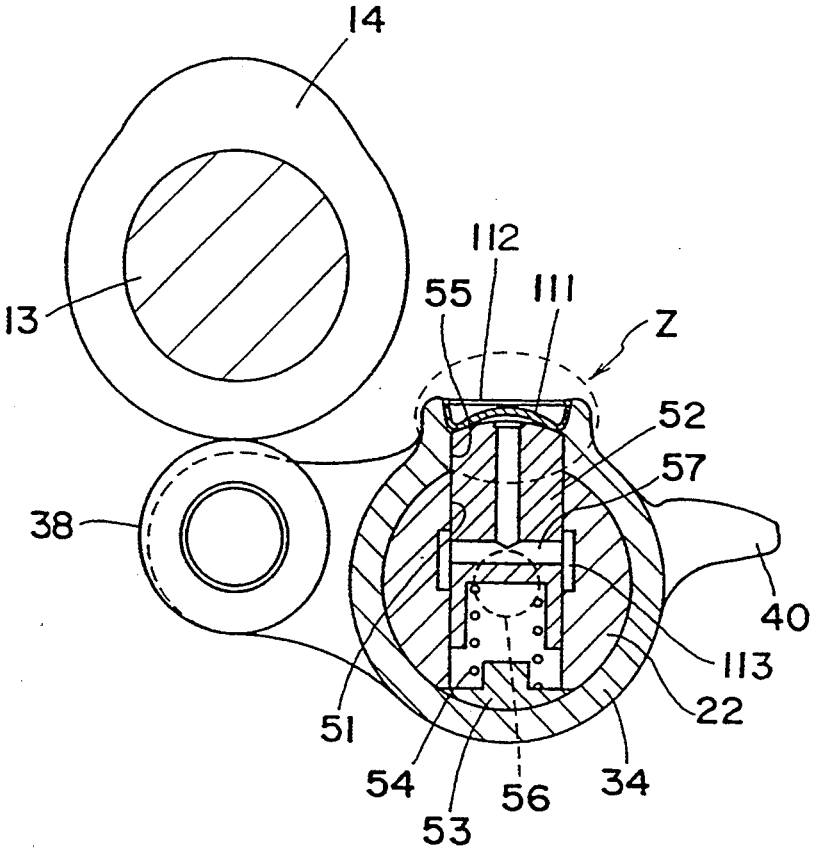
FIG. 16 is a detailed view of arrow X portion in FIG. 5.
Figure 17:
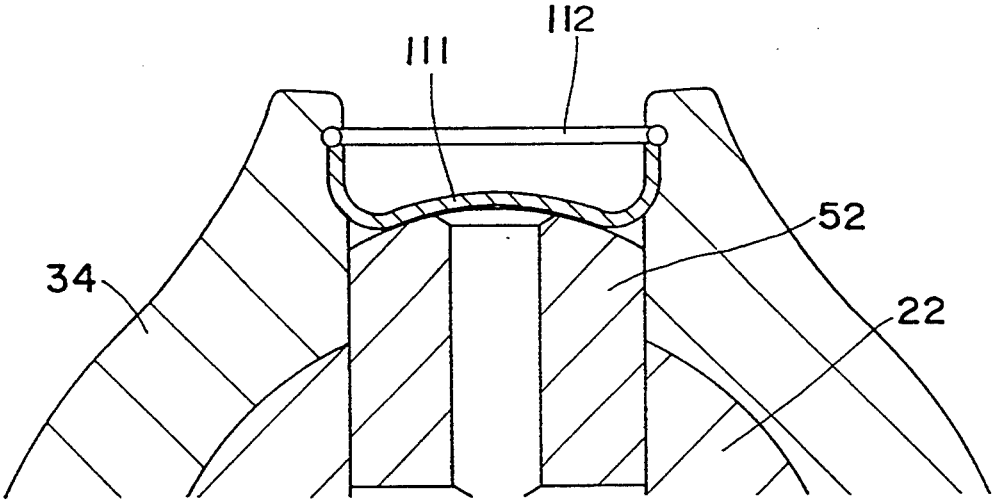
FIG. 17 is a detailed view of arrow Z portion in FIG. 16.
Figure 18:
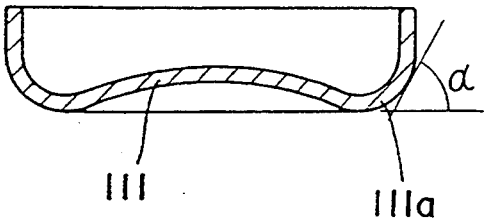
FIG. 18 is a schematic cross sectional view of a cover.
Figure 19:
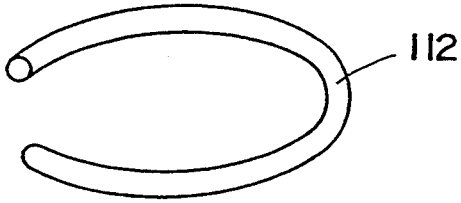
FIG. 19 is a schematic perspective view showing a snap ring.

Next, the structure of the low-speed rocker arm 34 will be described further in detail with reference to FIG. 16 to FIG.22. As shown in FIG. 16 and FIG. 17, a cover 111 is engaged with the engaging hole 55, and the cover 111 is fixed to the low-speed rocker arm 3 with a snap ring 112. The cover 111 is formed of a metal plate and, as shown in FIG. 18, the bottom edge 111*a* is inclined at an angle of a. The top edge is mounted to the low-speed rocker arm 34 with the snap ring 112 shown in FIG. 19.

When the low-speed rocker arm 34 is rotated by the low-speed cam 14, the engaging hole 55 is applied with repeated tensional load by the rock pin 52, repeating elastic deformation. Since the cover 111 is made of a metal plate, it deforms according to deformation of the engaging hole 55; the cover 111 will not separate; or no cracking or gap will be generated in the low-speed rocker arm 34.

Figure 20:
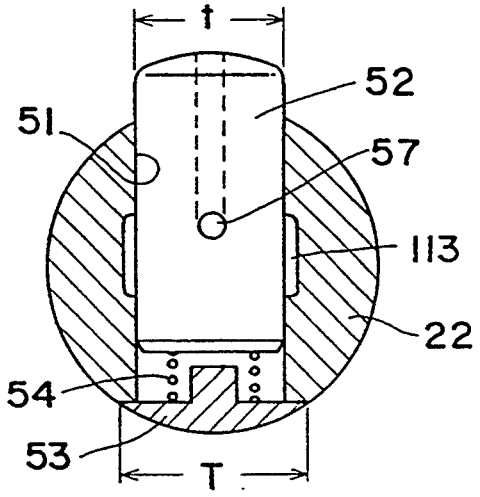
FIG. 20 is a schematic cross sectional view of a rocker shaft section.
Figure 21:
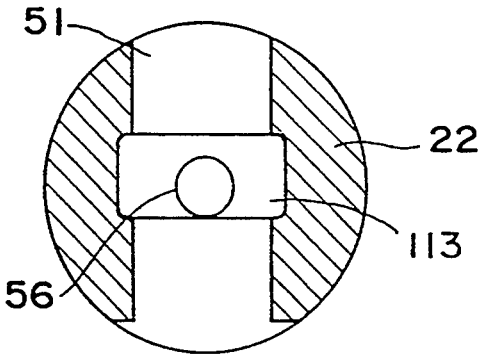
FIG. 21 is a schematic cross sectional view of a rocker shaft section showing a through-hole.

As shown in FIGS. 16, 20, and 21, an oil passage 113 for guiding hydraulic oil from the hydraulic pressure passage 56 to the oil passage 57 is formed on the inner periphery of the through-hole 51. Therefore, the rock pin 52 can be formed as a circular cylinder, thereby preventing breakage of the rock pin 52 and improving the reliability.

Figure 22:
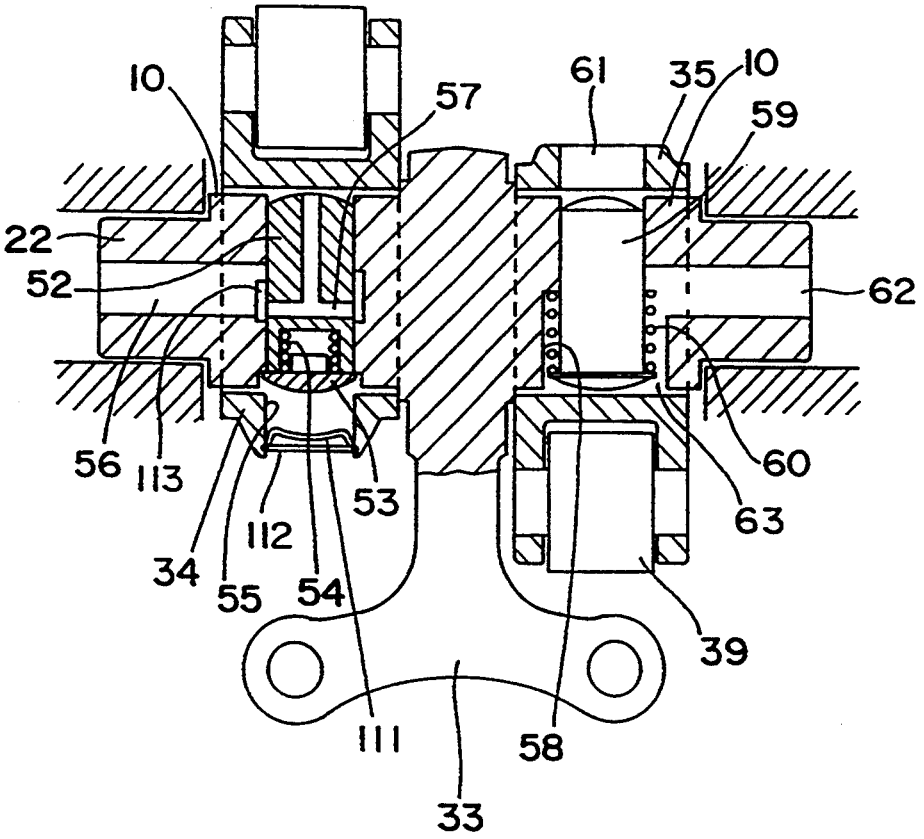
FIG. 22 is a schematic cross sectional view of a change-over mechanism with a low-speed rocker arm reversed.

As shown in FIG. 20, a diameter T of the spring sheet 53 of the rock pin 52 is set greater than a diameter t of the head inserted into the engaging hole 55. This prevents the spring sheet 53 from engaging with the engaging hole 55 by the urging force of the compression spring 54 when, as shown in FIG. 22, the spring sheet 53 is caused to oppose to the engaging hole 55 by reversing the low-speed rocker arm 34 during assembly.

Since the engaging hole 55 is provided with the metal plate-made cover 111, the cover 111 deforms following deformation of the engaging hole 55, the cover 111 will not separate, or no cracking or gap will be generated in the low-speed rocker arm 34. This prevents oil leakage and the low-speed rocker arm 34 from being broken.

Furthermore, since the oil passage communicating with the hydraulic pressure passage is formed on the inner periphery of the through-hole, he rock pin can be formed as a circular cylinder with no groove. This increases the rigidity of the rock pin, thereby preventing the rock pin from breaking and improving reliability.

Further, since the diameter of the biasing means receiver of the rock pin is set greater than the diameter of the head, the biasing means receiver will not engage with the engaging hole even when the biasing means receiver opposes the engaging hole due to rotation of the sub-rocker arm. This prevents the sub-rocker arm from locking as a reversed position.

Next, a lubrication oil passage for supplying lubricating oil to the cam journal part of the intake cam shaft 12 and the exhaust cam shaft 13, and the sliding part between the low-speed arm spring 2 and the high-speed arm spring 43 will now be described in detail.

Figure 4:
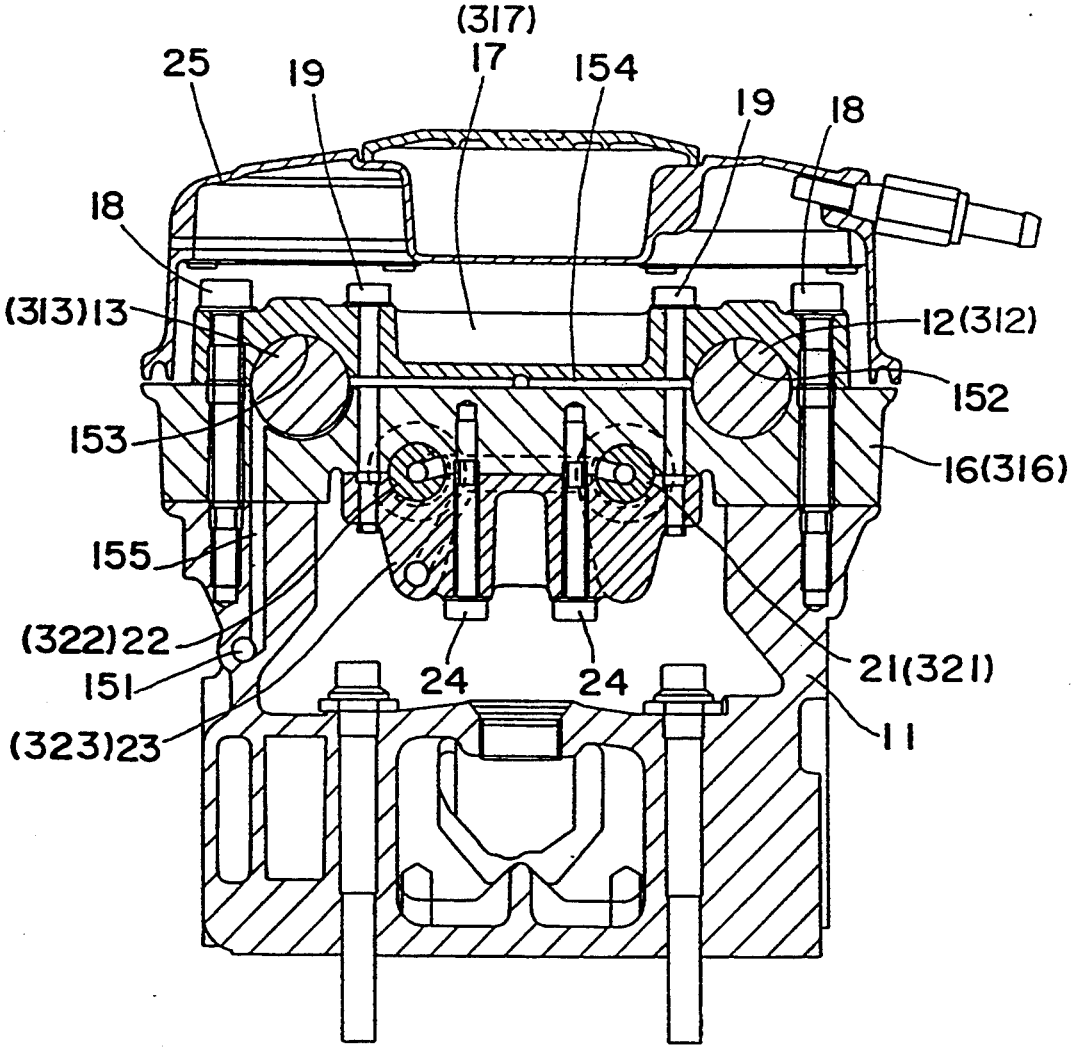
FIG. 4 is a schematic IV—IV cross sectional view of FIG. 3.
Figure 25:
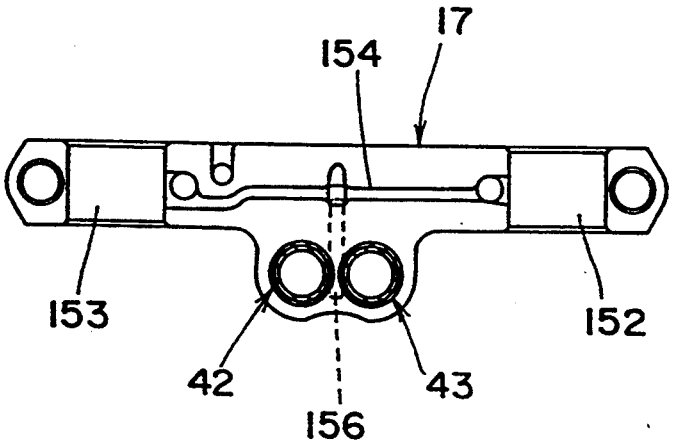
FIG. 25 is a schematic cross sectional view (XXV—XXV) in FIG. 23.
Figure 26:
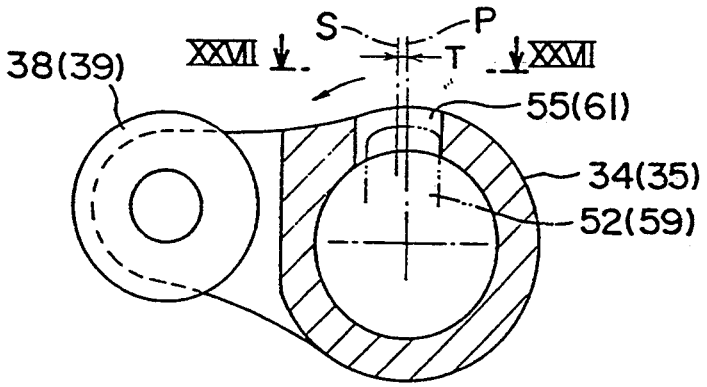
FIG. 26 is a schematic cross sectional side view of a rocker arm which is a modification of the first embodiment of the present invention.
Figure 27:
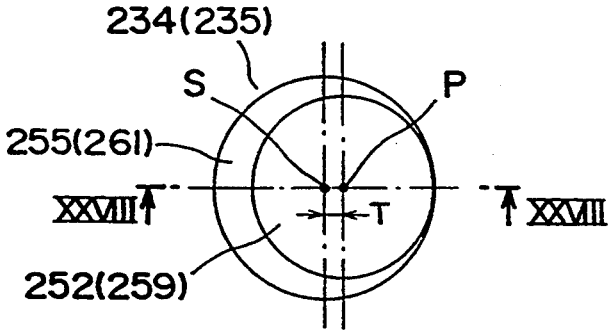
FIG. 27 is a schematic cross sectional view taken along line XXVII—XXVII in FIG. 26.

As shown in FIG. 4 and FIG. 5, an oil passage 151 is formed along the longitudinal direction (direction perpendicular to the paper surface in the Figures) at the exhaust side (left side in the Figures) of the cylinder head 11, and the oil passage 151 is connected with the main oil pump of the engine. The intake cam shaft 12 and the exhaust cam shaft 13 are held by the cam shaft housing 16 and the cam cap 17. The cam cap 17, as shown in detail in FIG. 25, is of an intake-exhaust integral type, exhaust side and intake side bearing parts 152 and 153 for individually supporting the intake cam shaft 12 and the exhaust cam shaft 13, and an oil groove 154 for connecting the bearing parts 152 and 153 is formed on the bottom surface. The exhaust side bearing part 153 and the above-described oil passage 151 are connected by a connecting passage 155 formed along the vertical direction penetrating the cylinder head 11 and the cam shaft housing 16.

Therefore, engine oil as lubricating oil supplied from the main oil pump of the engine to the oil passage 151 is supplied to the exhaust side bearing part 153 through the individual connecting passages 155, and to the intake side bearing part 152 by the oil groove 154.

Figure 23:
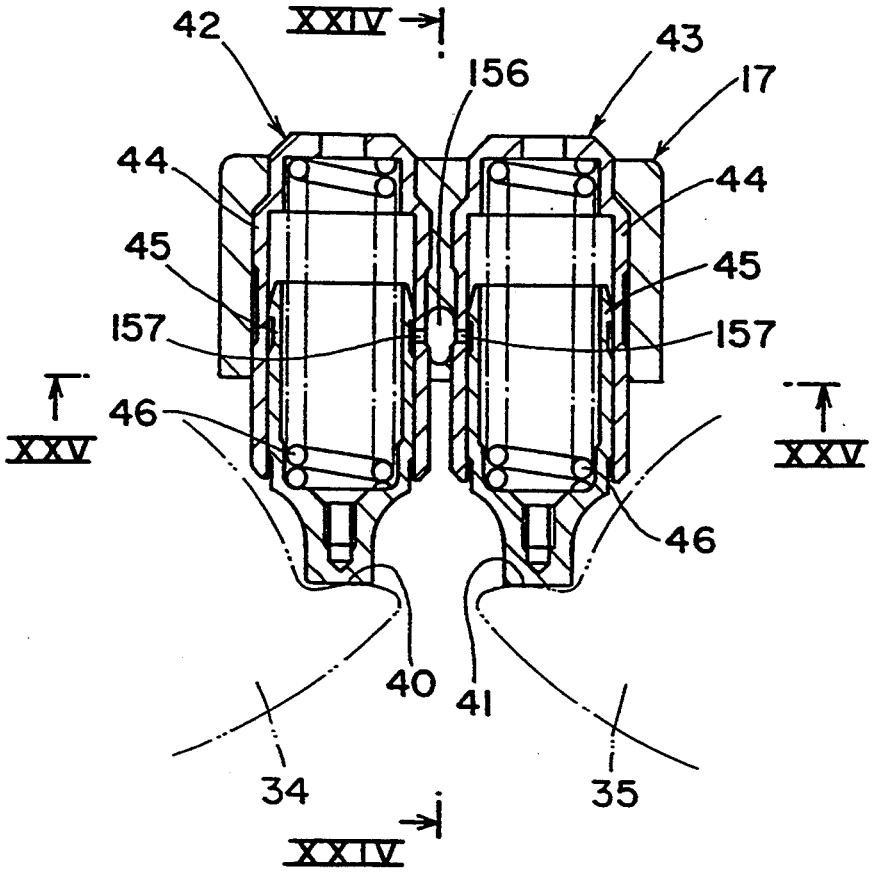
FIG. 23 is a schematic cross sectional view showing an arm spring of the present invention.
Figure 24:
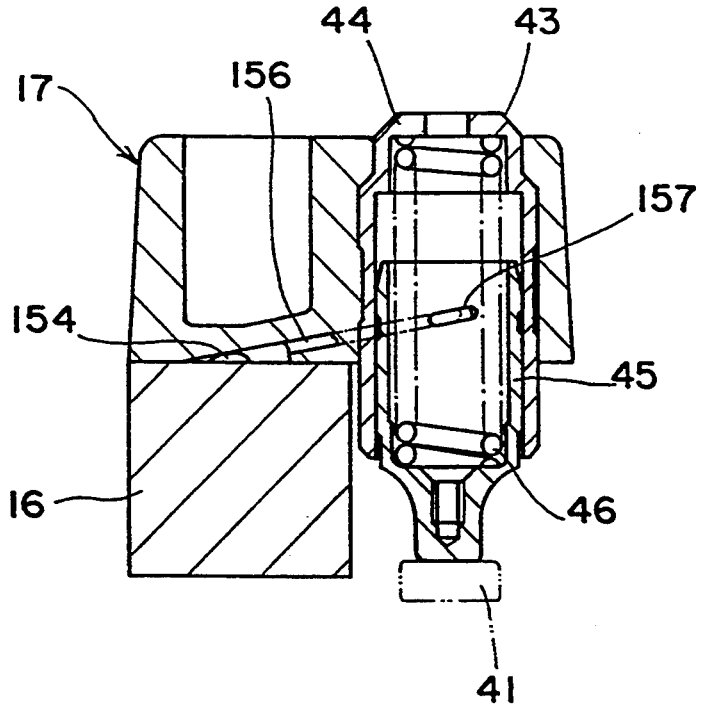
FIG. 24 is a schematic cross sectional view (XXIV—XXIV) in FIG. 23.

Furthermore, as shown in FIGS. 23 to 25, the cam cap 17 is formed with an oil supply passage 156 having a base communicating with an intermediate part of the oil groove 154 and a top end extending between the low-speed arm spring 42 and the high-speed arm spring 43. Each oil supply port 157 is formed on the outer periphery where the cylinder opposes the low-speed arm spring 42 and the high-speed arm spring 43, which communicate with the front end of the oil supply passage 156.

Therefore, engine oil flowing into the connecting passage 155 is supplied to the low-speed arm spring 42 and the high-speed arm spring 43 through the oil supply passage 156, and from the individual oil supply ports 157 to the sliding parts of the cylinder a and the plunger 45.

As described above, in the valve-moving apparatus for an engine of the first embodiment, the oil passage 151 is formed on the cylinder head 11; the oil groove 154 communicating with the semicircular bearing parts 152 and 153 of the intake cam shaft 12 and the exhaust cam shaft 13 is formed; and both being connected by the connecting passage 155; and the oil supply passage 156 connecting oil supply ports 157 of the oil groove 154 and the low-speed and high-speed arm springs 42 and 43 is formed. Therefore, engine oil supplied form the main oil pump of the engine to the oil passage 151 flows into the oil groove 154 through the individual connecting passage 156, and further through the oil supply passage 156, from the individual oil supply port 157 of the tow-speed arm spring 42 and the high-speed arm spring 43 to the sliding parts of the cylinder 44 and the plunger 45. Thus, a single oil supply passage is sufficient to supply the individual bearing parts 152 and 153 of the intake cam shaft 12 and the exhaust cam shaft 13 with engine oil, which simplifies the processing with reduced manpower and prevents the wearing and malfunction of the individual arm springs 42 and 43.

Next, the relationship between the through-holes 51 and 58 and the engaging holes 55 and 61, which are a modification of the first embodiment, will now be described with reference to FIGS. 7 and 26 to 28.

When base circles of the cams 14 and 15 oppose the roller bearings 38 and 39, the through-holes 51 and 58 oppose the engaging holes 55 and 61. A center S of the engaging holes 55 and 61 and a center P of the rock pins 52 and 59 separate by a deviation amount T, and the center S of the engaging holes 55 and 61 deviates to the front side in the rotational direction when the rocker arm parts 34 and 35 are rotated by the cam surfaces of the cams 14 and 15. The deviation amount T is a half of the gap between the engaging holes 55 and 61 and the rock pins 52 and 59. That is, $T=(\phi D-\phi d)/2$, where $\phi D$ is a diameter of the engaging holes 51 and 61, and $\phi d$ is a diameter of the rock pins 252 and 259.

Figure 28:
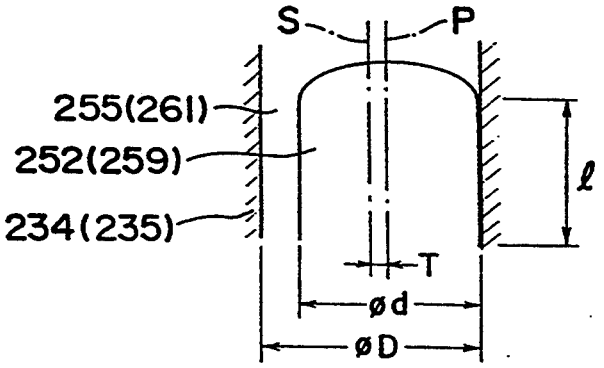
FIG. 28 is a schematic cross sectional view taken along line XXVIII—XXVIII in FIG. 27.

Therefore, when the rock pins 252 and 259 protrude into the engaging holes 255 and 261, as shown in FIG. 28, the rock pins 252 and 259 make a line contact with the inner periphery of the engaging holes 255 and 261 over a length l, receiving a load by a line.

In the above-described mechanism, since the projection and withdrawal action of the rock win is performed so that the through-hole of the rocker shaft side is in line with the engaging hole of the rocker arm side only when the roller bearing on the rocker arm opposes the base circle of the cam, the position of the rock pin cannot be easily changed, thereby achieving reliable transmission of driving force.

Furthermore, since the central position of the engaging hole is shifted to the front side in the rocker arm rotational direction when the rock pin opposes the engaging hole, the rock pin engages with the engaging hole by a line contact when the rock pin protrudes, thereby improving the connection rigidity and suppressing flexural deformation of the rocker arm.

Figure 30:
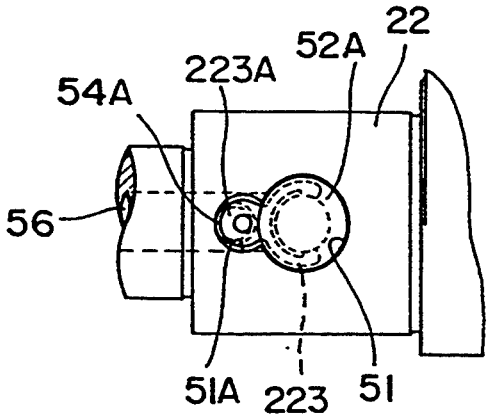
FIG. 30 is a schematic cross sectional view taken along line XXX—XXX in FIG. 29.
Figure 31:
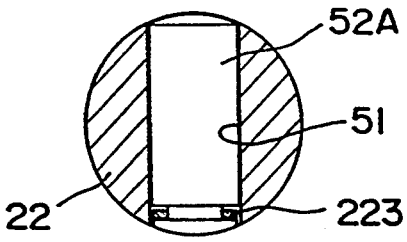
FIG. 31 is a schematic cross sectional view taken along line XXXI—XXXI in FIG. 29.

A modification example of rock pin supporting condition will be described in detail with reference to FIGS. 29, 30, and 31.

The rocker shaft part 22 at the hydraulic passage 56 and 62 side of the through-holes 51 and 58 is formed with spring holes 51A and 58A as an biasing means insertion part provided with compression springs 54A and 60A as biasing means, and the spring holes 51A and 58A are in juxtaposition with the through-holes 51 and 58.

Rock pins 52A and 59A their engaging hole 55 and 61 sides being heads, are formed with collars 52B and 59B at ends reverse to the heads in the longitudinal direction of the through-holes 51 and 58. The collars 52B and 59B have clips 223, and the clips 223 are provided with late parts 223A projecting into the spring holes 51A and 58A. The compression springs 54A and 60A are disposed on the top surfaces of the plate parts 223A.

Figure 29:
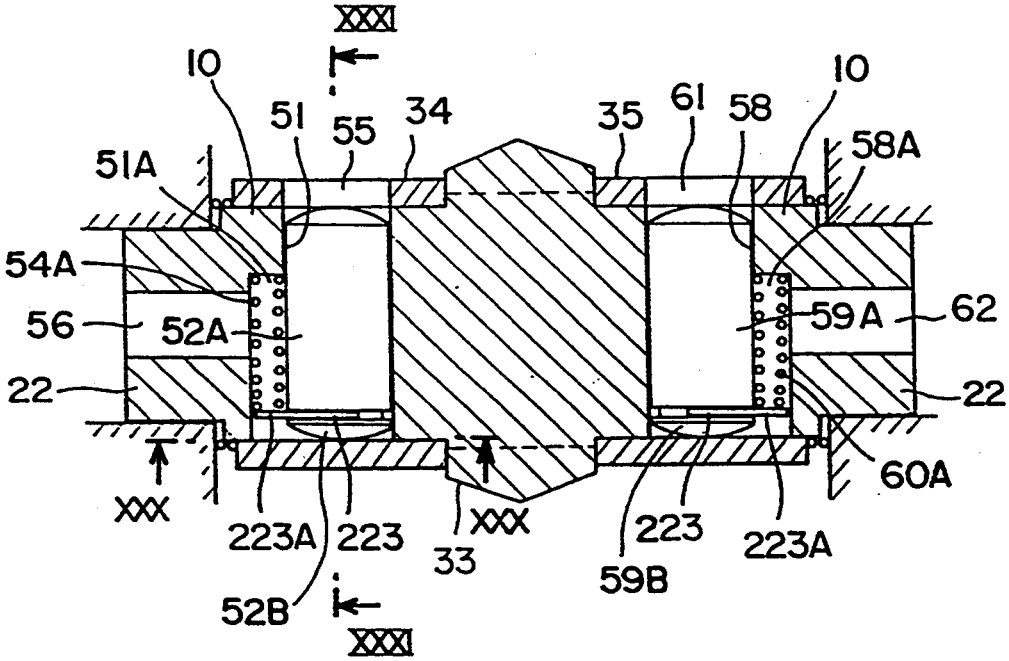
FIG. 29 is a schematic perspective view showing part of the valve-moving apparatus according to a modified embodiment of the present invention.

Therefore, in the normal condition, the rock pins 52A and 59A are urged downward in FIG. 29, and set at positions where the heads are inserted from the engaging holes 55 and 61 into the through-holes 51 and 58.

Since, in this modification example, the urging direction of the compression spring 54A urging the rock pin 52A is the reverse to the urging direction of the compression spring 54 urging the rock pin 52 in the first embodiment, hydraulic pressure supply to the hydraulic passage 56 described in the first embodiment is the reverse to this example.

Therefore, with the above-described valve-moving apparatus, since the spring holes 51A and 58A separately from the through-holes 51 and 58 are provided in the rocker shaft part 22, and the compression springs 54A and 60A are disposed in the spring holes 51A and 58A, the rock pins 52A and 59A can be formed in simple circular cylindrical shape, and the diameters of the projections of the rock pins 52A and 59A of the through-holes 51 and 58 can be set to the minimum diameters that allow the rock pins 52A and 59A to be moved. This improves the torsional rigidity of the rocker shaft part 22 and simplifies processing of the rock pins 52A and 59A.

In the above modification example, ordinary positions of the rock pins 52A and 59A are described in the condition where the rock pins 52A and 59A are inserted in the through-holes 51 and 58 of the rocker shaft part 22. However, it is also possible to set the ordinary condition to a condition where the rock pins are engaged with the engaging holes 55 and 51 of the rocker arms 34 and 35.

A second embodiment of the valve-moving apparatus according to the present invention will now be described.

Figure 32A:
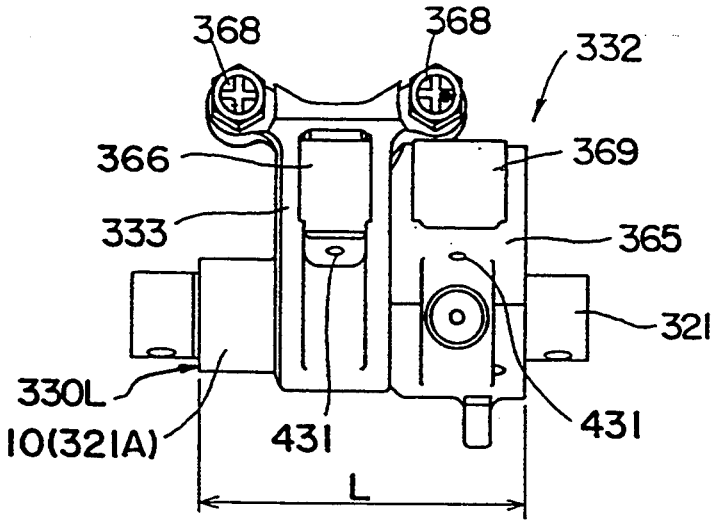
FIGS. 32 (A) and (B) are schematic plan views of a rocker arm assembly showing a second embodiment of the present invention.
Figure 32B:
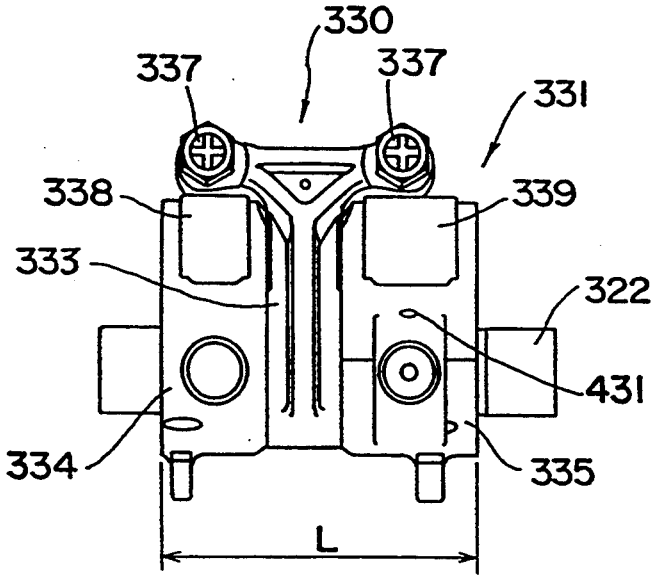

As shown in FIG. 32(A), in a valve-moving apparatus 332 with no cylinder-closing mechanism, a base of an arm part 333 having a collar part 321A is integrally mounted on a rocker shaft part 321, a T-formed (L) 330L is formed, a high-speed rocker arm 365 is detachably mounted in juxtaposition with the T-formed lever (L) 330L. The other end of the arm part 333 is a part which is contacted against a valve stem end, and an adjust nut 368 is provided for this purpose.

The T-formed lever (L) 330L is operated at low-speed operation and the like, and is provided with a roller bearing 366 to be contacted with a low-speed cam. The high-speed rocker arm 365 is provided with a roller bearing 369 to be contacted with a high-speed cam.

The length from the end surface of the collar part 321A of the valve-moving apparatus 332 to the end surface of the high-speed rocker arm 365 is set to L.

In a valve-moving apparatus 331 having a cylinder-closing mechanism, a base of the arm part 333 is integrally mounted on a rocker shaft part 322, and a T-formed lever 330 is formed, and a low-speed rocker arm 334 and a high-seed rocker arm 335 are mounted on both sides to be disconnectable to the rocker shaft part 322. The other end of the arm part 333 is a part which is contacted against a valve stem end, and is provided with an adjust nut 337. The low-speed rocker arm 334 and the high-speed rocker arm 335 have roller bearings 338 and 339 at front ends, and the roller bearings 338 and 339 are contacted with the low-speed cam and the high-speed cam, respectively.

The length from the end surface of the low-speed rocker arm 334 of the valve-moving apparatus 331 to the end surface of the high-speed rocker arm 335 is set to L as in the valve-moving apparatus 331.

On the other hand, FIGS. 4 and 33 to 36 shows a cam shaft housing and the like supporting the valve-moving apparatus 331 and 332. A cam shaft housing 316 is mounted on the cylinder head 11. On the bottom surface of the cam shaft housing 316, rocker shaft journal parts 316A are formed a predetermined intervals along the crank shaft direction, both ends of rocker shaft parts 321 and 322 of the valve-moving apparatus 331 and 332 are inserted into adjacent journal parts 316A, and a rocker shaft cap 323 is mounted on the cam shaft housing 316.

Cam shafts 312 and 313 are mounted on the upper surface of the cam shaft housing 316, and held by a cam cap Low-speed and high-speed cams 314 and 315 contact roller bearing 366 of low-speed rocker arm part 333 and roller bearing 369 of high-seed rocker arm part 365 of valve-moving apparatus 332, respectively, and contact roller bearing 338 of low-speed rocker arm part 334 and roller bearing 339 of high-seed rocker arm 335, of valve-moving apparatus 331, respectively.

Figure 33:
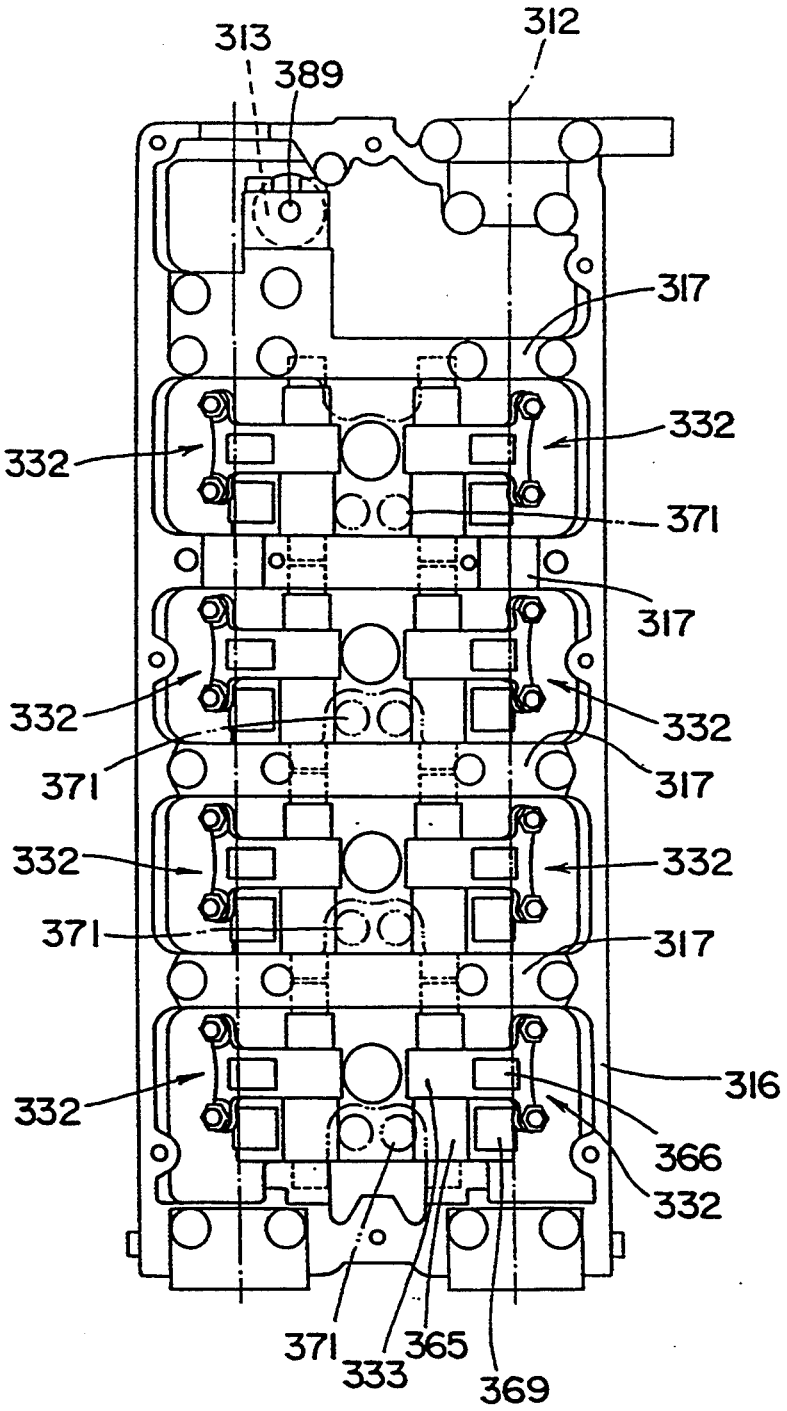
FIG. 33 is a schematic plan view showing a cylinder head of an engine having no valve operation stopping mechanism.
Figure 34:
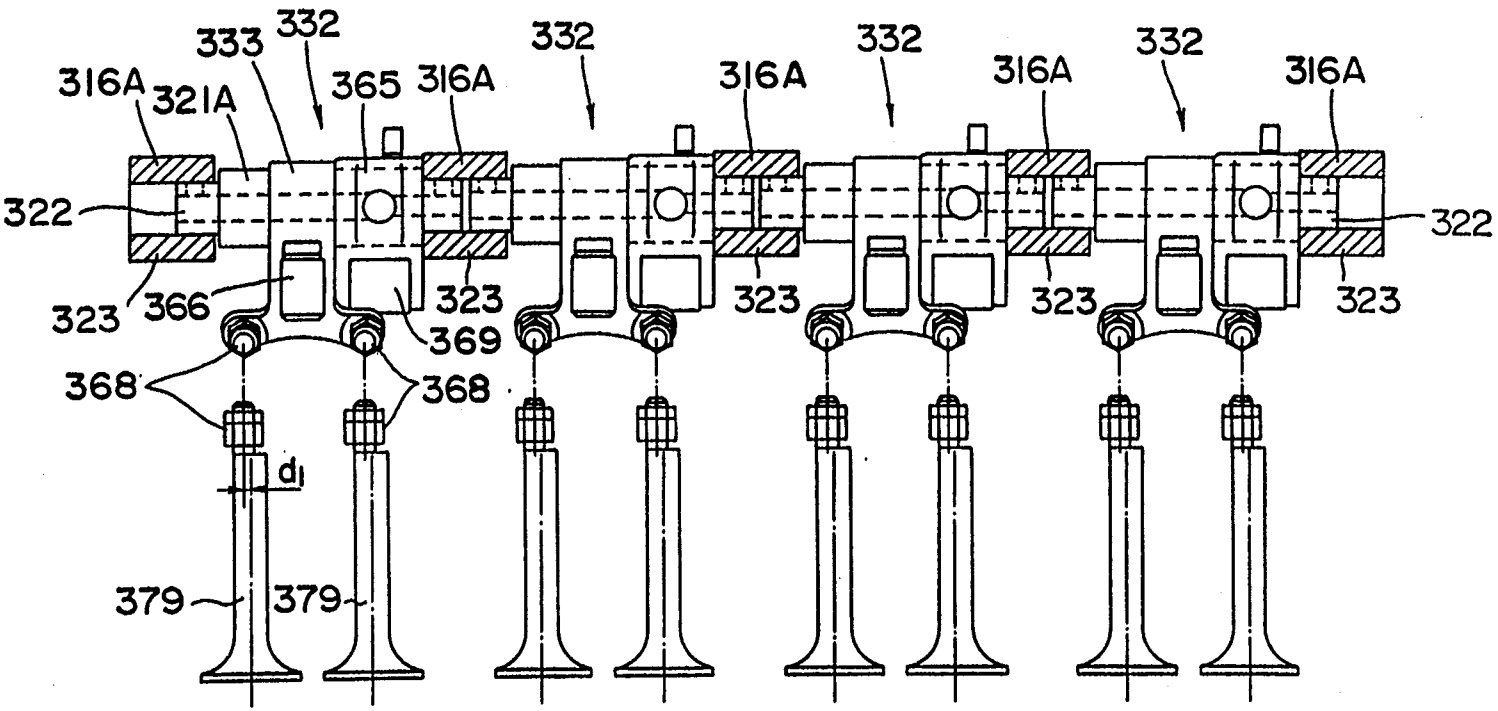
FIG. 34 is a schematic view showing the relationship between rocker arms and the like and valves in an assembled condition.

FIGS. 33 and 34 show an assembled condition of only the valve-moving apparatus 332 with no cylinder-closing mechanism which has no valve operation stopping mechanism. In FIG. 33, the right side is the intake side, and the left side is the exhaust side. Referring to FIG. 33, an arm spring 371 for making the high-speed rocker arm 365 in contact with the high-speed cam 315 when the high-speed rocker arm 365 is separated from the cam shaft part 321 is held by the cam cap 317. Connection and separation of the high-speed rocker arm 365 to the cam shaft part 321 is achieved, for example, by a hydraulic force and a spring force, and an oil control valve 389 for this purpose is mounted to an end of the cam shaft housing 315. FIG. 34 shows a schematic plan view of the valve-moving apparatus 332 and a contact condition of the adjust nut 368 at an end of the rocker arm part 332 with a stem end of a valve 379. Center of the valve 379 is eccentric $d_1$ to the center of the adjust nut 368.

Figure 35:
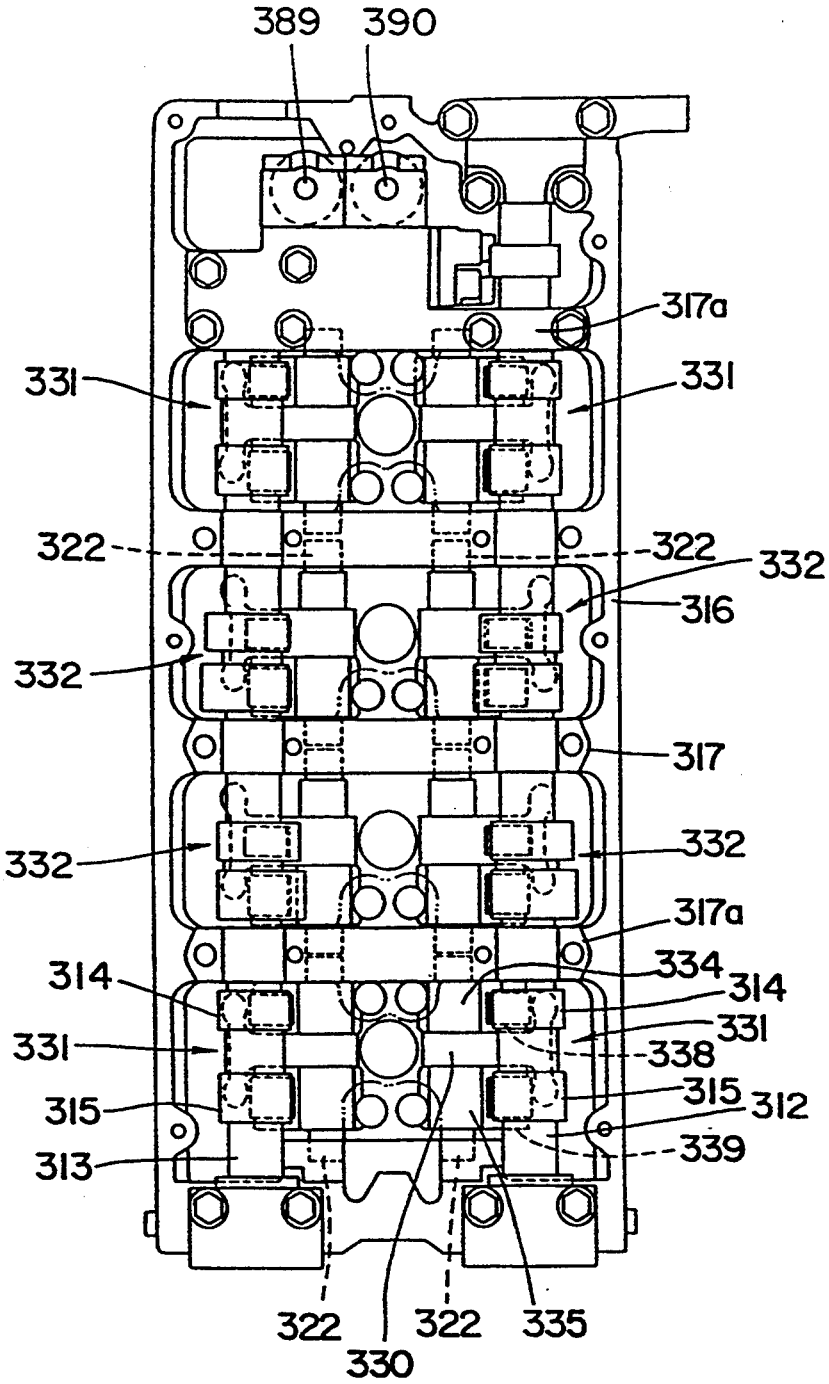
FIG. 35 is a schematic plan view of a cylinder head of an engine having a valve operation stopping mechanism.
Figure 36:
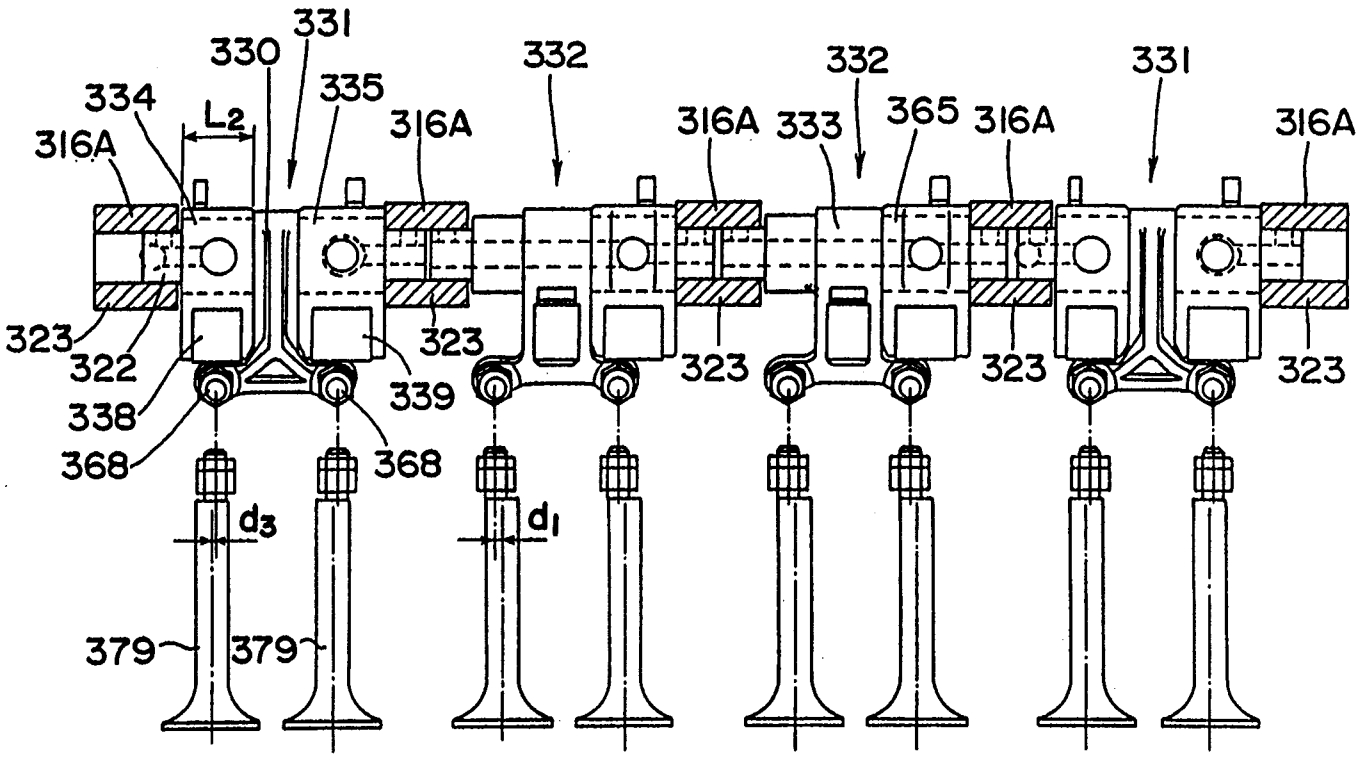
FIG. 36 is a schematic view showing the relationship between rocker arms and the like and valves in an assembled condition.

FIGS. 35 and 36 show an engine which is provided with a valve-moving apparatus with a cylinder-closing mechanism to stop operation of the first and fourth cylinders. The cam shaft housing 316, the rocker shaft cap 323, an the like can be commonly used. However, since it is necessary that the arm spring 371 acts also to the low-speed rocker arm 334 during cylinder closing, it must be replaced with one which has arm springs 371 on two cam caps 317, and one which has a further set **317*a*. Furthermore, since a cylinder-closing oil control valve 390 is necessary, it is mounted to an end of the cam shaft housing 316**.

FIG. 36 shows a schematic plan view of the valve-moving apparatus 331 with cylinder-closing mechanism and a contact condition of the adjust nut 368 at an end of the rocker arm part 330 with a stem end of the valve 379. In this embodiment, as shown in the Figure, in the valve-moving apparatus 331 with cylinder-closing mechanism, the contact point of the adjust nut 368 with the stem end is shifted by $d_3$ relative to the stem end center to the reverse side compared to the valve-moving apparatus with no valve operation stopping mechanism. This is to increase the thickness of the low-speed rocker arm 334 for improved rigidity by shifting to the reverse side. Of course, the valve opening function is unchanged.

With the rocker arm supporting structure according to the second embodiment, since axial dimensions of the rocker arm assembly are the same both for the valve-moving apparatus with and without valve operation stopping mechanism, the cam shaft holder and the like can be commonly used, which is advantageous in terms of manufacture and cost.

Figure 37:
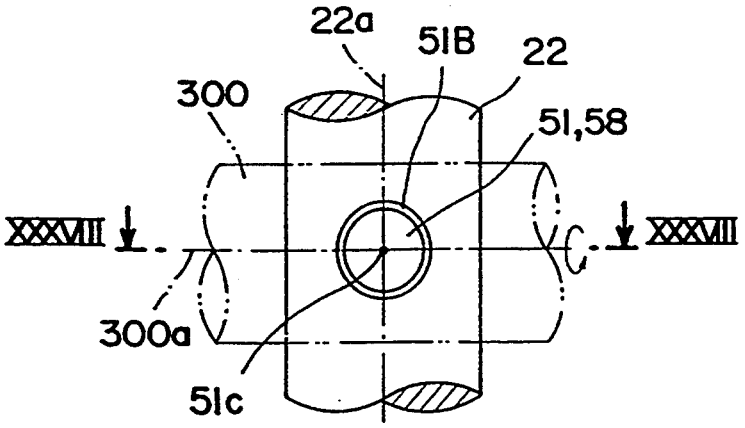
FIG. 37 is a schematic front view showing hole opening chamfering method of the present invention.
Figure 38:
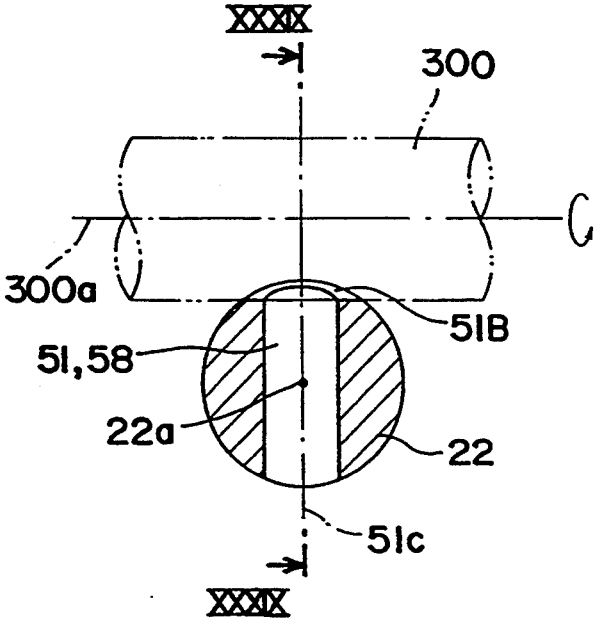
FIG. 38 is a schematic cross sectional view taken along line XXXVIII—XXXVIII in FIG. 37.

Then, chamfering of the through-holes 51 and 58 for sliding the rock pin 52 provided in the rocker shaft art 22 will be described in detail with reference to FIGS. 37 to 39. The rocker shaft part 22 is provided with the through-holes 51 and 58 in a direction perpendicular to the axial direction. An opening 51B of the through-holes 51 and 58 is chamfered by a cylindrical cutter 300 having a cutting edge on the outer peripheral surface.

The direction of a rotational center axis **300*a* of the cutter 300 is set perpendicular to the center axis 51*c* of the rocker shaft part 22 and the through-holes 51 and 58, the opening 51B is chamfered by the cutting edge on the outer peripheral surface of the cutter 300**.

Figure 39:
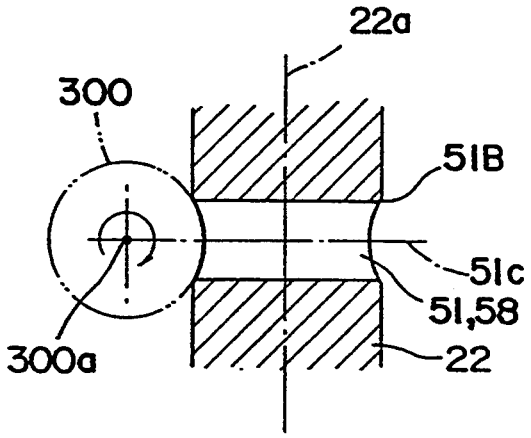
FIG. 39 is a schematic cross sectional view taken along line XXXIX—XXXIX in FIG. 38.

The diameter of the cutter 300, as shown in FIG. 39, is set slightly greater than an approximate circle of the opening 51B shown as a side cross sectional condition of the through-holes 51 and 58.

By chamfering the opening 51B of the through-holes 51 and 58 by the outer peripheral surface of the cutter 300, a chamfering depth is almost uniform over the entire periphery of the opening 51B.

In the hole opening chamfering method according to the present invention, since the direction of the rotational center axis of the cuter is set perpendicular to the axial direction of an elongate object and the axial direction of the hole, and the hole opening is chamfered by the outer peripheral surface of the cutter, chamfering is possible with a chamfering depth almost uniform over the entire periphery of the hole. As a result, mechanical chamfering of the hole opening becomes possible, thereby improving the productivity.

The cylinder head 11 is disposed with a pair of intake cam shaft 12 and exhaust cam shaft 13 parallel to each other along the longitudinal direction, and each cylinder is integrally formed with the small-lift low-speed cam 14 and the large-lift high-speed cam 15. The pair of cam shafts 12 and 13 are sandwiched between the upper portion of the cam shaft housing 16 and the plurality of cam caps 17, and rotatably supported on the cylinder head 11.

The cylinder head 11 is provided with a pair of intake rocker shaft part 21 and exhaust rocker shaft part 22 parallel to each other and parallel to the pair of cam shafts 12 and 13 for each cylinder. The pair of rocker shaft parts 21 and 22 are sandwiched between the lower portion of the cam shaft housing 16 and the pair of rocker shaft caps 23, and rotatably supported on the cylinder head 11.

The individual rocker shaft parts 21 and 22 are provided with a valve-moving apparatus which can be changed over to a high-speed operation valve timing and a low-speed operation valve timing, and a valve-moving apparatus which can be changed over to a high-speed operation valve timing and a low-speed operation valve timing and capable of cylinder closing at low-load operation. That is, as shown in FIG. 11, of the four cylinders, the valve-moving apparatus of the top and bottom cylinders have cylinder-closing mechanisms, and the valve-moving apparatus 32 of the central two cylinders have no cylinder-closing mechanisms.

The valve-moving apparatus 31 and 32 are the same in structure for the intake and exhaust sides. As shown in FIG. 7 and FIG. 10, the valve-moving apparatus having no cylinder-closing mechanism is provided integrally with the arm part 33 on the rocker shaft part 22, and adjacently with the high-speed rocker arm 35 connectable and disconnectable with the rocker shaft part 22, and the roller bearings 38 and 39 disposed on the arm part 33 are engaged with the low-speed cam 12 and the high-speed cam 15 on the above-described cam shaft 13.

In this engine, the ignition plug 106 is mounted on the cylinder head 11 at the position corresponding to the center of each cylinder, with its chip facing within the combustion chamber 85. The ignition plug 106 is covered with a pipe-formed ignition plug tube 05, and its upper portion is held by the cylinder head cover 25.

Figure 40:
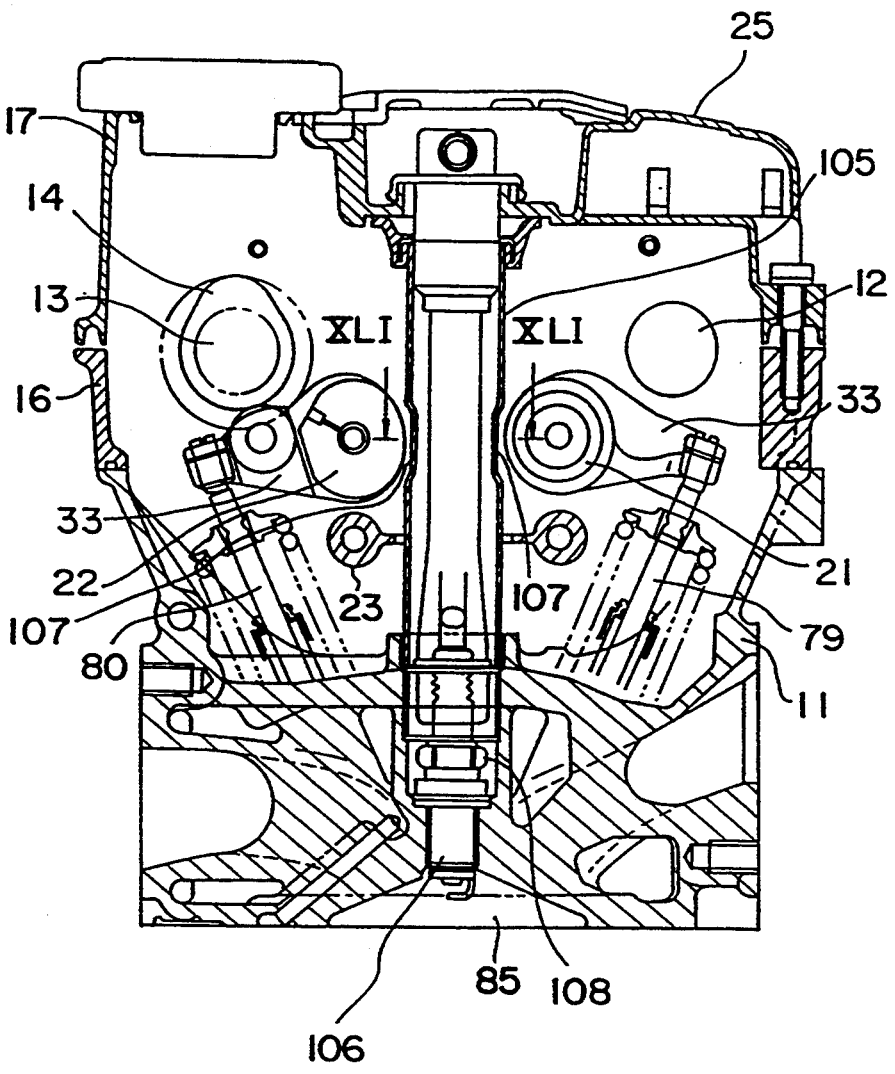
FIG. 40 is a schematic cross sectional view showing an upper portion of an engine having an ignition plug housing according to the XL—XL cross sectional view in FIG. 11.
Figure 41:
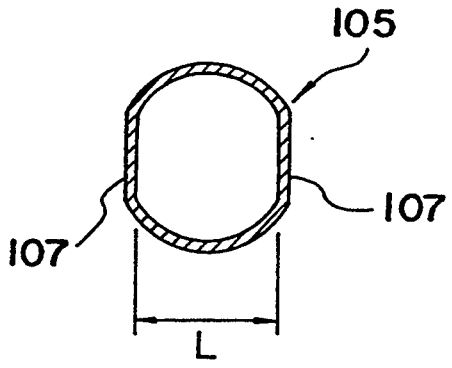
FIG. 41 is a schematic cross sectional view (XLI—XLI) in FIG. 40.

The ignition plug tube 105 is located between the arm parts 33 of the intake side and exhaust side valve-moving apparatus. Therefore, the recess 107 as shown in FIGS. 40 and 41 is provided on the body part of the plug tube 105 at a position opposing the arm part 33. By providing the recess 107, the rocking center of the arm part 33 can be further shifted to the center side with no interference with the ignition plug tube 105. Therefore the cam shaft 12 can also be shifted to the engine center side, and the width of the upper portion of the cylinder head can be reduced even further.

The recess 107 is formed by flattening part of the pipe-formed ignition plug tube 105, and its inner size is set as large as possible as far as a tool to be attached to the nut part 108 of the ignition plug 106 can pass.

The present embodiment is not limited to an engine having a valve-moving apparatus, but can also be applied to an ordinary engine. Also in this case, layout spacings of peripheral members can be reduced, thereby achieving a compact cylinder head.

With the ignition plug housing according to the present invention, since a recess is provided on the pipe-formed housing to reduce spacings to peripheral members, such as the rocker arm, as much as possible, thereby achieving a compact cylinder head. Furthermore, since it is unnecessary to grind part of the rocker arm and the like for size reduction, rigidity of the individual member can be maintained.

Mounting structure of the low-speed side roller bearings 38 and 66 and the high-speed side bearings 39 and 69 will now be described in detail with reference to FIGS. 7, 10, 42, 43, and 44.

First, in the valve-moving apparatus 32 with no cylinder-closing mechanism, the roller bearing 66 capable of contacting with the low-speed cam 14 is provided at an intermediated part of T-formed lever (L) 30L. The roller bearing 66 is supported to be smoothly rotatable through a bearing part 66B on a shaft 66A journaled at the intermediate part of the T-formed lever (L) 30L.

On the other hand, the high-speed rocker arm 65 is supported at its one end to be rotatable relative to the rocker shaft part 22, and is provided with the roller bearing 69 capable of contacting against the high-speed cam 15 at the other end. The roller bearing 69 is also supported to be smoothly rotatable through a roller bearing part 69B on a shaft 69A journaled on the rocker arm 65.

Figure 42:
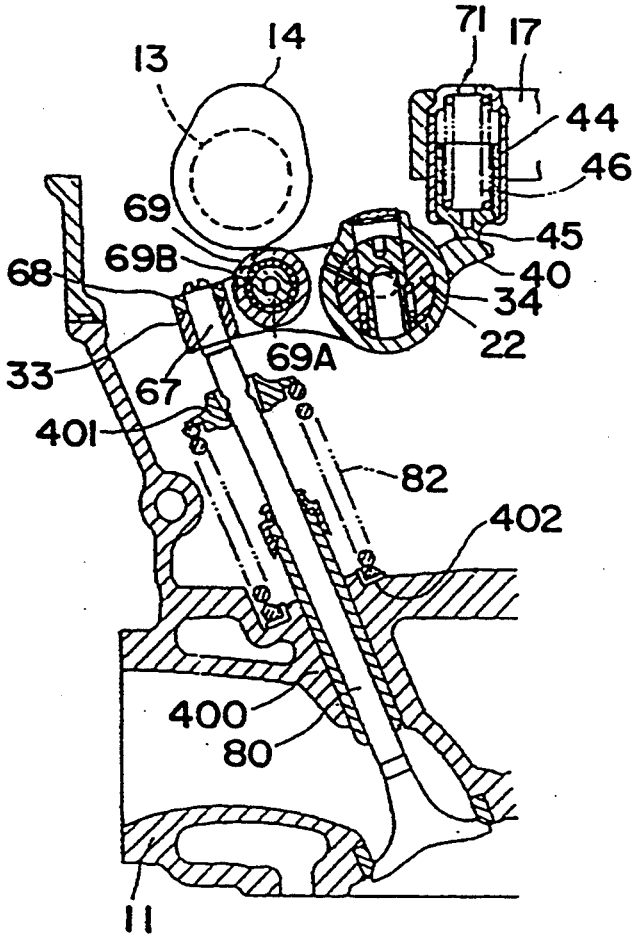
FIG. 42 is a partial schematic cross sectional view (XLII—XLII in FIG. 3) showing a valve-moving system structure having a variable valve timing mechanism as a modified embodiment of the present invention.
Figure 43:
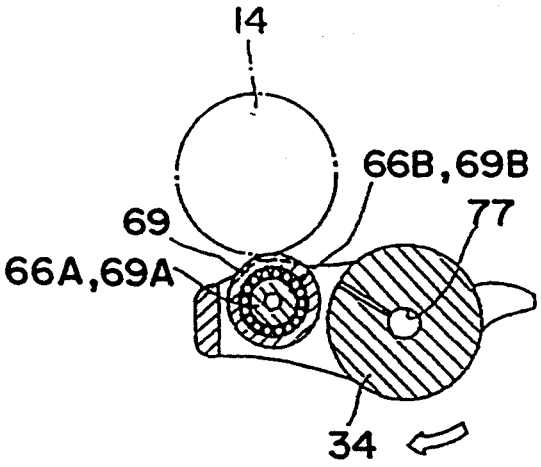
FIG. 43 is a schematic cross sectional view showing a rocker arm of a valve-moving system structure having a variable valve timing mechanism.

As described above with reference to FIG. 5, also in FIG. 42, a spring retainer 401 is disposed at a top end of the valve stem 200 of the valves 80 and 79; a spring retainer 402 is disposed at the cylinder head 11 side; and valve springs 81 and 82 are disposed between these spring retainers 401 and 402. This urges the valves 77 and 80 in the closing direction, that is, to the top end side of the valve stem 400. Therefore, the T-formed lever (L) 30L is also urged to the cams 14 and 15 side through the valve springs 81 and 82, and urging force of the valve springs 81 and 82 functions as a returning force when the T-formed lever (L) 30L rocks.

On the other hand, since the rocker arm 65 integrates with the T-formed lever (L) 30L to be applied with the urging force of the valve springs 81 and 82 in a connection mode, but is not applied with the urging force in a non-connection mode, it is necessary to provide a means for urging to the cams 14 and 15 side so that the rocker arm 65 follows the cams 14 and 15. Thus the arm spring 71 as shown in FIG. 10 is provided on the rocker arm 65.

Spring force of the compression spring 46 is set to counter the inertial force acting on the high-speed rocker arm 65. That is, when the inertial force acting on the high-speed rocker arm 65 is as indicated by a curve a2 in FIG. 45, the spring force of the compression string 46 can be set to a relatively small value, for example, as indicated by a curve b2 in FIG. 45.

In this valve-moving system, the low-speed roller bearing 66 is formed to be lighter in weight tan the high-speed roller bearing 69. That is, the high-seed roller bearing 69 is formed of an ordinary ferrous metal material, whereas the low-speed roller bearing 66 is formed of a material which is lightweight and has required abrasion resistance such as ceramics.

The valve clearance between the T-formed lever (L) 30L and the valves 79 and 80 (that is, valve clearance between the T-formed lever (L) 30L and the valves 79 and 80 when the T-formed lever (L) 30L is driven through the low-speed cam 14 in the connection mode) can be adjusted by the adjust screw 67. However, since the valve clearance when the T-formed lever (L) 30L moves integrally with the rocker arm 65 in the connection mode differs from that in the non-connection mode, it is necessary to adjust the valve clearance in the connection mode (during high-speed operation). Valve clearance adjustment in this case is mainly initial adjustment in assembly.

Figure 44:
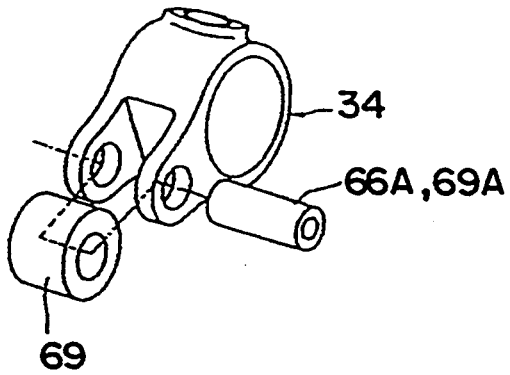
FIG. 44 is a schematic exploded perspective view showing a rocker arm of a valve-moving system structure having a variable valve timing mechanism.

Then, in this valve-moving system structure, plural types of high-speed roller bearings 69 with different outer diameters are prepared, an appropriate outer diameter is selected so that an appropriate valve clearance of the T-formed lever (L) 30L is obtained in the connection mode, and the high-speed roller bearing 69 is mounted on the rocker arm 65 as shown in FIG. 44.

As a result, in the valve-moving apparatus with no cylinder-closing mechanism, the tow-speed roller bearing 66 always acts as a valve-moving system weight for low-speed and high-speed operation. However, since the low-speed roller bearing 66 is formed of a lighter material than the high-speed roller bearing 69, an increase in the valve-moving system weight of the T-formed lever (L) 30L due to the low-speed roller bearing 66 is reduced to a slight value, thereby improving the dynamic characteristics (characteristics for driving the valve appropriately according to the cam profile of the cams 14 and 15) of the valve-moving system.

Therefore, the valves 79 and 80 are driven always appropriately, air intake is made to the combustion chamber of each cylinder at an appropriate timing, and the engine performance is improved.

Furthermore, since the low-speed roller bearing 66 is formed of a lightweight material, inertial weight of the valve springs 81 and 82 system provided on the valves 79 and 80 is also reduced, the valve springs 81 and 82 can be set to a smaller spring force, that is, more compact and lightweight, and friction of this portion is reduced, thereby improving the engine performance.

Further, in this valve-moving system structure, since the valve clearance in the connection mode (low-speed operation in this case) is adjusted by the adjust screw 67, and the valve clearance in the connection mode (high-speed operation in this case) is adjusted by outer diameter selection of the high-speed roller bearing 69, appropriate initial setting of the valve clearance can be achieved positively and easily.

Since both the T-formed lever (L) 30L and the rocker arm 65 are provided with rollers, abrasion due to contact with the cams 14 and 15 becomes very slight; a change in the valve clearance over time is nearly negligible; and normal operation of the valve-moving system can be maintained in a maintenance-free condition.

Furthermore, as described above, as the valve clearance is adjusted by outer diameter selection of the high-speed roller bearing 69, it is necessary to prepare plural types of high-speed bearings 69 with different outer diameters, and production cost of the high-speed roller bearing 69 tends to increase. However, since the high-speed roller bearing 69 is formed of a relatively inexpensive ferrous metal material, the cost increase can be limited to a small value. On the other hand, while the low-speed roller bearing 66 is formed of a relatively expensive material such as ceramics or the like, however, since the low-speed roller bearing 66 may be a single type, a cost increase for the low-speed roller bearing 66 can also be limited.

In the valve-moving apparatus 31 having a cylinder-closing mechanism, the rocker arms 32 and 35 are provided with rollers, the low-speed rocker arm 34 is rotatably supported on the rocker shaft part 22, and provided on the other end with the low-speed roller bearing 38 which is capable of contacting with the low-speed cam 14. The low-speed roller bearing 38 is supported to be smoothly rotatable through a roller bearing 38B on a shaft 38A journaled on the rocker arm 34.

On the other hand, the high-speed rocker arm 35 is rotatably supported at is one end on the rocker shaft part 22, and provided on the other end with the high-speed roller bearing 39 which is capable of contacting with the high-speed cam 15. The roller bearing 39 is also supported to be smoothly rotatable through a bearing part 39B on a shaft part 39A journaled on the rocker arm 35.

Also in this valve-moving system, the low-speed roller bearing 38 is formed of a material which is lighter than that for the high-speed roller bearing 39. That is, the high-speed roller bearing 39 is formed of an ordinary ferrous metal material, whereas the low-speed roller bearing 38 is formed of a material which is lightweight and has required abrasion resistance such as ceramics.

The low-speed rocker arm 32 and the high-speed rocker arm 35 are provided with the same arm springs 42 and 43. This is for the following reason.

As described above, of the rocker arms 32 and 35, the arm spring 42 of the low-speed side rocker arm 34 is required to have a tracking function in the high-speed rotation area after the driving mode of the valve is changed over to the high-speed driving mode, and the inertial force applied to the low-speed rocker arm 34 increases with the speed, and also increases due to the cam profile of the narrow valve opening angle of the low-seed cam 14. Therefore, in general, it is necessary to set the spring force of the spring 46 to a large value to be able to accomplish this.

Figure 45:
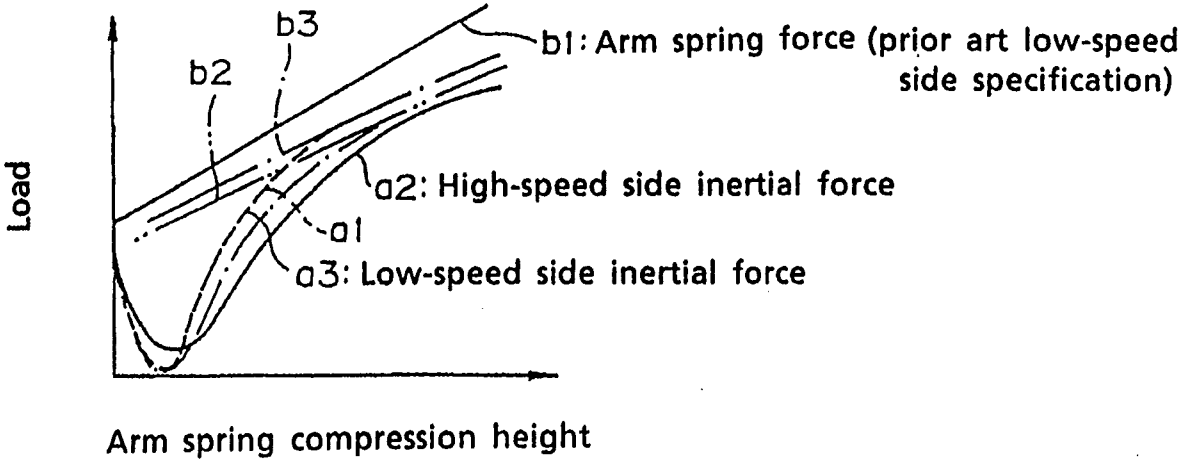
FIG. 45 is a graph showing inertial and spring force characteristics of a valve-moving system structure having a variable valve timing mechanism (graph showing inertial and spring force characteristics according to an arm spring compression height) of the present invention.

That is, in general, the inertial force of the low-speed rocker arm 34 (curve a1 in FIG. 45) is greater than the inertial force of the high-speed rocker arm 35 (curve a2 in FIG. 45), and the spring force of low-speed one (straight line b1 in FIG. 45) is required to be greater than that for high-speed one (straight line b2 in FIG. 45).

However, since the low-speed roller bearing 38 provided on the rocker arm 34 is formed of a material which is lighter than that for the high-speed roller bearing 39 provided on the high-speed rocker arm 35, weight of the rocker arm 34 is reduced to this extent, and the inertial force of the rocker arm 34 is reduced. That is, in the rocker arm 34, the inertial force is reduced by the amount of the reduced weight of the low-speed roller bearing 38, providing inertial force characteristics as indicated by curve a3 in FIG. 45.

Therefore, the minimum arm spring force required for the low-speed rocker arm 32 is as indicated by straight line b3 in FIG. 45, which is smaller than that of the conventional one (straight line b1 in FIG. 45), to be close to that of high-speed one (straight line b2 in FIG. 45).

As a result, even when the spring force of characteristics as indicated by straight line b3 is set to he high-speed rocker arm 34, excess of arm spring force applied to the high-speed side is very small. Therefore, no substantial loss occurs even if the same arm springs 42 and 43 are used for both the low-speed rocker arm 34 and the high-speed rocker arm 35.

Rather, by the use of the same arm springs 42 and 43 for both the rocker arms 34 and 35, substantial advantages are expected such as cost reduction due to the use of common parts, prevention of mis-mounting (mis-assembly) of the arm springs 42 and 43, and the like.

The valve clearance of the T-formed lever 30 to the valves 79 and 80 can be adjusted by the adjust screw 36, and this adjustment is made in the low-speed mode were the T-formed lever 30 engages with the low-speed rocker arm 34 but not with the high-speed rocker arm 35.

On the other hand, since, in the high-speed mode when the T-formed lever 30 does not engage with the low-speed rocker arm 32 but does engage with the high-seed rocker arm 35, the valve clearance of the T-formed lever 30 differs from that in the low-speed mode, it is necessary that the valve clearance in the connection mode (that is, high-speed operation) be adjusted (mainly for initial adjustment at assembly) by some means.

Then, in this valve-moving system structure, plural types of high-speed roller bearings 39 with different outer diameters are prepared, an appropriate outer diameter is selected so that an appropriate valve clearance is obtained in the high-speed mode, and the high-speed roller bearing 39 is mounted on the rocker arm 35 (FIG. 44).

As a result, since, in the valve-moving apparatus with a cylinder-closing mechanism, the low-speed roller bearing 38 is formed of a material lighter than that for the high-speed roller bearing 39, weight of the low-speed rocker arm 34 is reduced to this extent, and inertial force of the rocker arm 34 is reduced.

Therefore, the minimum arm spring force required for the low-speed rocker arm 34 is as indicated by straight line b3 in FIG. 45, which is smaller than that of conventional one (straight line b1 in FIG. 45), to be close to that of high-speed one (straight line b2 in FIG. 45), and friction of this part is reduced, thereby improving the engine performance.

Furthermore, the same arm springs 42 and 43 are used for the low-speed rocker arm 34 and the high-speed rocker arm 35, but this does not lead to a substantial friction loss in the high-speed rocker arm 35 and. Rather, substantial advantages can be obtained such as cost reduction due to the use of common parts, prevention of mis-mounting (mis-assembly) of the arm springs 42 and 43, and the like.

Of course, as described above, since the low-speed roller bearing 38 is formed of a material lighter than that of the high-speed roller bearing 39, weight increase of the valve-moving system of the T-formed lever 30 due to the low-speed roller bearing 38 is limited to a small value, and dynamic characteristics of the valve-moving system (that is, performance to drive the valves appropriately according to the cam profile of the cams 14 and 15) are improved.

Therefore, the valves 79 and 80 are driven always appropriately, and air intake is performed at an appropriate timing to the combustion chamber of each valve, thereby improving the engine performance.

Further, also in this valve-moving system structure, since the valve clearance in the low-speed mode is adjusted by the adjust screw 36, and the valve clearance in the high-speed mode is adjusted by outer diameter selection of the high-speed roller bearing 39, appropriate initial setting of the valve clearance can be achieved positively and easily.

Since both the rocker arms 34 and 35 are provided with rollers, abrasion due to contact with the cams 14 and 15 becomes very slight; change in the valve clearance over time is nearly negligible; and normal operation of the valve-moving system can be maintained in a maintenance-free condition.

Furthermore, the as described above, the valve clearance is adjusted by outer diameter selection of the high-speed roller bearing 39, it is necessary to prepare plural types of high-speed bearings 39 with different outer diameters such that production cost of the high-speed roller bearing 39 tends to increase to this extent. However, since the high-speed roller bearing 39 is formed of a relatively inexpensive ferrous metal material, the cost increase can be limited to a small value. On the other hand, while the low-speed roller bearing 38 is formed of a relatively expensive material such as ceramics or the like, since the low-speed roller bearing 38 may be a single type, cost increase for the low-speed roller bearing 38 can also be limited.

Structures of mode change-over means, the main rocker arm and the sub-rocker arms are not limited to those of the present embodiment.

Figure 46:
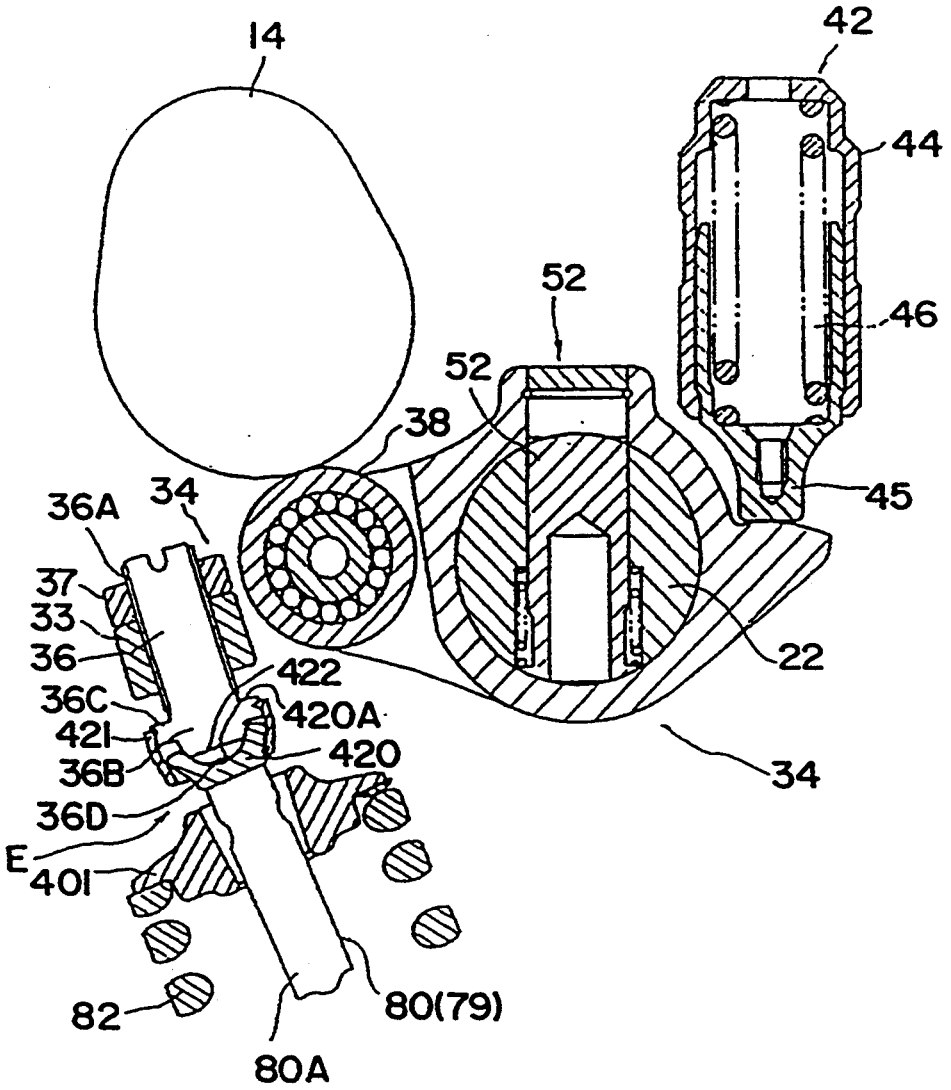
FIG. 46 is a schematic view showing a valve contact part of a valve-moving system structure having a variable valve timing mechanism of the present invention.

Next, a modification example of the adjust screws 36 and 67 will now be described with reference to FIG. 46.

An elephant foot structure E is disposed at the contact part of the adjust screws 36 and 67 with the valves 79 and 80. For example, the adjust screw 36 will be described. As shown in FIG. 46, the adjust screw 36 has an adjust screw main body 36A screwed with the arm part 33 and a nut 37 for retaining the adjust screw main body 36A at a predetermined position. The elephant foot structure E is provided on the bottom end of the adjust screw main body 36A.

The elephant foot structure E comprises the adjust screw main body 36A, a pad 420 in sliding contact with the adjust screw main body 36A, and a retainer 421 for retaining the pad 420 not to separate from the adjust screw main body 36A.

An enlarged diameter part 36B is formed at the lower part of the adjust screw main body 36A, and a curved projection part 36D is formed at the bottom end of the enlarged diameter par 36B. Furthermore, a curved recess 420A is formed on the pad 420. The curved recess 420A is in line contact with the curved projection part 36D on a line 422 as shown in FIG. 46. The lower surface of the pad 420 is in face contact with ends of stems 79A and 80A of the valves 79 and 80. The retainer 421 is mounted so that it engages with an outer periphery 36C of the enlarged diameter part 36B of the adjust screw main body 36A.

With such line contact of the curved recess 420A with the curved projection part 36D and face contact of the pad 420 with the valve 80, abrasion of the contact part is considerably suppressed.

Since the contact part of the adjust screw 67 with the valves 79 and 80 is structured same as above, detailed thereof is omitted.

Furthermore, with the line contact of the curved projection part 36D of the adjust screw main body 36A with the curved recess 420A of the pad 420 and the face contact of the pad 420 with the valves 79 and 80, point contact of this portion is avoided, and abrasion of the contact part is considerably suppressed.

With such abrasion reduction, change in valve clearance over time is nearly negligible, and normal operation of the valve-moving system can be maintained in a maintenance-free condition.

That is, in a phase condition where the individual rocker arms 32, 35, 62, and 65 contact with the base circle of the cams 14 and 15, rotation phases of the two sets of rocker arms 34, 35, 64, and 65 are positively in line, engagement of the rock pins 52, 59, and 74 is smoothly performed, and change-over of valve timing by the variable valve timing mechanism is appropriately made.

With the adjust screw capable of adjusting the valve clearance disposed at the contact part of the valve driving arm with the intake valve or exhaust valve, and the elephant foot structure provided on the adjust screw, while the valve clearance can be adjusted at assembly of the valve-moving system, change in valve clearance over time is reduced, and normal operation of the valve-moving system can be maintained in a maintenance-free condition.

The elephant foot structure is provided with a first contact member disposed at the valve driving arm side and a second contact member disposed between the firs contact member and the stem end of the intake valve or the exhaust valve, the first contact member being provided with a convex curved surface, the second contact member being provided with a concave curved surface, and the second contact member is in face contact with the stem end, whereby point contact of the valve driving arm with the valve is always positively prevented even if the valve clearance is adjusted by the adjust screw, and normal operation of the valve-moving system can be maintained.

Next, the lubrication structure of roller bearings 339, 366, and 369 will be described in detail with reference to FIGS. 32(A) and (B), and FIG. 47.

Rocker shaft parts 321 and 322 are provided with oil passages 5, the hydraulic pressure passages 62 and 77 are formed with an oil jet 430 directed to the contact surface of the roller bearings 339, 366, and 369 with the cams 14 and 15 and the like, and an oil reservoir 431 is formed at the outlet part of the oil jet 430.

When hydraulic pressure of the hydraulic pressure passages 62 and 77 is high, oil is blown off from the oil jet 430, and is directly supplied to the contact surface of the roller bearings 339, 366, and 369 with the cams 14 and 15 in order to lubricate them.

Figure 47:
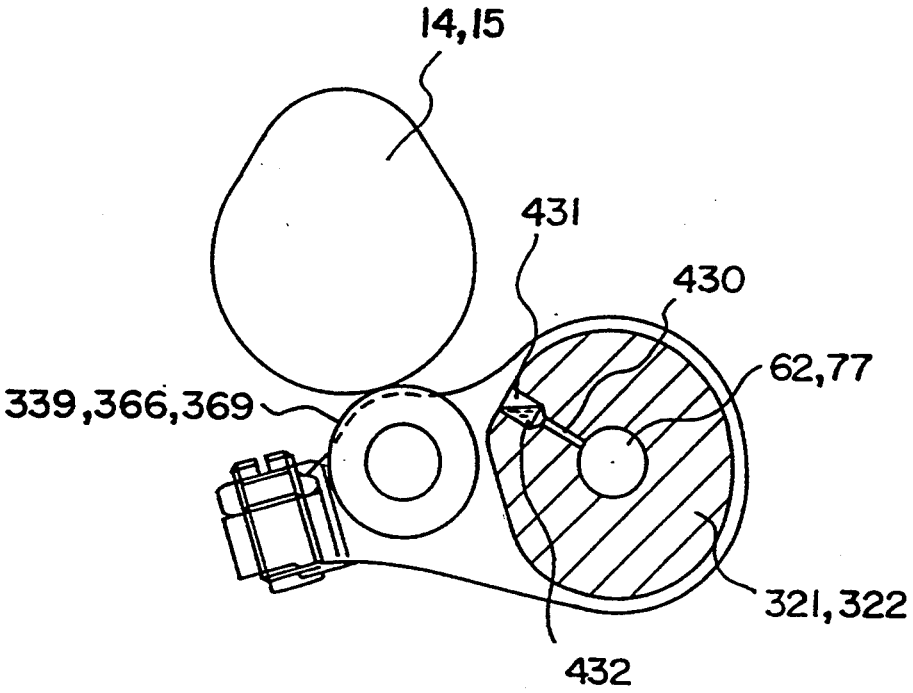
FIG. 47 is a schematic cross sectional view of a lubrication structure.

When the hydraulic pressure is low, oil 432 collects in the oil reservoir 431 as shown in FIG. 47. Then, when the oil reservoir 431 is inclined by the rocking of the rocker arms 335 and 365, oil in the oil reservoir 431 overflows during rocking, and a large amount of oil is supplied to the roller bearings 339, 366, and 369. As a result, the roller bearings 339, 366, and 369 and the cams 14 and 15 are positively lubricated.

The reason why oil is not supplied from he hydraulic pressure passage 56 side in the rocker arm 334 to the roller bearing 338 is to prevent mis-operation of the rock pin 52 due to a change in pressure by such oil supply and the roller bearing 338 is lubricated by another oil supply means (not shown).

The present invention is not limited to the above embodiment, but can also be applied to a roller rocker arm of a type of which one end is supported on a lash adjuster and the other end is in contact against the valve end, as well as other types of rocker arms, and the size and shape of the oil reservoir not being limited to that of the present embodiment.

With the rocker arm lubrication structure according to the present invention, since the oil reservoir is provided at the outlet of the oil jet and, when the hydraulic pressure is low, oil collected in the oil reservoir overflows by the rocking of the rocker arms an splashes on the rollers, the rollers and cams are always positively lubricated, thereby providing improved reliability and durability. Furthermore, in providing an oil reservoir, the lubrication structure does not lead to a cost increase.

Jump prevention during lifting of the valves 79 and 80 will be described with reference to FIGS. 48 to 52.

Figure 48:
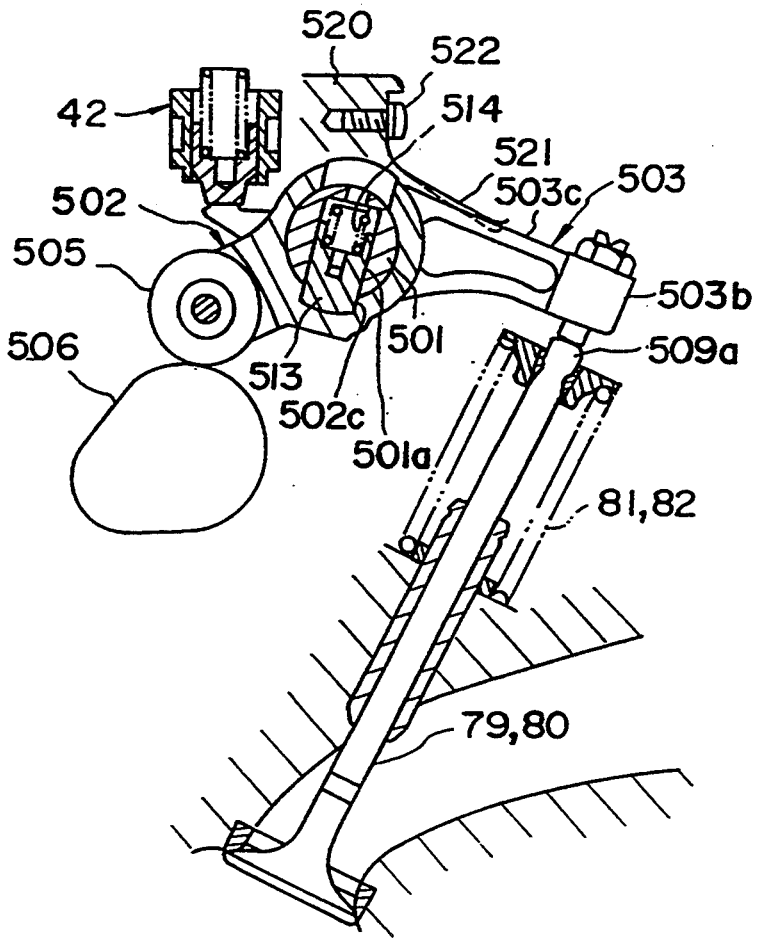
FIG. 48 is a schematic cross sectional view of a valve-moving mechanism of an engine.
Figure 49:
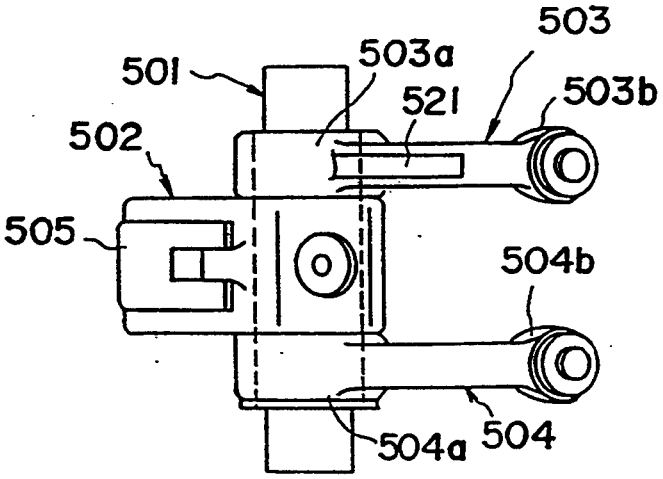
FIG. 49 is a schematic plan view of FIG. 48.

In FIG. 48 and FIG. 49 a support part 520 is provided for one of rocker arm parts 503 and 504 with bases 503*a* and 504*a* fixed to a rocker shaft part 501, for example, at a position slightly above the base 503*a* of the rocker arm part 503, the support part 520 being integrally formed at a position which has no connection with movement of the valve-moving apparatus, for example, on the cylinder head 11 on which the valve-moving apparatus is disposed. A spring 521 as biasing means is, for example, a band-formed plate spring, its base is mounted to an end face of the support part 520 by a bolt 522, curved in the vicinity of the base and extending in a chip end 503*b* direction along an upper surface 503*c* of the rocker arm part 503, with the chip end being pressed against about the center of the upper surface 503*c*.

The spring 521 presses the upper surface 503*c* of the rocker arm part 503 to press the rocker arm part 503 and the rocker arm part 504 so that they rotate clockwise about the rocker shaft part 501. An initial load of the spring 521 is set to a value which is greater than a torque due to friction between the rocker arm 502, supported on the rocker shaft part 501, and the rocker shaft part 501, thereby preventing the rocker shaft part 501 from rotating with the rocker arm 502.

Figure 50:
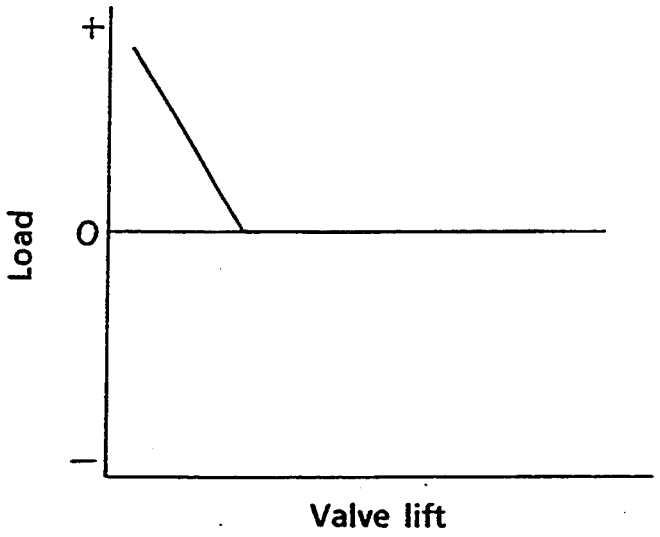
FIG. 50 is a diagram showing the relationship between a valve lift amount and a spring force.

Furthermore, the spring 521 gradually decreases in spring force as the lift amount of the valves 79 and 80 increases as shown in FIG. 50, that is, as the rocker arm part 503 rotates downward, so that it does not apply a spring force exceeding a predetermined value.

A rock pin 513 is pushed out from a through-hole 501*a* of the rocker shaft part 501 by the spring force of a spring 514 when hydraulic pressure is not applied, and its chip end engages with an engaging hole 502*c* of the rocker arm 502 to link the rocker arm 502 with the rocker shaft part 501. As a result, the rocker arm parts 503 and 504 are rocked through the rocker arm 502 and the rocker shaft part 501 to rock the individual valves 79 and 80.

During cylinder closing, the rock pin 513 is pushed in the through-hole 501*a* of the rocker shaft part 501 by hydraulic pressure against the spring force of the spring 514, and its chip end disengages from the through-hole 502*c* of the rocker arm 502. As a result, engagement of the rocker arm 502 with the rocker shaft part 501 is released, the rocker shaft part 501 becomes free from the rocker arm 502, the rocker arm parts 503 and 504 stop rocking even when the rocker arm 502 rocks according to rotation of a cam 506, and the individual valves 79 and 80 are maintained in a stop (valve-closed) condition. Therefore, cylinders of these valves 79 and 80 are stopped (closed).

In the ascending area of the cam 506, since the rocker arm parts 503 and 504, integral with the rocker shaft part 501, are regulated by the valve end, the rocker shaft part 501 does not rotate. Further, since the rocker arm parts 503 and 504 are pressed at the individual chip ends 503*b* and 504*b* against the stem heads of the individual valves 79 and 80 by the spring force of the spring 521 , they are prevented from jumping up in the descending area of the cam 506. Therefore, the rocker shaft part 501 is prevented from rotating with the rocker arm 502. As a result, in the base circle area of the cam 506 during cylinder closing, the through-hole 502*c* of the rocker arm 502 and the rock pin 513 are maintained in line, and the chip end of the rock pin 513 is engageable with the through-hole 502*c* of the rocker arm 502. This enables the valves 79 and 80 to smoothly return from stop condition to operating condition.

Figure 52:
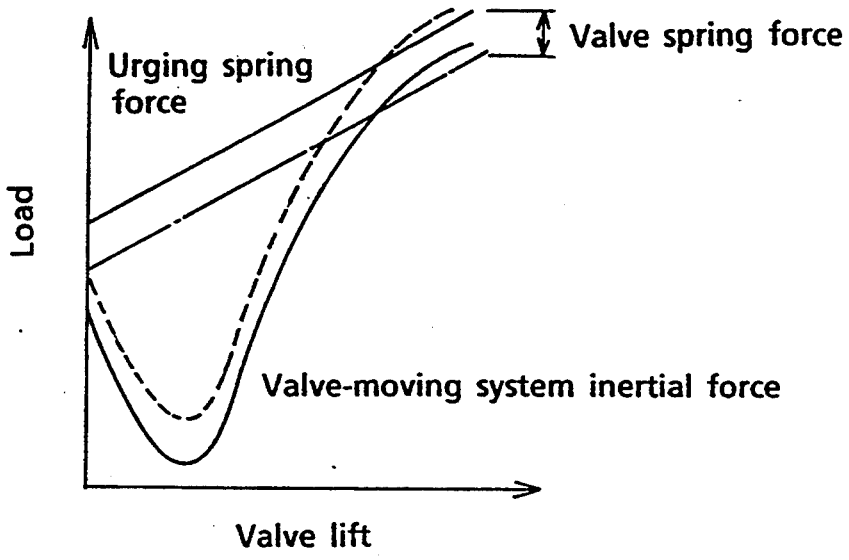
FIG. 52 is a diagram showing a malfunction when a spring force is always applied.

Since the urging direction of the spring 521 is the reverse to the urging direction of the valve springs 81 and 82, if the urging force of the spring 521 is always applied during lifting of the valves 79 and 80, as shown in FIG. 52, during valve driving, the spring force is added to the inertial force of the valves 79 and 80 to cause the valves 79 and 80 themselves to jump up, and the desired valve-moving characteristics cannot be obtained. Therefore, the arrangement is made so that the spring force of the spring 521 is applied only before lifting, or only before lifting and during initial lift. In the relation between a roller 505 of the rocker arm 502 and the cam 506, the spring force is applied only when the roller 505 contacts the base circle of the cam 506, or only during the base circle and initial lift, while in other periods, no or almost no spring force is applied to a stem head 509*a* of he valves 79 and 80.

Figure 51:
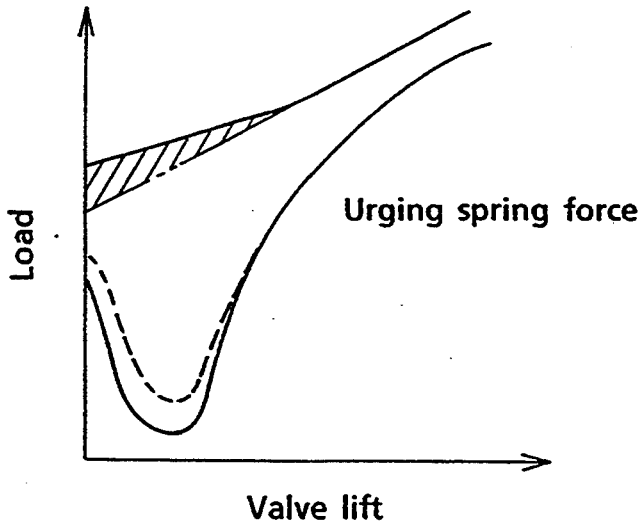
FIG. 51 is a diagram showing the relationship between a valve lift amount and a force applied to the valve.

As a result, as shown in FIG. 51, spring force by the spring 521 is not applied when the valves 79 and 80 lift, thereby preventing jump-up of the valves 79 and 80.

Figure 53:
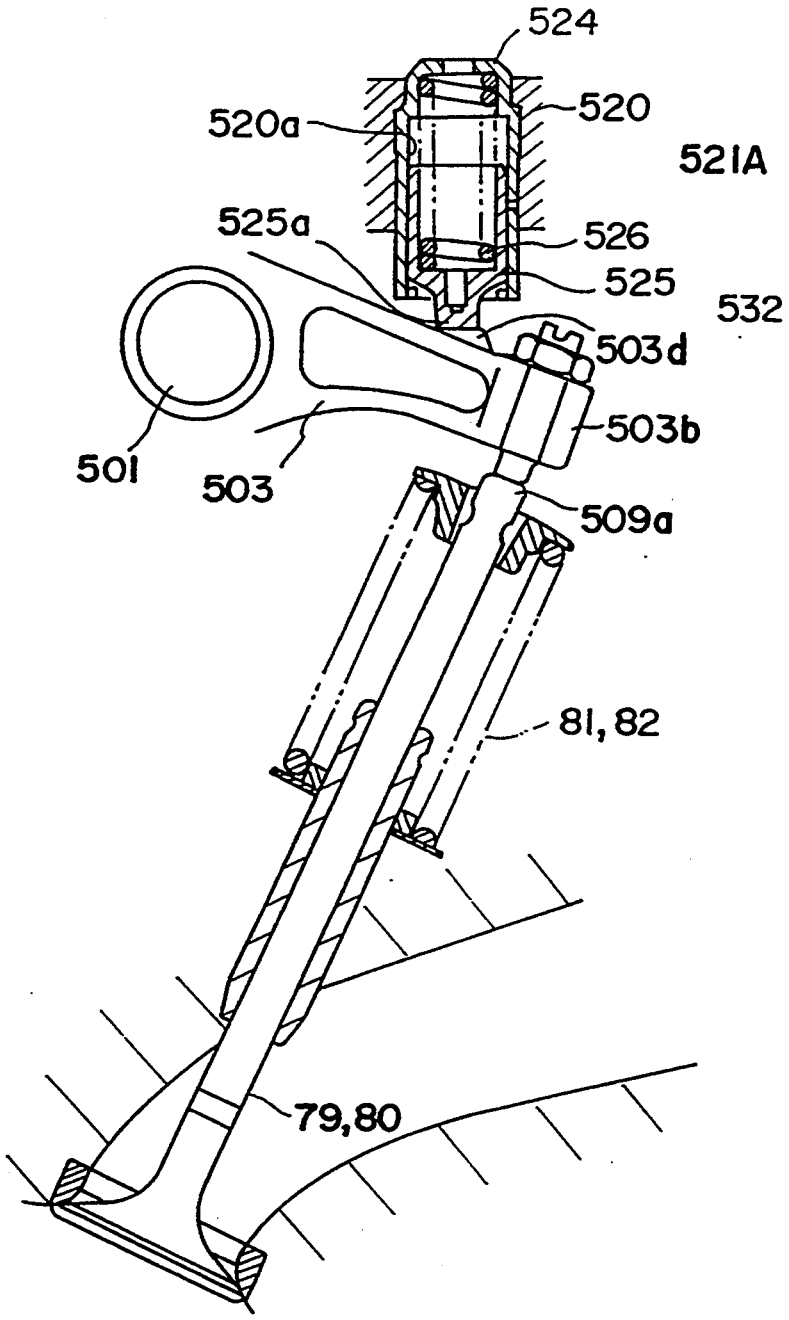
FIG. 53 is a schematic cross sectional view showing part of another modification of the present invention.

The valve-moving apparatus shown in FIG. 53 uses an arm spring 521A in place of the spring 521, the support part 520 being provided with upper and lower holes 520*a* above the rocker arm 503 in the vicinity of the chip end 503*b* of the rocker arm 503, the hole 520*a* being engaged with a cylinder 522 with its opening facing down, the cylinder 524 being engaged to be slidable in the axial direction with a plunger 525 with its closed end directed downward, and a compression spring 526 in a compressed condition being disposed between the cylinder 524 and the plunger 525. A projection 525*a* provided at the center of the closed end surface of the plunger 525 is pressed against a boss 503*d* projected in the vicinity of the chip end 503*b* on the upper surface 503*c* of the rocker arm 503. A snap ring 532 is disposed as a stopper inside the opening of the cylinder 524.

Figure 54:
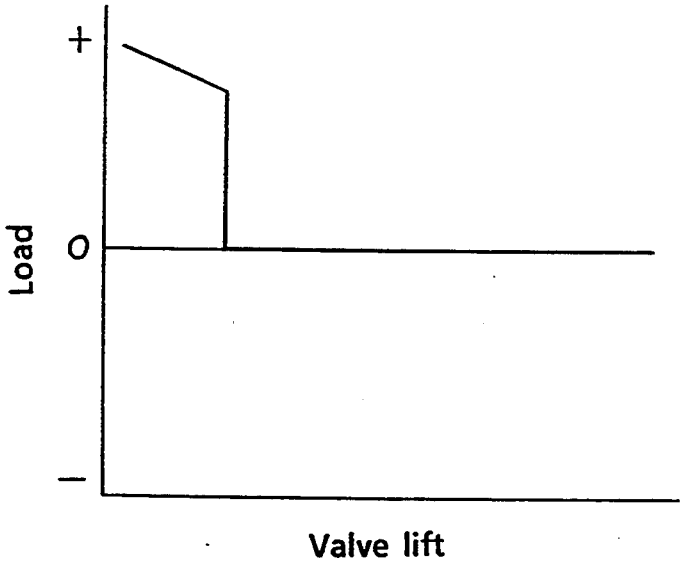
FIG. 54 is a diagram showing the relationship between a valve lift amount and a spring force.

Therefore, the plunger 525 endows the rocker arms 503 and 504 with a pressing force in the clockwise direction in the Figure by the spring force of the spring 526. However, when the rocker arms 503 and 504 slightly rotate, the lower end of the cylinder 524 hits the snap ring 532 and is not able to move down further, and cannot apply spring force to the rocker arms 503 and 504. That is, as shown in FIG. 54, spring force is applied only during an initial lifting period of the valves 79 and 80, and no spring force is applied in other period.

Figure 55:
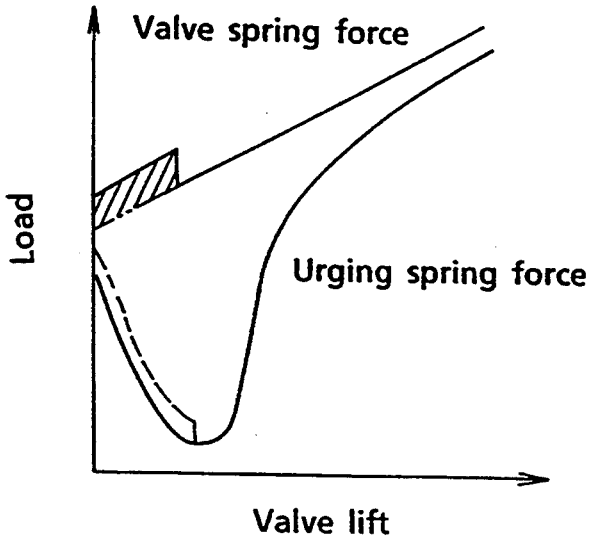
FIG. 55 is a diagram showing the relationship between a valve lift amount and a force applied to the valve.

Therefore, similar to the above description, jump-up of the rocker arms 503 and 504 in the descending area of the cam 506 during cylinder closing is prevented; rotation of the rocker shaft part 50 with the rocker arm 502 is prevented; as shown in FIG. 55, since the valves 79 and 80 are not applied with any excess urging force during driving of the valves 79 and 80, jump-up of the valves 79 and 80 is prevented, thereby providing the desired valve-moving characteristics.

Figure 56:
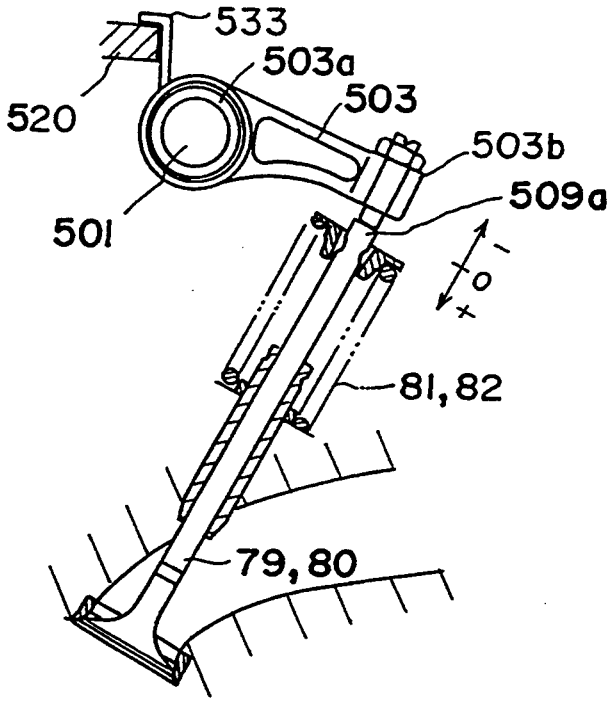
FIG. 56 is a schematic cross sectional view showing part of another modification of the present invention.
Figure 57:
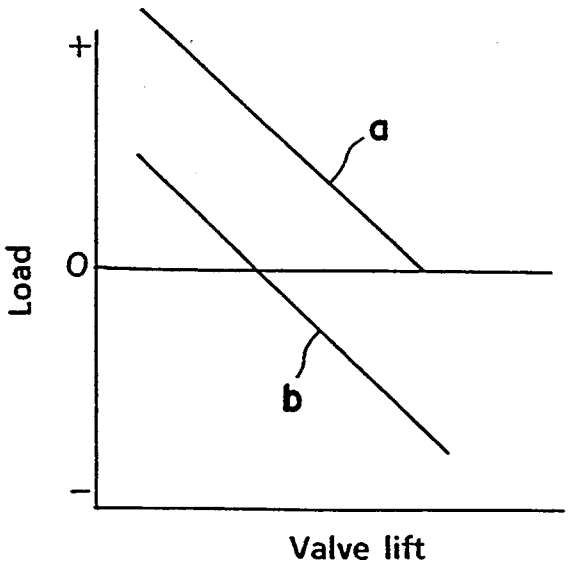
FIG. 57 is a diagram showing the relationship between a valve lift amount and a spring force which is produced by a torsion spring.
Figure 58:
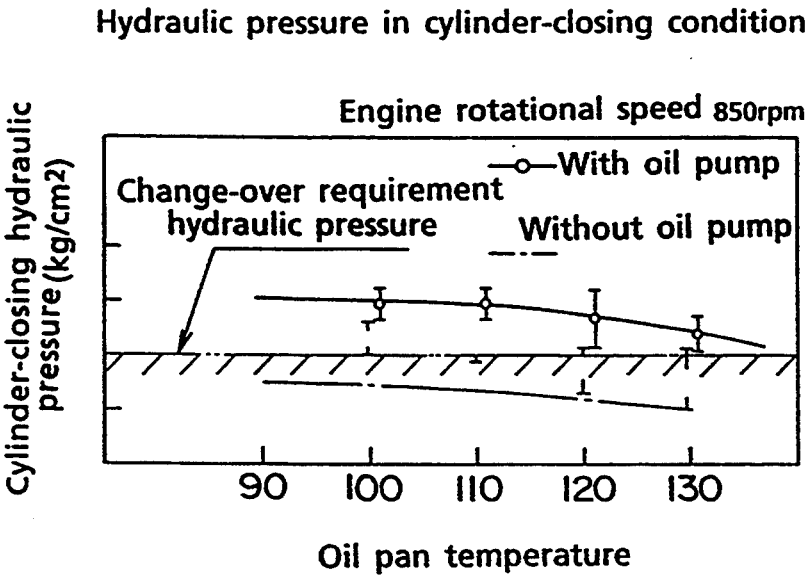
Fig. 58 PRIOR ART
FIG. 58 is a graph showing hydraulic pressure during cylinder-closing condition of a prior art internal combustion engine.
Figure 59:
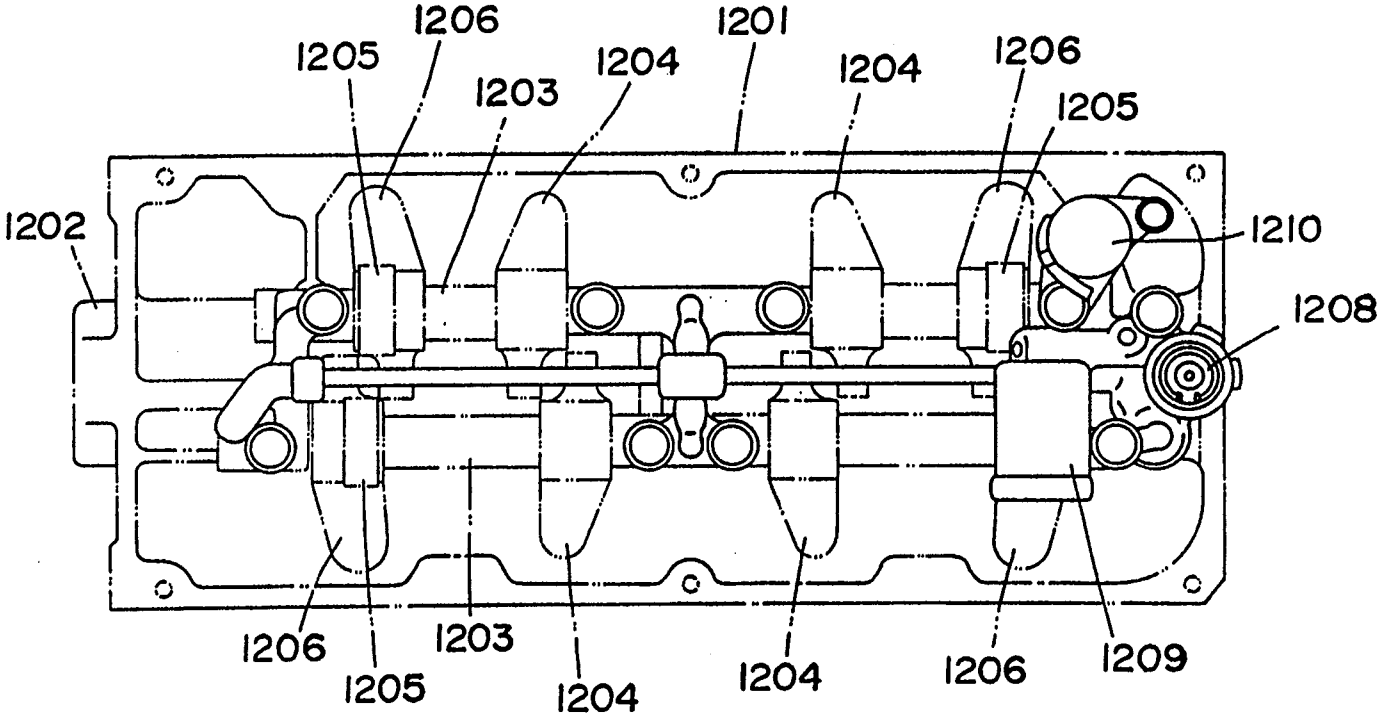
Fig. 59 PRIOR ART
FIG. 59 is a schematic plan view of a cylinder head showing a valve-moving apparatus of a engine having a prior art cylinder-closing mechanism.
Figure 60:
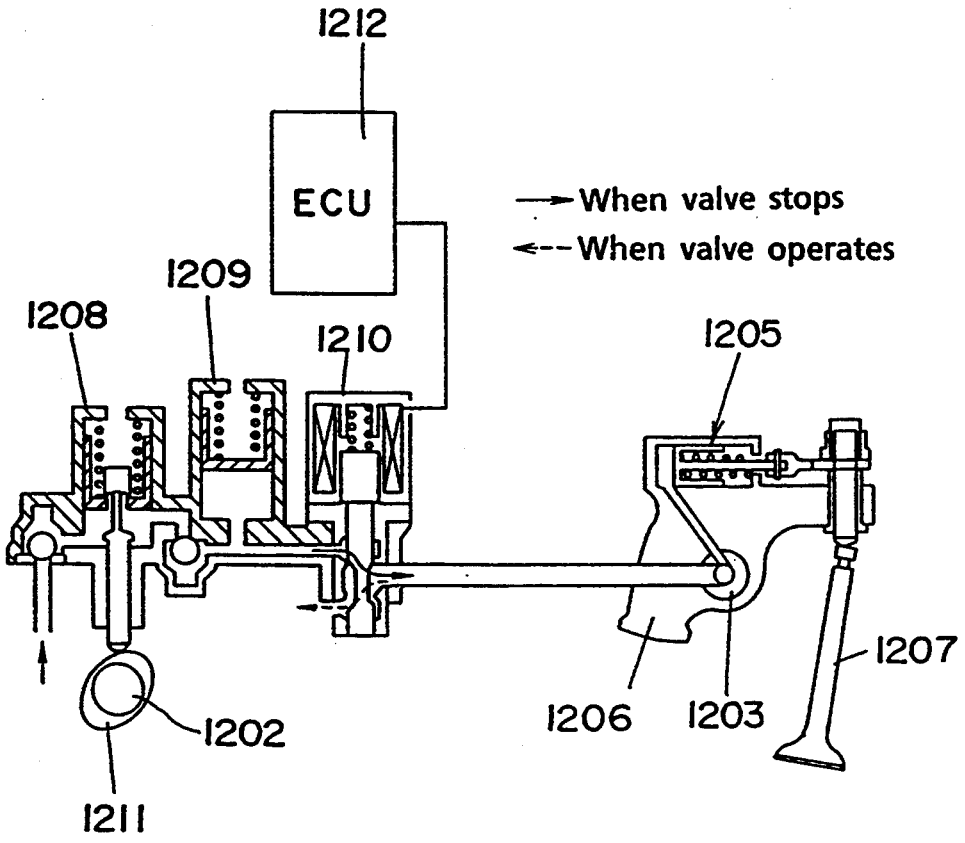
Fig. 60 PRIOR ART
FIG. 60 is a schematic view showing a hydraulic pressure passage of a prior art valve-moving apparatus.

FIG. 56 shows another modification example which uses a torsion spring. Specifically, the base 503*a* of the rocker arm 503 is engaged with a torsion spring 533 to retain one end of the torsion spring 533, and the other end is attached to the fixed support part 520. When the torsion spring 533 is used, as indicated by a in FIG. 57, it is also possible that not only the spring force gradually increases according to the lift amount of the valves 79 and 80, but also the spring force pressing the valves 79 and 80 gradually decreases according to the lift amount of the valves 79 and 80, and a spring force in the reverse direction, that is, a spring force in the same direction as the valve spring 531 is applied. Thus, jump-up of the valves 79 and 80 at opening and closing of the valves 79 and 80 is positively prevented.

In addition to the above, as the spring 521, it is possible to use a tension spring or the like, and as urging means, other than springs can also be used.

The present embodiment has been described when applied to the valve-moving apparatus of a variable cylinder engine, however, this embodiment is not limited to the above, but the spring 521 or the arm spring 524 may be applied to the T-formed lever 30 in FIG. 6 and the T-formed lever (L) 30L in FIG. 10, and can be applied to a valve-moving apparatus which can vary the valve timing according to the engine operation condition.

With the above structure in which biasing means 521, 521A, and 533 press the chip end of the rocker arm 503 to the stem head 509*a*, deviation of the rocker shaft part 501 from the individual through-holes 502*c* of the rocker arm 502 during cylinder closing is prevented; the rock pin 513 pulled in the through-hole 502*c* of the rocker shaft part 501 is easily engageable with the through-hole 502*c* of the rocker arm 502; and return from cylinder-closed operation to full-cylinder operation or varying the valve timing can be smoothly performed.

Furthermore, since the urging means applies the urging force only before valve lifting or in the initial lift, the valves will not jump up at opening and closing the valves; friction is not increased; and it is unnecessary to strengthen the valve spring.

We claim:

1. An internal combustion engine having a valve-moving apparatus comprising:

an intake cam shaft and an exhaust cam shaft, each of said cam shafts having at least one low-speed cam and at least one high-speed cam;

a cam shaft bearing cap supporting aid cam shafts;

a plurality of lever members disposed adjacent to said cam shafts, each said lever member comprising a rocker shaft part rotatably mounted on support members of the engine, and an arm part integrally formed with said rocker shaft part, and contacting against at least one of a pair of intake valves and a pair of exhaust valves;

at least one rocker arm rotatably mounted on said rocker shaft part and rocked by one of said cams;

change-over mechanism means for selectively engaging said at least one rocker arm with said rocker shaft part; and hydraulic pressure supply means for hydraulically operating said change-over mechanism means according to an operating condition of the engine;

each of said at least one rocker arm is rotatably mounted individually on each said rocker shaft part on both sides of each said arm part, and include a low-speed rocker arm and a high-speed rocker arm; and low-speed first arm spring means and high speed first arm spring means, said low-speed first arm spring means biasing said low-speed rocker arm and said high-speed first arm spring means biasing said high-speed rocker arm, so that said rocker arms contact against said low speed cam and said high speed cam, respectively, wherein said low-speed first arm spring means has a greater biasing force than the biasing force of said high-speed first arm spring means.

2. The internal combustion engine of claim 1 wherein said hydraulic pressure supply means includes an oil passage for supplying lubricating oil to both said first arm spring means, said oil passage being disposed in said cam shaft bearing cap.

3. The internal combustion engine of claim 1 wherein said low-speed rocker arm and said high-speed rocker arm include a low-speed roller bearing means and a high-speed roller bearing means, respectively, said low-speed roller bearing means and said high-speed roller bearing means being rotatably mounted respectively on said low-speed rocker arm and said high-speed rocker arm, said roller bearing means being driven by said low-speed cam and said high-speed cam, respectively.

4. The internal combustion engine of claim 3, wherein said low-speed roller bearing means is formed of a material lighter in weight than a material of said high-speed roller bearing means.

5. The valve-moving apparatus of claim 4 wherein said low-speed roller bearing means is formed of a ceramic, and said high-speed roller bearing means is formed of a ferrous metal.

6. The internal combustion engine of claim 1 further comprising biasing means mounted to said support members, said biasing means urging at least one of said lever members to contact against said valves.

7. The internal combustion engine of claim 6 wherein said valves are disposed so that said valves are urged by said levers member only in an initial stage when said valves are lifting.

8. The internal combustion engine of claim 6 wherein said biasing means is second arm spring means.

9. The internal combustion engine of claim 6 wherein said biasing means is a plate spring.

10. The internal combustion engine of claim 6 wherein said biasing means is a torsion spring.

11. The internal combustion engine of claim 1 wherein said hydraulic pressure supply means comprises:

a first oil control valve for supplying hydraulic pressure from the oil pump of the engine to oil chambers of said change-over mechanism means provided in said high-speed rocker arms;

an accumulator;

an assist oil pump; and a second oil control valve for supplying hydraulic pressure from the oil pump of the engine through said accumulator and said assist oil pump to oil chambers of said change-over mechanism means provided in said low-speed rocker arms of said valve-moving apparatus.

12. The internal combustion engine of claim 11 wherein each said high-speed rocker arm has a high-speed roller bearing means, and said hydraulic pressure supply means further includes an oil jet provided in said rocker shaft part for supplying hydraulic oil to said high-speed roller bearing means.

13. The internal combustion engine of claim 12 wherein said oil jet includes an outlet part and an oil reservoir adjacent said outlet part.

14. The internal combustion engine of claim 11 wherein said second oil control valve is disposed between said intake cam shaft and said exhaust cam shaft.

15. The internal combustion engine of claim 11 wherein an oil pump cam shaft, and said assist oil pump is formed on one side of said cam shaft, and driven by said oil pump cam.

16. The internal combustion engine apparatus of claim 15 wherein said oil pump cam is formed on one end of said intake cam shaft.

17. The internal combustion engine of claim 11 wherein said assist oil pump or said accumulator is disposed between said intake cam shaft and said exhaust shaft.

18. The internal combustion engine of claim 11 wherein said accumulator is disposed between said intake cam shaft and said exhaust cam shaft, and said assist oil pump is formed on said accumulator.

19. The internal combustion engine of claim 1 further having a plurality of cylinders, said plurality of cylinders consisting of a first portion and a second portion, wherein said first portion is provided with said valve-moving apparatus.

20. The internal combustion engine of claim 19 wherein said second portion is provided with a variable valve-moving apparatus driven by said low-speed cam or said high-speed cam.

* * * * *